US008336475B2

(12) United States Patent
Morin

(10) Patent No.: US 8,336,475 B2
(45) Date of Patent: Dec. 25, 2012

(54) TRANSFORMABLE, MULTIFUNCTIONAL AND SELF-STOWAGE WATERCRAFT

(76) Inventor: Ronald Morin, Quebec (CA)

( * ) Notice: Subject to any disclaimer, the term of this patent is extended or adjusted under 35 U.S.C. 154(b) by 360 days.

(21) Appl. No.: 12/086,494

(22) PCT Filed: Dec. 14, 2006

(86) PCT No.: PCT/CA2006/002042

§ 371 (c)(1),
(2), (4) Date: Apr. 12, 2010

(87) PCT Pub. No.: WO2007/068117

PCT Pub. Date: Jun. 21, 2007

(65) Prior Publication Data

US 2011/0041748 A1 Feb. 24, 2011

Related U.S. Application Data

(60) Provisional application No. 60/750,050, filed on Dec. 14, 2005.

(51) Int. Cl.
*B63B 35/00* (2006.01)

(52) U.S. Cl. ..... 114/39.22

(58) Field of Classification Search .... 114/39.11–39.15, 114/39.12, 39.22, 39.25, 39.29, 39.32, 343, 114/347, 360, 361, 364, 89, 90, 102.11, 102.15, 114/108, 121, 122, 126, 127, 138, 201 R
See application file for complete search history.

(56) References Cited

U.S. PATENT DOCUMENTS

| | | | | | |
|---|---|---|---|---|---|
| 3,291,088 | A | * | 12/1966 | Klose | 114/39.25 |
| 3,956,785 | A | * | 5/1976 | Halfon | 114/357 |
| 4,543,898 | A | | 10/1985 | Castilla | |
| 4,934,302 | A | | 6/1990 | Harper | |
| 5,106,248 | A | * | 4/1992 | Harris | 410/107 |
| 5,377,607 | A | | 1/1995 | Ross | |
| 5,937,785 | A | | 8/1999 | Murray, III | |
| 6,032,964 | A | * | 3/2000 | Capobianco | 280/47.331 |

FOREIGN PATENT DOCUMENTS

| | | |
|---|---|---|
| WO | WO 03/016131 | 2/2003 |
| WO | WO 03/024777 | 3/2003 |

* cited by examiner

*Primary Examiner* — Daniel Venne
(74) *Attorney, Agent, or Firm* — Equinox Protection; Franz Bonsang, Patent Agent

(57) ABSTRACT

A watercraft comprising a main body having hull, a bow end and an opposite stern send, a starboard, a port and a deck. A plurality of watercraft articles are removably mountable to the main body and provide for transforming the watercraft into a variety of watercraft types. The main body comprises a watercraft article-receiving assembly for stowing the watercraft articles therein. Thus providing a transformable, multifunctional and self-stowage watercraft. These watercraft types include a kayak, a paddle boat, a sailboat, a catamaran, a trimaran, a motorboat, a sit-in/on windsurfer/sailboard and any combinations thereof. A removable trailer assembly for the land-transport of a watercraft is also provided. A rudder control assembly for a watercraft having a rudder is also disclosed.

41 Claims, 58 Drawing Sheets

B
W
605
601
610

608
599
598
605

616
W

603
W

603b
W
604

616
B
604
W
603b

TRANSFORMABLE, MULTIFUNCTIONAL AND SELF-STOWAGE WATERCRAFT

FIELD OF THE INVENTION

The present invention relates to a watercraft. More specifically, the present invention is concerned with a transformable, multi-functional and self-stowage watercraft.

BACKGROUND OF THE INVENTION

Conversion arrangements for boats are known in the art.

U.S. Pat. No. 5,377,607 issued to Ross on Jan. 3, 1995 teaches a multi-functional arrangement for converting a sail board into a row boat, a kayak or a conventional sailing craft having a multi-functional seat including a back support adapted to be adjustable between a sailing/hiking position, rowing position and paddling position. The seat is also moveable. U.S. Pat. No. 4,543,898 issued to Castilla on Oct. 1, 1985 teaches a boat that is convertible between outboard motor drive and sail drive.

International Application Number PCT/CA02/01270 teaches a collapsible portable watercraft that can be easily assembled from modular unitary components using minimal hardware. U.S. Pat. No. 4,934,302 issued to Harper on Jan. 19, 1990 teaches a combination storage and transportation apparatus having a mobile trailer and a unitary cover cantilevered for being raised and lowered via actuators enclosing the watercraft therein.

Drawbacks with conventional transformable watercrafts include: the large number pieces that are inconvenient for quick use and storage, the fact that tools need to be used when adding or removing pieces, the limited multi-functionality of the watercraft, the lack of stowage compartments, the inconvenience of land transport as well as other cumbersome drawbacks, which makes the product unattractive or unpractical to consumers.

OBJECTS OF THE INVENTION

An object of the present invention is to provide a transformable, multi-functional and self-stowage watercraft.

Another object of the present invention is to provide a kit for a transformable, multi-functional and self-stowage watercraft.

A further object of the present invention is to provide a trailer assembly for the land-transport of a watercraft.

Yet another object of the present invention is to provide a rudder control assembly for a watercraft having a rudder.

Yet a further object of the present invention is to provide a mast-wishbone mounting bracket.

Still another object of the present invention is to provided a locking assembly for locking onto a deck of a watercraft an auxiliary member.

Still a further object of the present invention is to provided a watercraft a hatch member lockable to the floor and/or deck of the watercraft.

Still yet another object of the present invention is to provide a hatch that is provide a mast well opening for receiving a mast therethrough or mounting a base-receiving element thereto for receiving a mast base thereon.

Still yet a further object of the present invention is to provide a trapeze outrigger seat that is foldable and pivotable about a watercraft element between an outrigger position and an inner stowed position.

Another yet object of the present invention is to provide a retractable cleat for a watercraft.

A further yet aspect of the present invention is to provide an adjustable outrigger hull assembly for a watercraft.

SUMMARY OF THE INVENTION

In accordance with an aspect of the present invention there is provided a watercraft comprising: a main body comprising at least one hull, a bow end and an opposite stern end, a starboard lateral side and a port lateral side and a deck; and a plurality of watercraft articles removably mountable to said main body and providing for transforming said watercraft into a variety of watercraft types; wherein said main body comprises a watercraft article-receiving assembly for stowing said watercraft articles therein.

In accordance with another aspect of the present invention there is provided a watercraft kit comprising: a watercraft body providing inner stowage; and a plurality of watercraft auxiliary articles removably stowable within said watercraft body and removably and operationally mountable to said watercraft body, wherein when mounting a given number and combination of said plurality of watercraft articles on said watercraft body, said watercraft body is transformed into a given watercraft type.

In accordance with a further aspect of the present invention there is provided a trailer assembly for the land-transport of a watercraft, said assembly comprising wheel members being mountable to an axle-shaft assembly, said axle-shaft assembly being mountable to an axle-shaft assembly receiving portion formed in the watercraft, wherein said wheels when mounted to said watercraft provide for land-transport of the watercraft.

In accordance with yet another aspect of the present invention there is provided a rudder control assembly for a watercraft having a rudder, the rudder being pivotable about a vertical axis thereof, said rudder control assembly comprising: a rotary plate member mountable to the deck of the watercraft and being rotatably moveable about an axis thereof; a driving assembly mounted to said rotary plate member and to the rudder; wherein rotational movement of said plate member actuates said driving assembly causing the rudder to correspondingly pivot about its vertical axis.

In accordance with yet a further aspect of the present invention there is provided a bracket mounting a watercraft wishbone to a watercraft mast, said bracket comprising; a mast mounting casing for being mounted about the mast; a wishbone mounting casing for being mounted to said mast mounting casing and comprising a wishbone receiving portion; and a locking assembly for:—locking said mast mounting casing to said mast;—locking said wishbone mounting casing to said mast mounting casing when said mast mounting casing is mounted to the mast; and—locking said wishbone mounting casing to the wishbone when said wishbone mounting casing is mounted to the mast mounting casing.

In accordance with still another aspect of the present invention, there is provided a locking assembly for locking onto a deck of a watercraft an auxiliary member, the auxiliary member being mounted to the deck about an opening thereof with at least a portion of the auxiliary member abutting the deck, said assembly comprising: a locking member comprising a cup and a cap, said cup threadety mounted within said recess of the auxiliary member, said cup having a bottom opening and a stopper locking member, said cap having an edge for abutting said auxiliary member, a cord mounted within said cup and being mounted to a tensioning assembly via said cup bottom opening; and a stopper mounted to said cord; wherein said cup is threadedly moveable within the recess between a locking position which causes via said tension assembly tension on said cord thereby causing said stopper to lock with said stopper locking member; and an unlocked position wherein said cord tension is release thereby causing said stopper to unlock from said stopper locking member, wherein when in said locking position said cap mounted to said cup lockingly acts on the auxiliary member which lockingly acts on the deck.

In accordance with still a further aspect of the present invention, there is provided a watercraft comprising a hatch member removably mountable to an opening of a deck thereof, said hatch member comprising mating elements about an edge thereof for lockingly and releasably engaging complementary mating elements about an deck opening edge, lockingly and releasably engaging complementary mating elements about a floor opening edge within said watercraft.

In accordance with still yet another aspect of the present invention, there is provided a watercraft having a deck and an inner floor, said deck comprising a mast well, a base receiving element being securely mountable within said mast well, for receiving a mast base thereon, said floor comprising a mast support for so as to receive mast through said mast well.

In accordance with still yet a further aspect of the present invention, there is provided a mast base receiving element having engaging elements for being securely mountable within a mast well opening, so as to receive a mast base thereon.

In accordance with yet still another aspect of the present invention, there is provided a seating arrangement for a watercraft having deck opening leading to the inside of the watercraft and having an inner seat-receiving member, said seating arrangement comprising a mounting portion for being pivotally mounted to said seat-receiving member so as to be pivotable from in an inside stowed position, internally positioned relative to said deck opening, to an outrigger in-use position, externally positioned relative to said deck opening, about said seat-receiving member.

In accordance with another yet aspect of the present invention, there is provided a retractable cleat for a watercraft, said cleat comprising a casing for being mounted within a recess of the watercraft, said casing including a screw member being threadably mounted within said casing, said screw member carrying at least one shackle member, wherein said screw member is movable between a first position where said shackle is above the watercraft surface about the recess and a second position where said shackle is below the watercraft surface about the recess.

In accordance with a further yet aspect of the present invention, there is provided n outrigger hull assembly for a watercraft comprising: outrigger hull members; and at least one beam, said outrigger hull members elements being mountable to said beam; said beam being mountable to the watercraft via beam-receiving portions; wherein said beam provides for said outrigger hull members to be positioned at distances with respect to said watercraft hull.

The term "watercraft article" should be construed herein as to include without limitation any auxiliary part, portion, member, component, assembly, fixture, mechanism, means, element, that is not immovably integral to the watercraft for transforming alone or with other watercraft articles the watercraft into one or more watercraft types and/or for adding a particular feature to the watercraft and/or having a functionality or any and/or all combinations thereof.

The term "watercraft type" should be construed herein as to include without limitation any of the various watercrafts described herein such as sailboat, a sailboard, a windsurfboard, a single-hull board, a multi-hull board, a catamaran, a trimaran, a paddle boat, a kayak, a canoe, a fishing boat, a mortorboat, a sit-in boat, a sit-on boat, a single cockpit boat, a multi-cockpit boat, watercraft having one ore more watercraft articles as defined herein and the like, including any and/or all combinations thereof.

The following enumerates only some non-limiting features that the present invention provides:—integrated design for multiple watercraft configurations (for example one hull, two hulls, three hulls, paddle, sail, motor, solo and duo);—integrated self stowage having multiple spaces, for all configuration elements (articles);—direct fitting and use of sailboard rigging (including mast, sail, and wishbone) as well as paddleboat use;—rotary mast having a low friction base; various types of rudder actions (such as foot/tiller/disk) with safety rudder lock down position; integrated axle-well with axle/wheels;—detachable outboard motor mount; detachable/adjustable outrigger (trapeze) seats;—watertight solid hatch and cockpit covers (lockable) or flexible covers adjustable and removable mountable keel (centreboard, daggerboard); removably mountable outboard motor bracket;—lightweight watercraft suitable for car top transport;—no tools or additional parts required; easy and quick to set-up, use, transport and store;—can be constructed out of a variety of materials and/or framing.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings where like reference numerals denote like elements throughout and in which:

FIG. 50 is another side view of the watercraft of FIG. 54, in operation;

FIG. 119 is a top view of a boat according to an embodiment of the present invention;

FIGS. 120 and 121 illustrate a suspension cartridge system for insertion inside the boat of FIG. 119;

FIG. 122 illustrates a wheel adjustment mechanism via the suspension cartridge system of FIGS. 120 and 121;

FIG. 123 shows an exploded view of a cartridge and wheel assembly of FIG. 122 in a disassembled position;

FIG. 124 is a sequential representation of the removal of a wheel assembly from the boat of FIG. 119 in water;

FIG. 125 is a top view of the boat of FIG. 119 with a portion removed to reveal a stowage of a wheel assembly;

FIG. 126 is a cross-sectional front view of the boat of FIG. 119 without the wheel assembly stowed inside;

FIG. 127 is a cross-sectional front view of the boat of FIG. 119 with the wheel assembly stowed inside;

FIG. 128 is a cross-sectional side view of the boat of FIG. 119 with the wheel assembly stowed inside;

FIG. 129 is a cross-sectional side view of the boat of FIG. 119 with a tow assembly;

FIG. 130 is a cross-sectional side view of the boat of FIG. 119 with a tow assembly in a locked position;

FIG. 131 is a side view of the boat of FIG. 119 with a tow assembly in a locked position;

Figure 132:
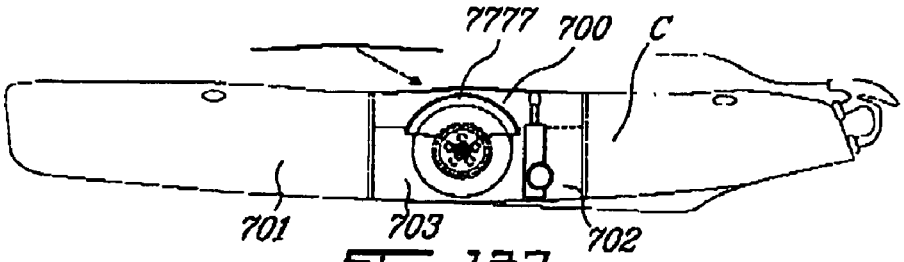
Figure 133:
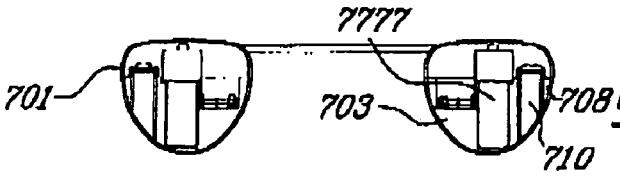
Figure 134:
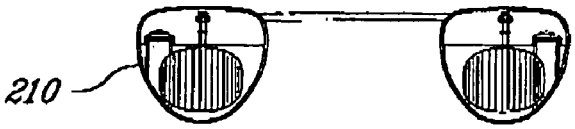
Figure 135:
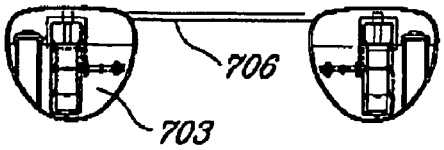
Figure 136:
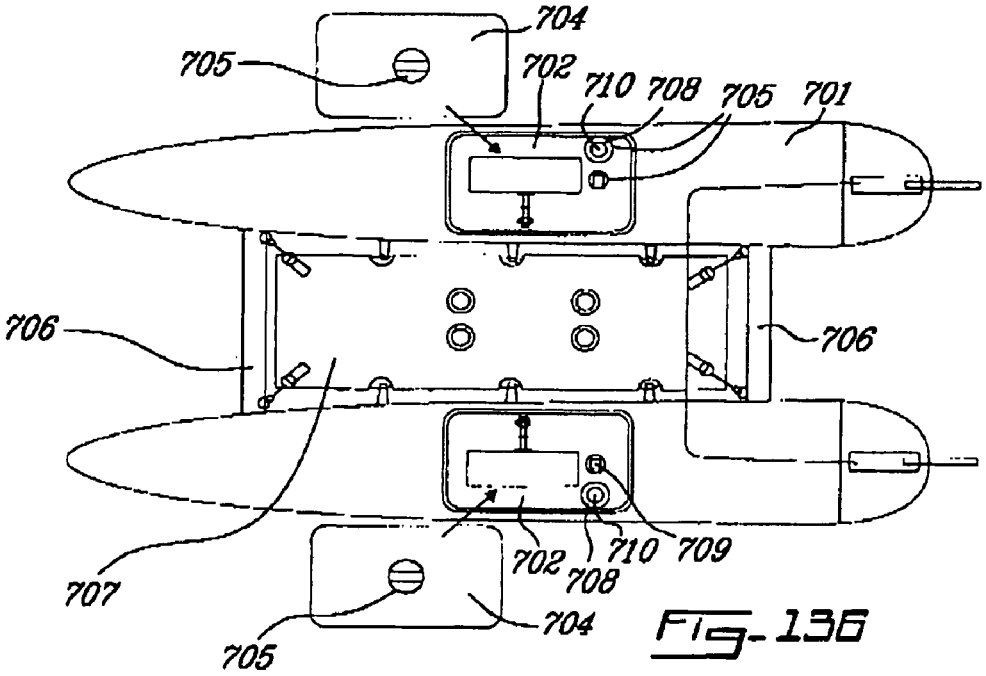
Figure 137:
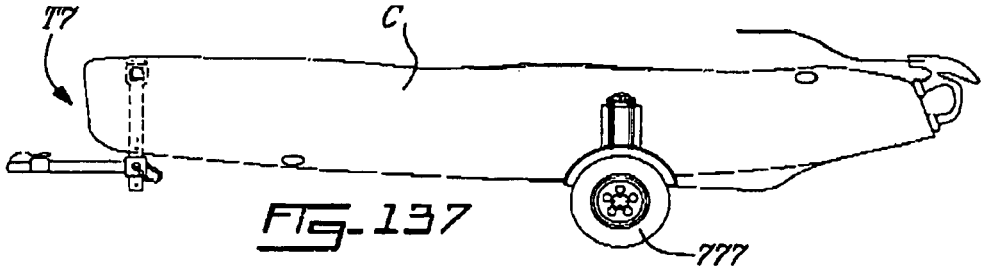
Figure 138:
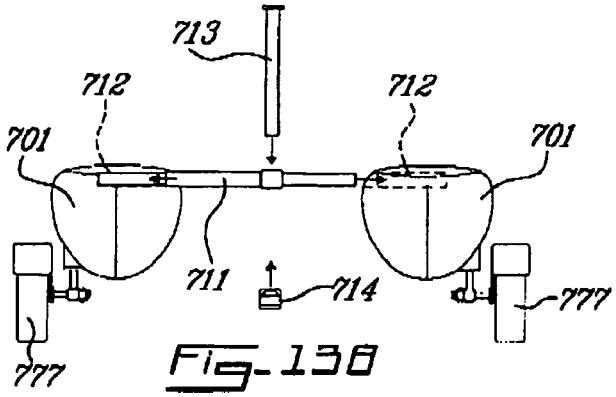
Figure 139:
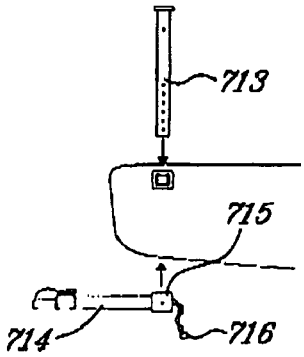
Figure 140:
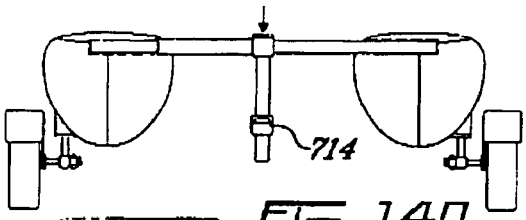
Figure 141:
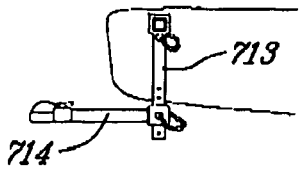
Figure 142:
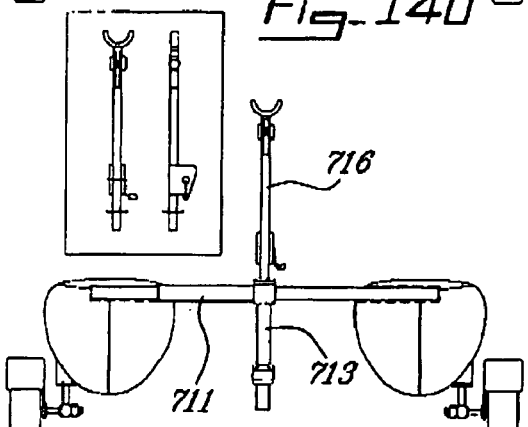
Figure 143:
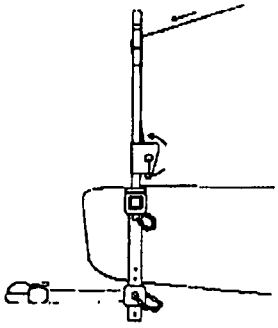
Figure 144:
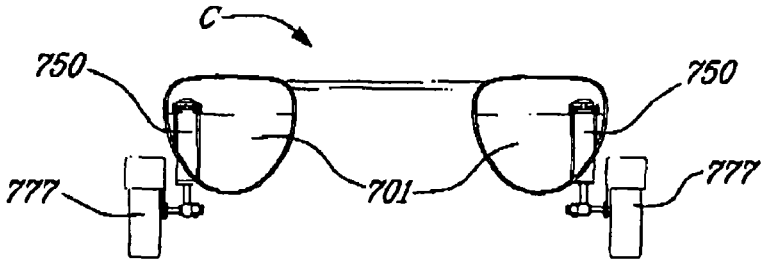
Figure 145:
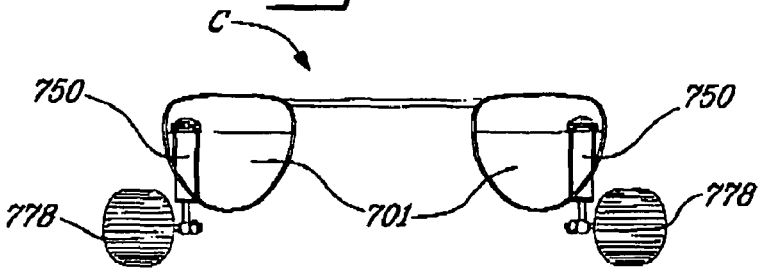
Figure 146:
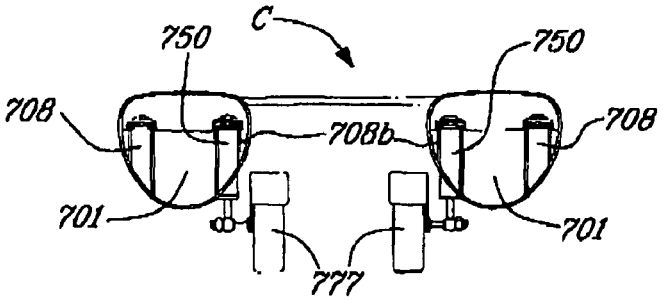
Figure 147:
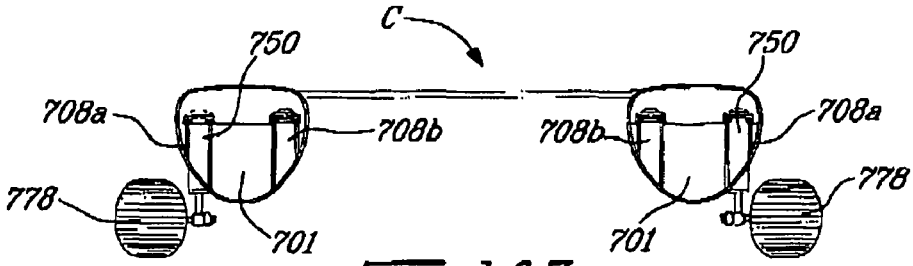
Figure 148:
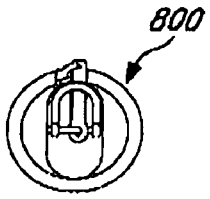
Figure 151:
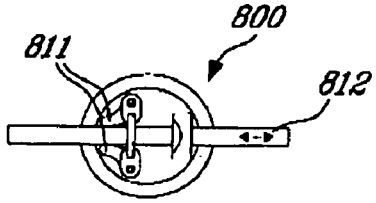
Figure 149:
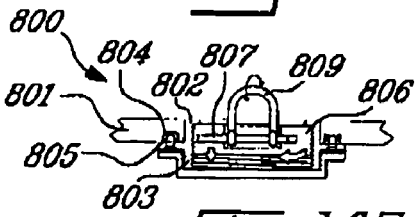
Figure 152:
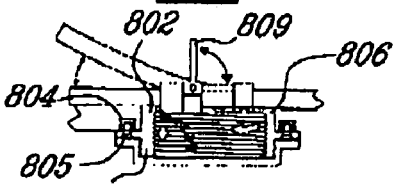
Figure 150:
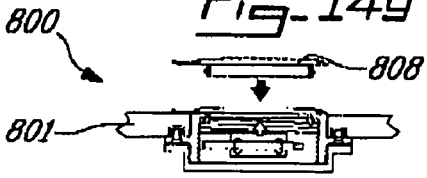
Figure 153:
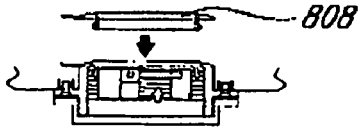
Figure 154:
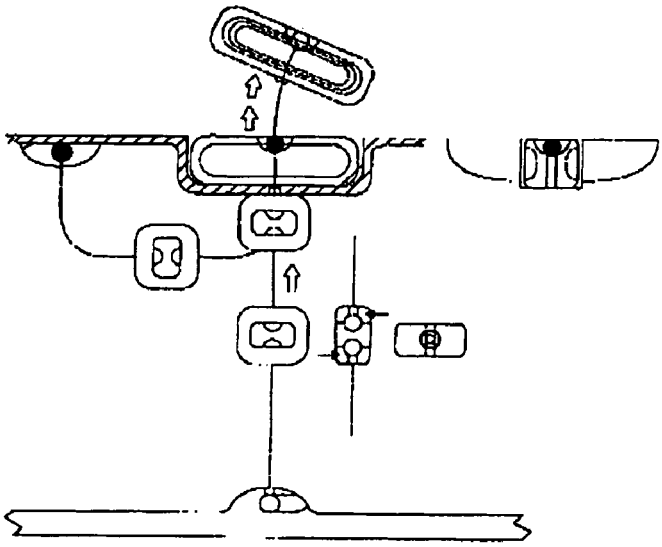
Figure 155:
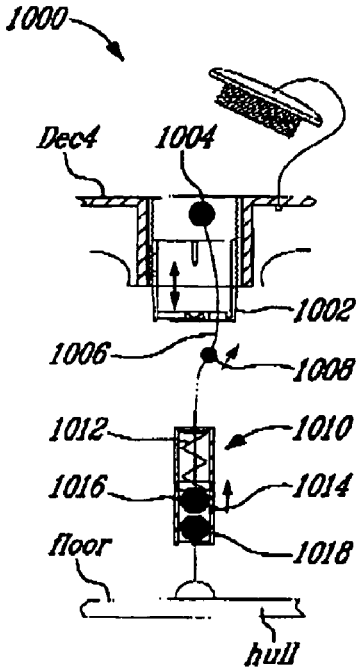
Figure 156:
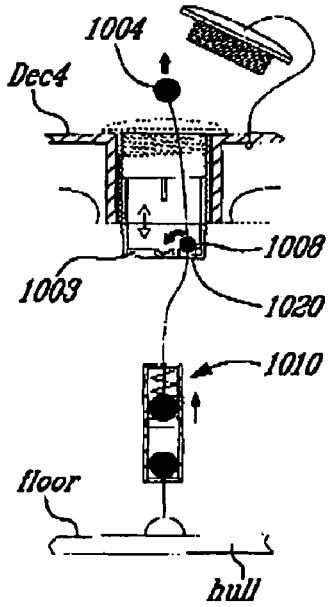
Figure 156A:
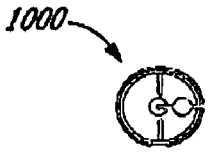
Figure 156B:
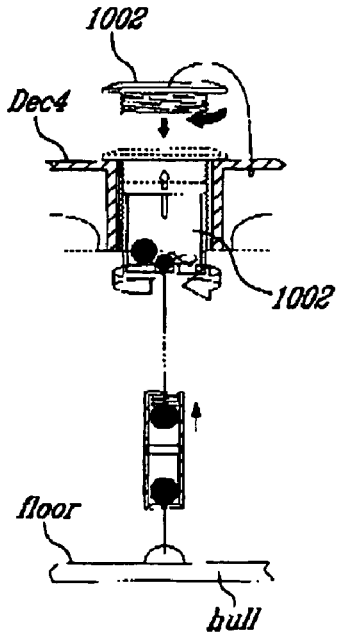
Figure 157:
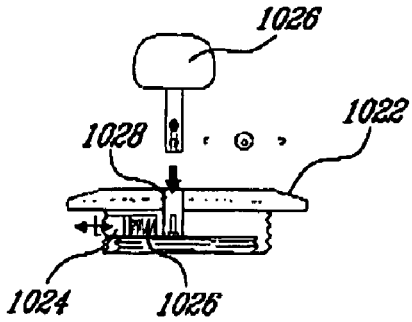
Figure 158:
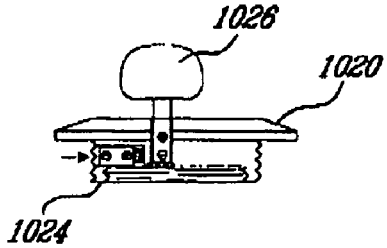
Figure 159:
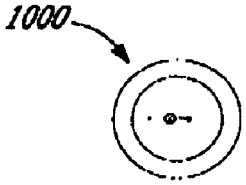
Figure 160:
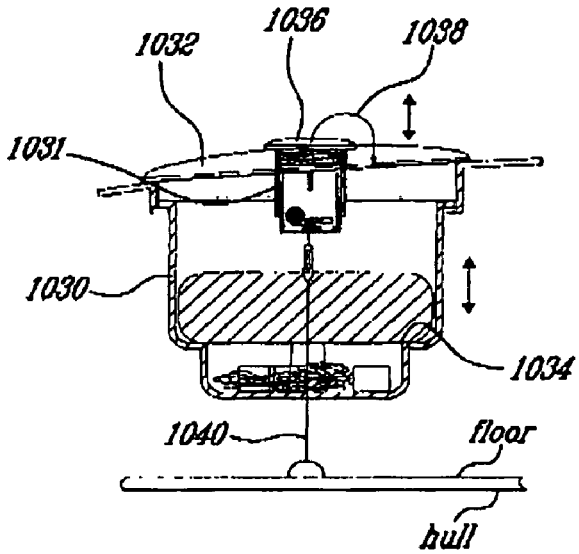
Figures 161, 162, 163, 164, 165:
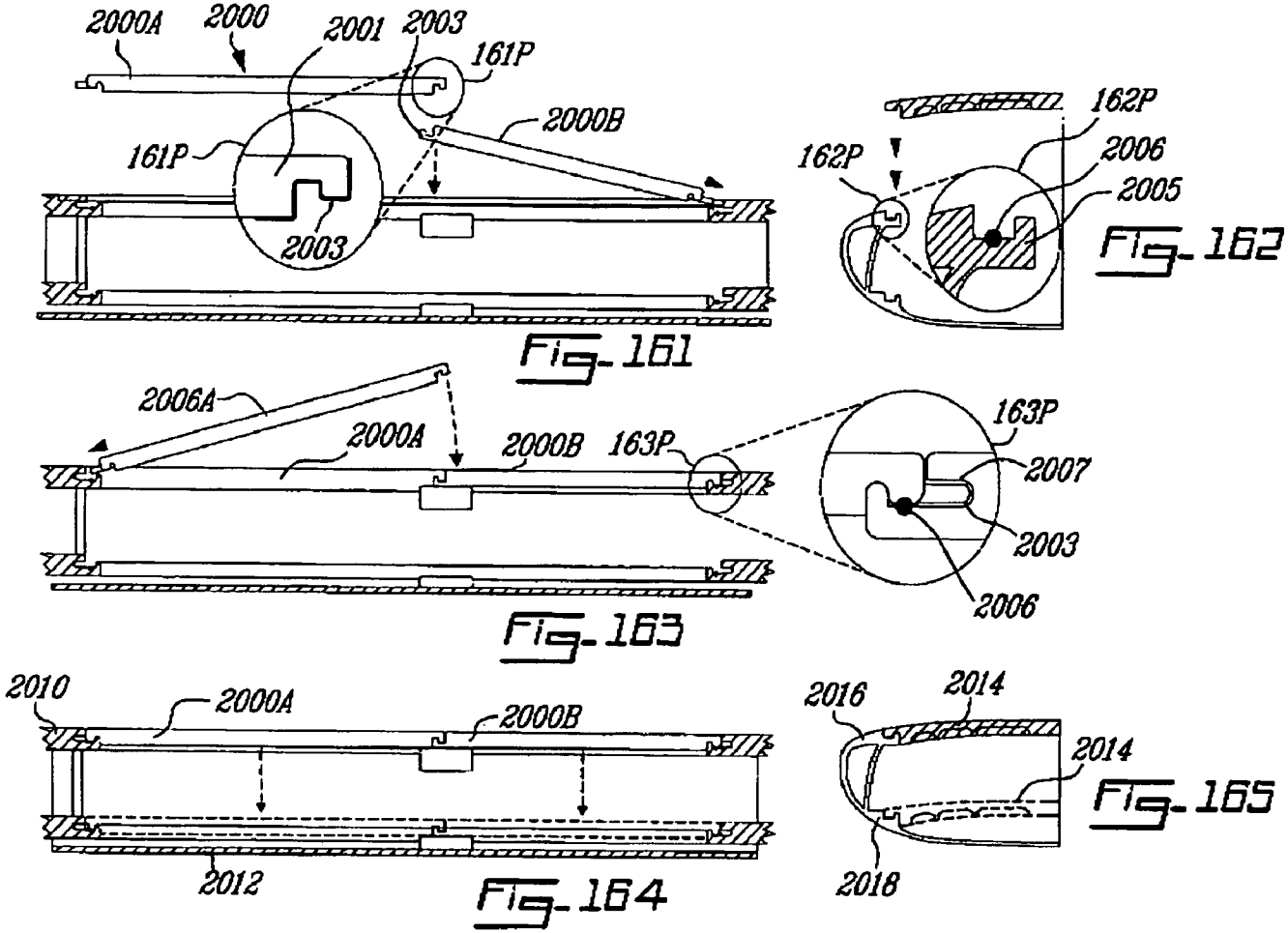
Figure 166:
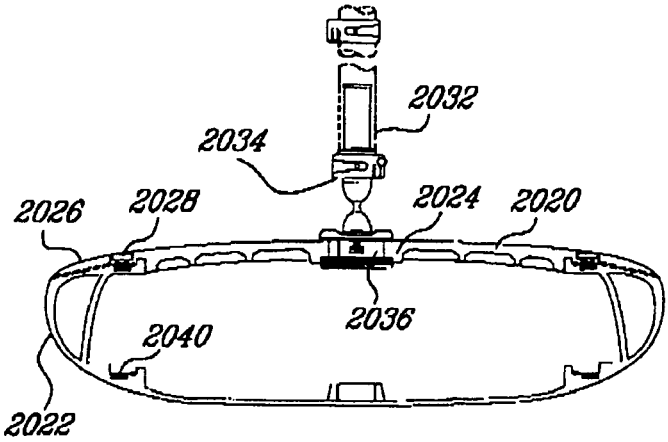
Figure 168:
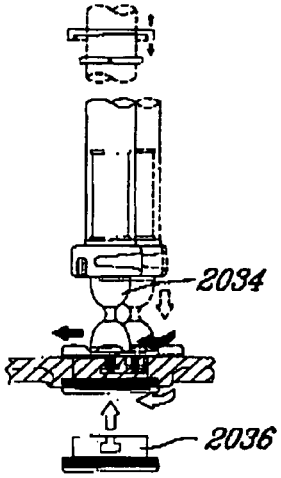
Figure 167:
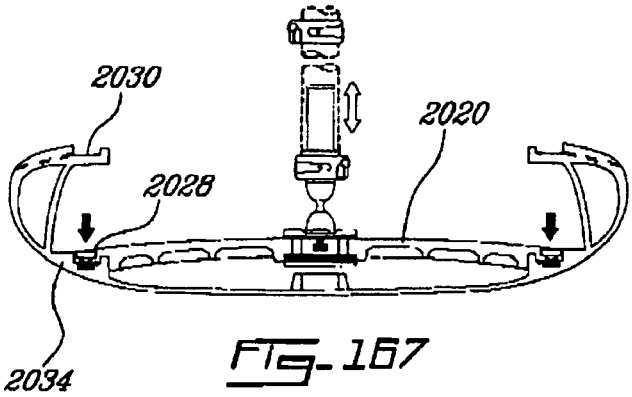
Figure 169:
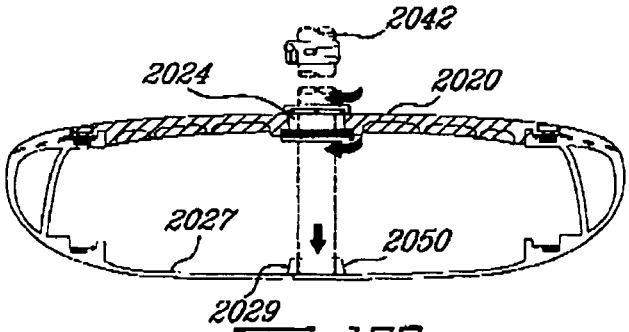
Figure 170:
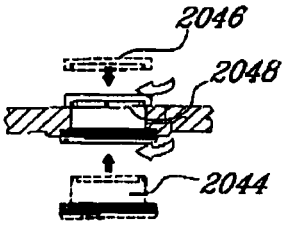
Figure 171:
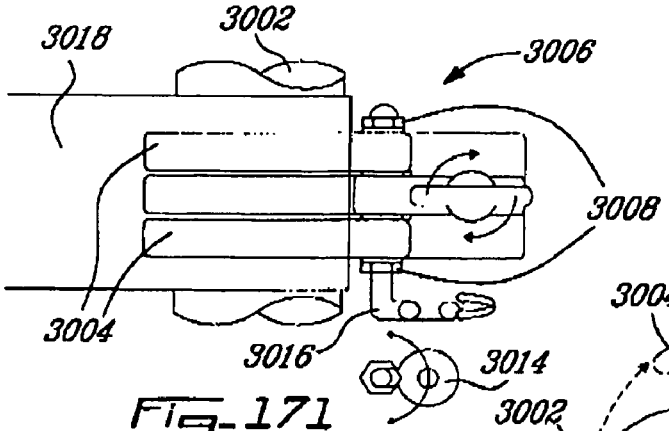
Figure 172:
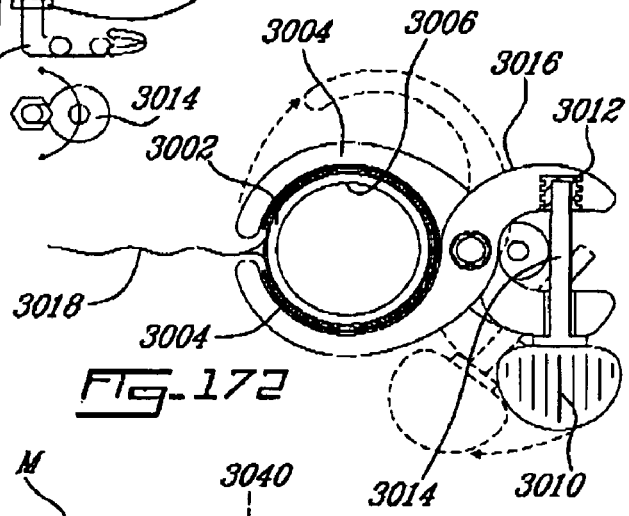
Figure 173:
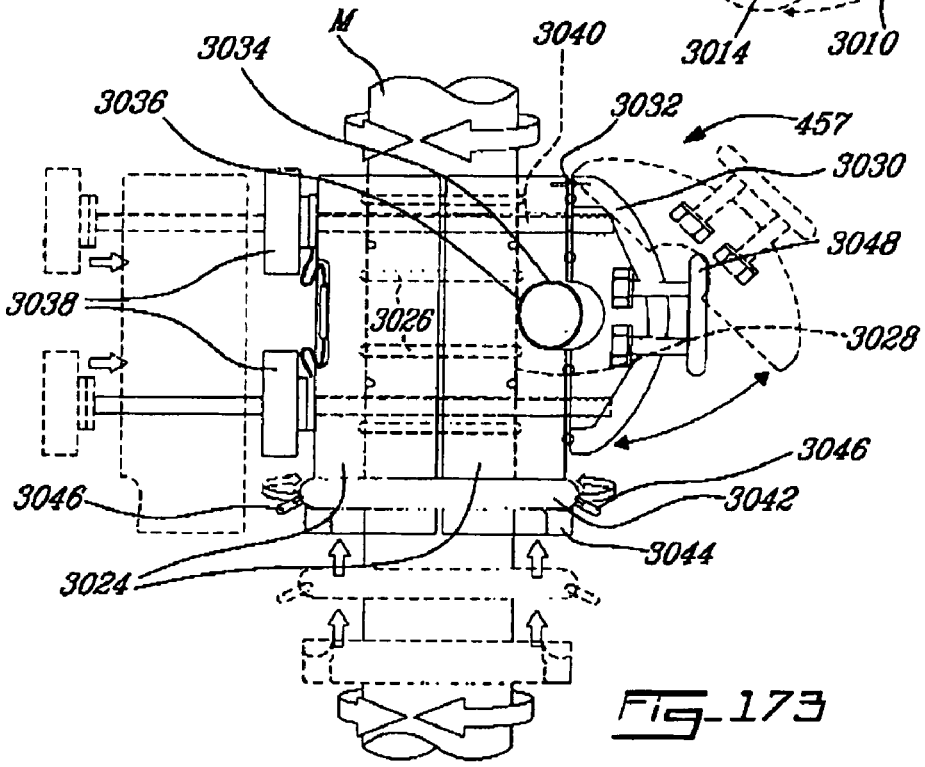
Figures 174A, 174B:
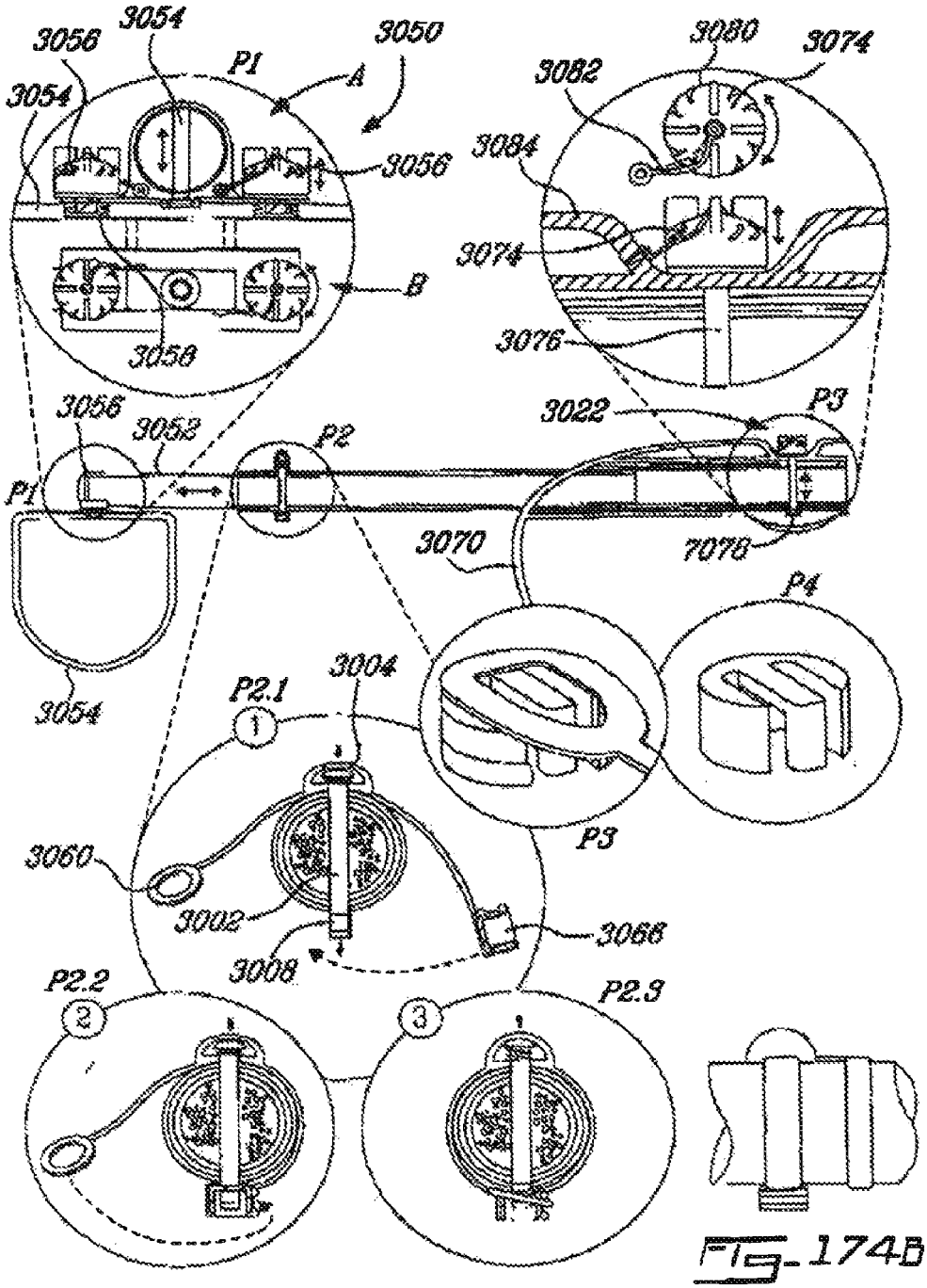
Figure 175:
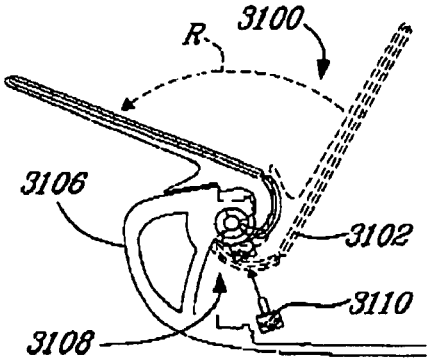
Figure 176:
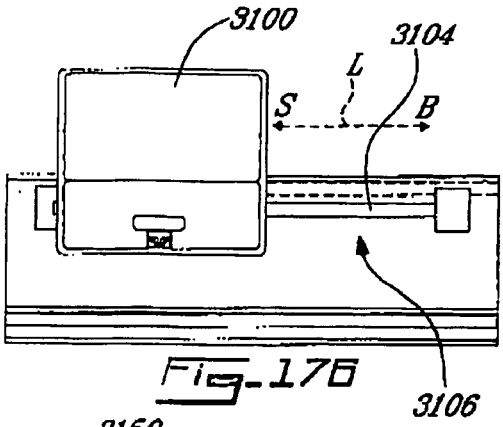
Figure 177:
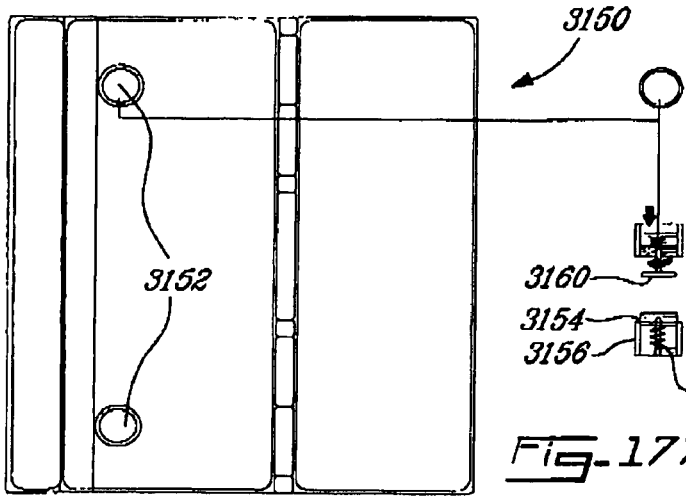
Figure 178:
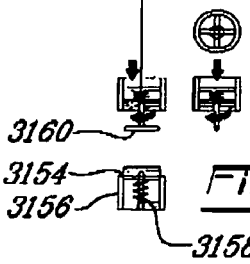
Figure 180:
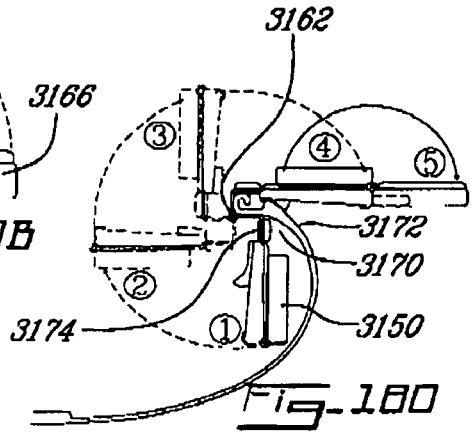
Figure 181:
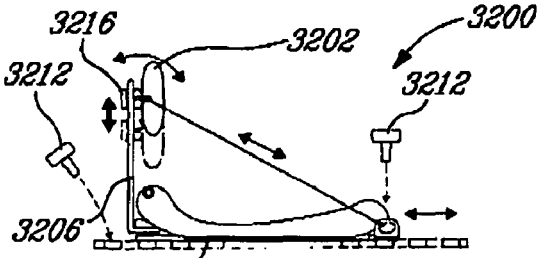
Figure 182:
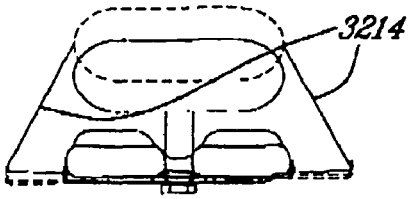
Figure 183:
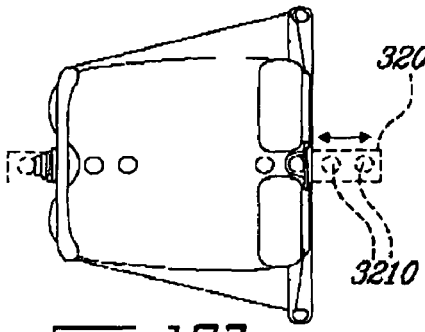
Figure 184:
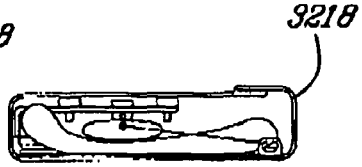
Figure 185:
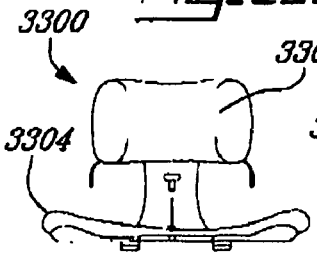
Figure 186:
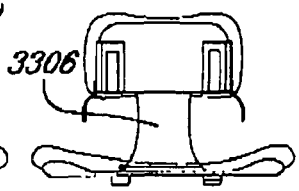
Figure 187:
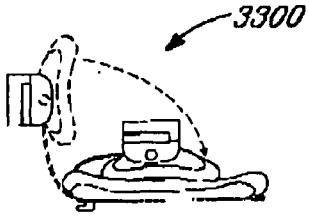
Figure 188:
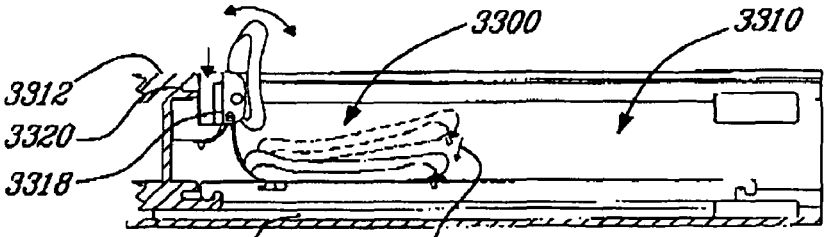
Figures 189, 189A, 189B:
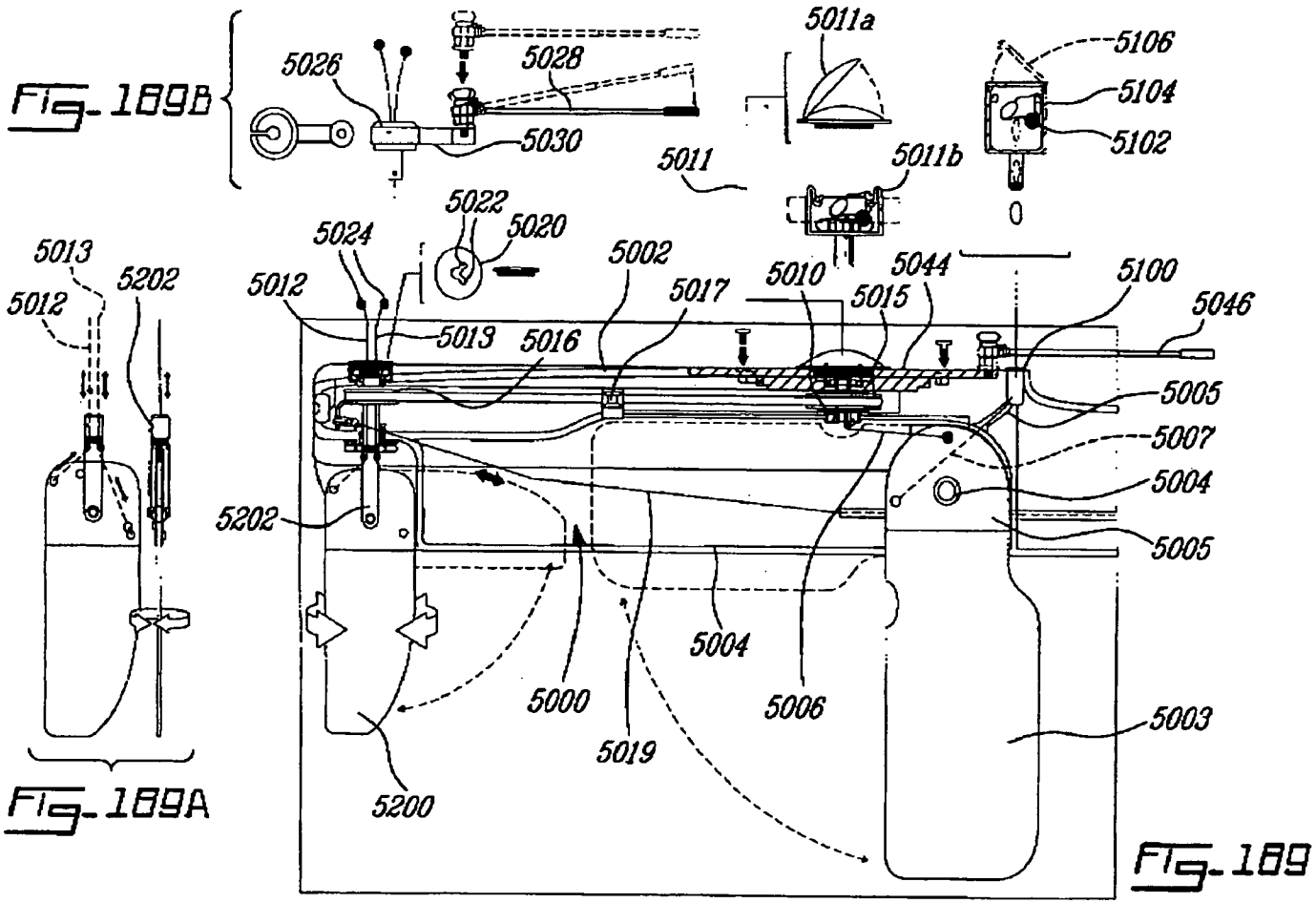
Figure 190:
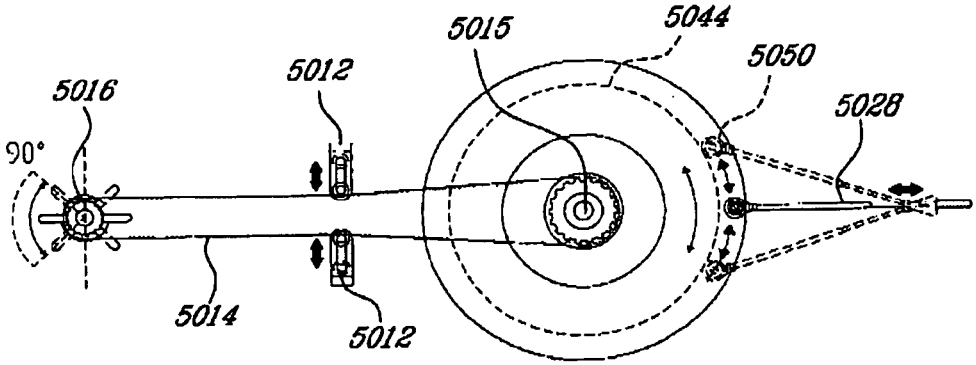
Figure 192:
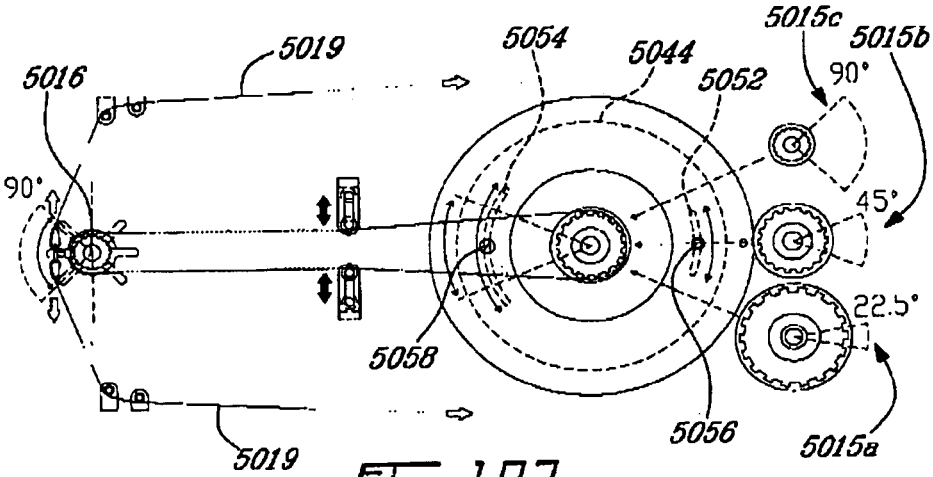
Figure 193:
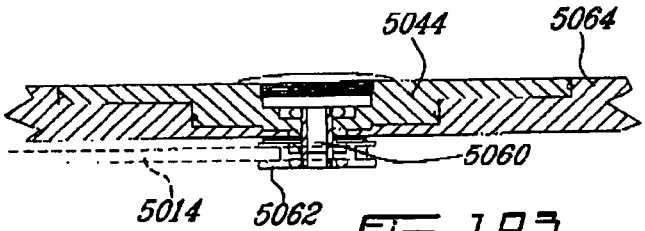

FIG. 132 is a cross-sectional side view of an example of catamaran, with an on-off road wheel assembly stowed in a stowage compartment;

FIG. 133 is a cross-sectional view of an example of the stowage compartment of FIG. 132;

FIG. 134 is a cross-sectional view of another example of the stowage compartment of FIG. 132;

FIG. 135 is a cross-sectional view of a further example of the stowage compartment of FIG. 132;

FIG. 136 is a top view of the catamaran of FIG. 132, with a trampoline mounted thereto;

FIG. 137 is a side view of a catamaran trailer;

FIG. 138 is a schematic front view of the catamaran trailer of FIG. 137, with the telescopic lock vertical beam separated from the telescopic horizontal beam;

FIG. 139 is a schematic side view of the catamaran trailer of FIG. 137, with the telescopic lock vertical beam separated from the telescopic horizontal beam;

FIG. 140 is a schematic front view of the catamaran trailer of FIG. 137, with the telescopic lock vertical beam inserted into the telescopic horizontal beam;

FIG. 141 is a schematic side view of the catamaran trailer of FIG. 137, with the telescopic lock vertical beam inserted into the telescopic horizontal beam;

FIG. 142 illustrates the catamaran trailer of FIG. 140, with a mast support mounted to the horizontal telescopic beam;

FIG. 143 illustrates the catamaran trailer of FIG. 141, with a mast support mounted to the horizontal telescopic beam;

FIG. 144 is a cross-sectional view of a pair of hulls of the catamaran trailer of FIG. 137 having suspension cartridge assemblies mounted to respective wheels:

FIG. 145 is a cross-sectional view of a pair of hulls of the catamaran trailer of FIG. 137 having suspension cartridge assemblies mounted to respective balloon wheels;

FIG. 146 is a cross-sectional view of a pair of hulls of the catamaran trailer of FIG. 137 having two tubular receivers for mounting the wheels to an inner position;

FIG. 147 a cross-sectional view of a pair of hulls of the catamaran trailer of FIG. 137 having two tubular receivers for mounting the wheels to an outer position;

FIG. 148 illustrates a top plan view a U-shackle retractable cleat according to a non-restrictive illustrative embodiment of the present invention;

FIG. 149 is a cross-sectional side view of the retractable cleat of FIG. 148;

FIG. 150 is a cross-sectional side view of the retractable cleat of FIG. 149 with a cover thereon;

FIG. 151 illustrates a top plan view a D-shackle retractable cleat;

FIG. 152 is a cross-sectional side view of the retractable cleat of FIG. 151;

FIG. 153 is a cross-sectional side view of the retractable cleat of FIG. 152 with a cover thereon;

FIG. 154 illustrates a retractable handle assembly according to an embodiment of the present invention;

FIG. 155 illustrates a latch lock device attached to a spring system;

FIG. 156 illustrates the latch lock device of FIG. 156 with the spring in tension;

FIG. 156*a* is a top view of the bottom of the latch lock device of FIG. 155;

FIG. 156*b* illustrates the latch lock device of FIG. 156 with the spring in maximum tension;

FIG. 157 is another illustration of a latch lock device comprising a magnetic key having a spring;

FIG. 158 illustrates the latch lock device of FIG. 157 with the spring inserted in the slot;

FIG. 159 is a top view of the latch device of FIG. 157;

FIG. 160 is a cross-sectional side view of a canister;

FIG. 161 illustrates removable hatches according to a non-restrictive illustrative embodiment of the present invention;

FIG. 162 illustrates an extremity of a deck body where a hatch from FIG. 161 can connect thereto;

FIG. 162P is a zoom of the portion the deck body for receiving a hatch from FIG. 161;

FIG. 163 illustrates a hatch being inserted in the deck body;

FIG. 163P is a zoom of the connecting portion between the hatch and deck body of FIG. 163;

FIG. 164 illustrates more than one hatch being inserted in the deck body;

FIG. 165 illustrates a hatch received into the deck body of FIG. 162P;

FIG. 166 is a schematic view of a watercraft comprising a panel and a mast receiving aperture;

FIG. 167 illustrates lock knobs for mounted the panel to the watercraft of FIG. 166;

FIG. 168 illustrates a mast receiving element of FIG. 166;

FIG. 169 illustrates a mast mounted within the panel of FIG. 166;

FIG. 170 illustrates a mast sleeve used in FIG. 169;

FIG. 171 is side view of a removable mast halyard bracket;

FIG. 172 is a top view of the removable mast halyard bracket of FIG. 171;

FIG. 173 illustrates a mast wishbone bracket;

FIGS. 174*a* and 174*b* illustrate an outrigger beam hull mounting bracket;

FIG. 175 illustrates an outrigger seat according to a non-restrictive illustrative embodiment of the present invention;

FIG. 176 illustrates an enlarged version of the outrigger seat of FIG. 175;

FIG. 177 illustrates a retractable outrigger seat;

FIG. 178 illustrates push button lock knobs of the retractable outrigger seat of FIG. 177;

FIG. 179 illustrates the retractable outrigger seat of FIG. 177 rotated about a hinge in a rotation position;

FIG. 180 illustrates the retractable outrigger seat of FIG. 177 rotated about a hinge in other rotation positions;

FIG. 181 illustrates a side view of a seat for kayaking according to a non-restrictive illustrative embodiment of the present invention;

FIG. 182 is a rear view of the seat for kayaking of FIG. 181;

FIG. 183 is a top view of the seat for kayaking of FIG. 181;

FIG. 184 illustrates a folded position of the seat of FIG. 181, within a seat bag;

FIG. 185 illustrates a cockpit seat according to a non-restrictive illustrative embodiment of the present invention;

FIG. 186 is a cross-sectional view of the cockpit seat of FIG. 185;

FIG. 187 illustrates a folded position of the cockpit seat of FIG. 185;

FIG. 188 illustrates the cockpit seat of FIG. 185 placed within a compartment;

FIG. 189 illustrates a retractable rudder and keel assembly of a watercraft according to a non-restrictive illustrative embodiment of the present invention;

FIG. 189*a* illustrates a cord pulling up and down mechanism for moving the rudder of FIG. 189;

FIG. 189*b* illustrates a rotating mechanism for rotating the rudder of FIG. 189;

FIG. 190 illustrates a rotary foot control disk for the rudder of FIG. 189;

FIG. 192 illustrates another example of a rotary foot control disk for the rudder of FIG. 189; and FIG. 193 illustrates a further example of a rotary foot control disk for the rudder of FIG. 189.

DESCRIPTION OF ILLUSTRATIVE EMBODIMENTS

The present invention is illustrated in further details by the following non-limiting examples. The invention concerns a watercraft that is multifunctional, and transformable; the invention also concerns a variety of watercraft components and sub-parts as well as the self-stowage structure of the watercraft for storing these various components.

Watercrafts

Figure 1:
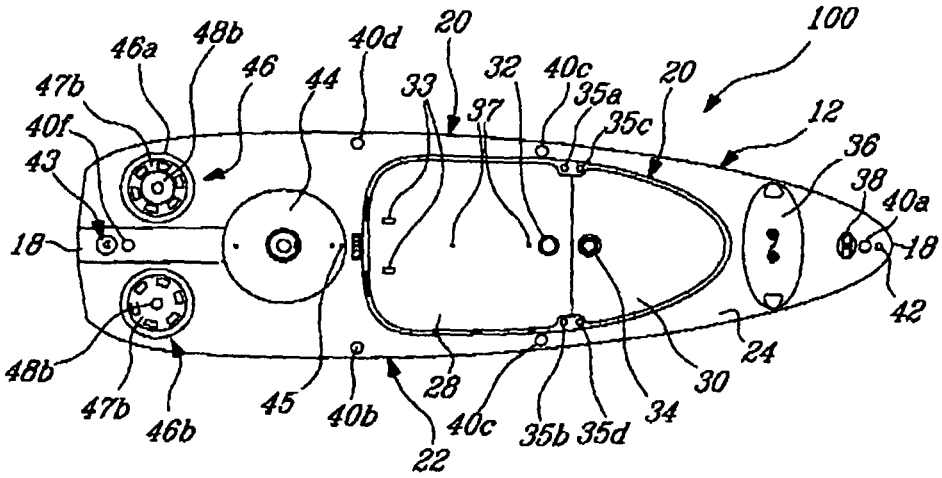
FIG. 1 is a top plan view of a watercraft according to a non-restrictive illustrative embodiment of the present invention.
Figure 114:
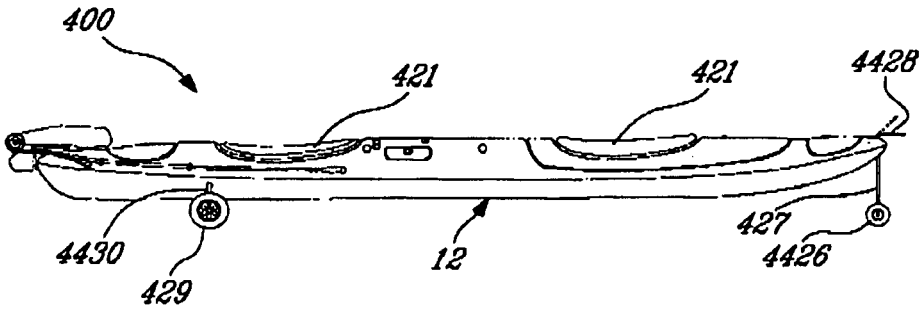
FIG. 114 is a side plan view of the watercraft of FIG. 113.

FIGS. 1 to 114 illustrate a variety of watercrafts in accordance with embodiments of the present invention. These watercrafts are transformable into a variety of watercraft types as will be understood by the skilled artisan and as such as multifunctional. In order to be transformable into more than one watercraft type a variety of watercraft articles are required. This variety of watercraft articles are stowed within the article-receiving assemblies Provided by the watercraft.

Figures 115, 116, 117, 118:
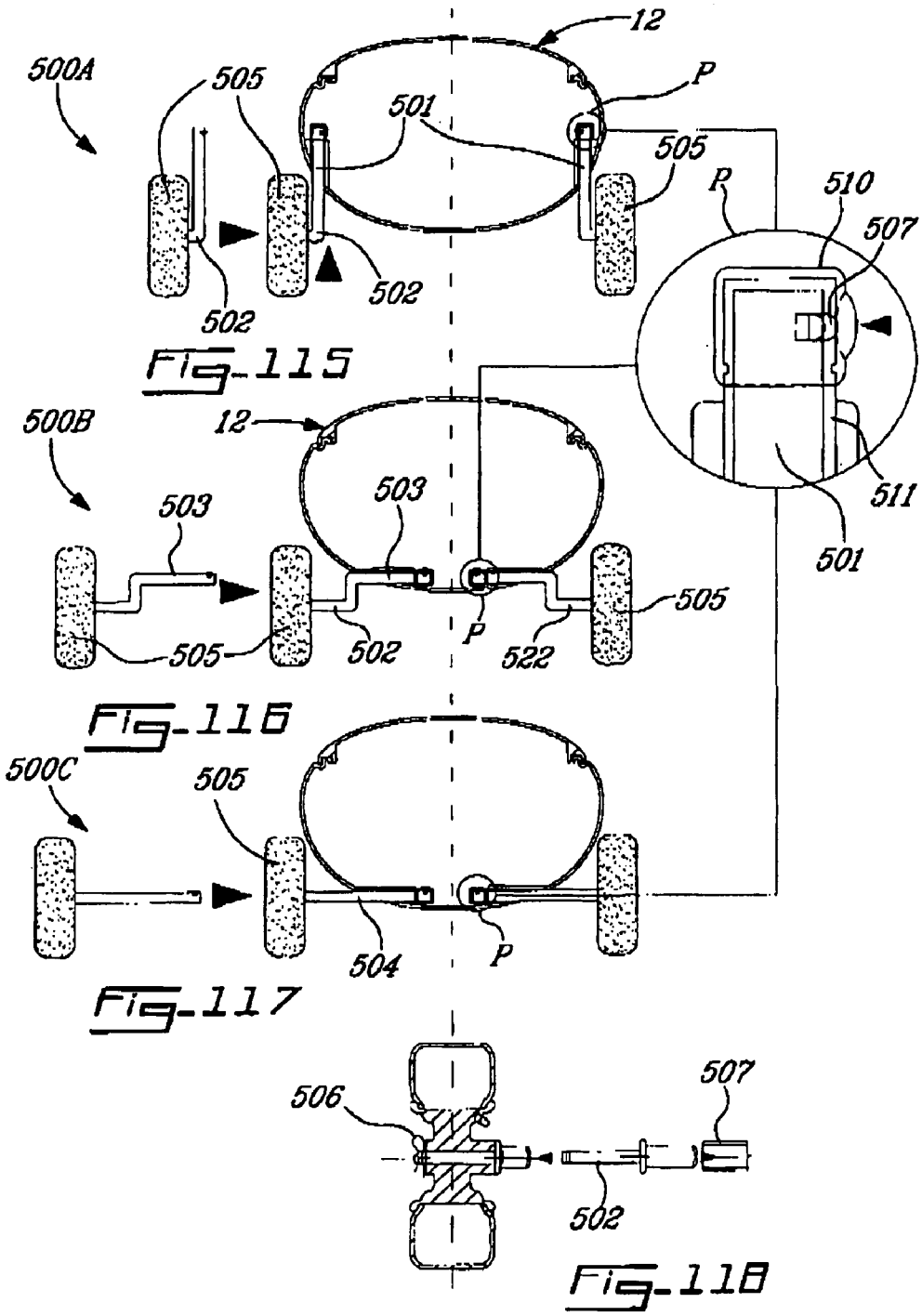
FIG. 115 illustrates a wheel assembly mountable to a watercraft, according to a non-restrictive illustrative embodiment of the present invention.
FIG. 116 illustrates an example of a wheel, assembly mountable to a watercraft, according to a non-restrictive illustrative embodiment of the present invention.
FIG. 117 illustrates another example of a wheel assembly mountable to the watercraft.
FIG. 118 illustrates a further example of a wheel assembly mountable to the watercraft.

As will be detailed herein, FIGS. 1 to 29, show a watercraft 100 in accordance with a first non limiting illustrative embodiment of the present invention; FIGS. 30 to 40 show a watercraft 200 in accordance with a second non limiting illustrative embodiment of the present invention; FIGS. 41 to 81*b* show a watercraft 300 in accordance with a third non limiting illustrative embodiment of the present invention; FIGS. 82 to 114 show a watercraft 400 in accordance with a fourth non limiting illustrative embodiment of the present invention; FIGS. 115 to 193 illustrate a variety of watercraft elements.

Watercraft 100

FIGS. 1 to 29 show the watercraft 100 in accordance with an embodiment of the present invention. Watercraft 100 is a transformable, multi-functional and self-stowage watercraft. In one non-limiting example, watercraft 100 is about ten feet in length.

Figure 2:
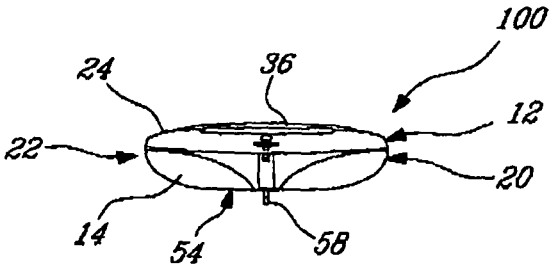
FIG. 2 is a rear plan view of the watercraft of FIG. 1.
Figure 3:
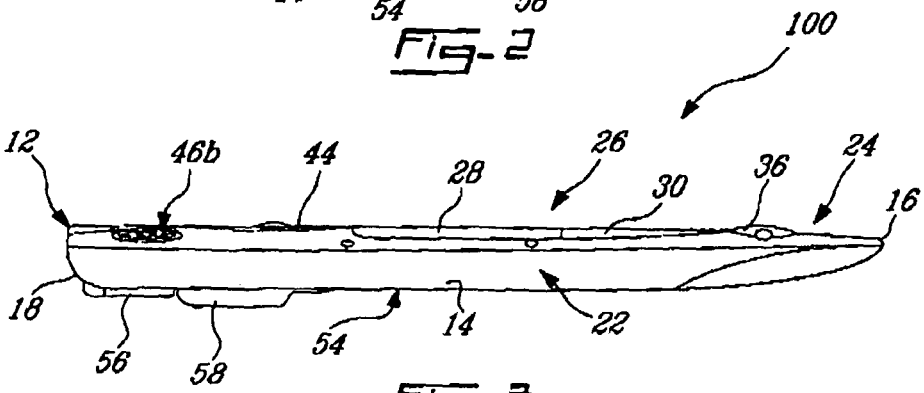
FIG. 3 is a side elevational view of the watercraft of FIG. 1.

Turning now to FIGS. 1, 2 and 3, the watercraft 100 includes a main body 12 having a hull 14, a bow (front side) 16, a stern (back side) 18, a port (left lateral side) 20, a starboard (right lateral side) 22 and a deck 24.

The deck 24 includes a main stowage assembly 26 having a pair of complementary removable hatch covers 28 and 30. Hatch cover 28 includes a latch lock 32 for locking the hatch 28 in place or unlocking it for removal. Hatch cover 30 includes a deck mast receiving element 34 for receiving a mast (as will be detailed herein). As will be detailed herein, hatch cover 28 defines a convertible centre deck, while hatch cover 30 defines a convertible bow deck. Furthermore, the convertible centre deck 28 defines a centre deck stowage, while the convertible bow deck 30 defines a deck bow stowage. The hatch covers 28 an 30 also include respective removable lock knobs 35*a*, 35*b* and 35*c*, 35*d*. Hatch cover 28 includes seat mounting elements, in the form of sockets 33, and apertures 37.

Near the bow 16, the deck 24 includes an outrigger hull receiving assembly 36, a retractable lift handle 38, a retractable bow cleat 40*a* and a bow-wheel shaft receiver 42, the function of all of which will be described herein.

It should be noted that the deck 24 includes a pair of port (left lateral side) retractable cleats 40*b* and 40*c*, a pair of starboard (right lateral side) retractable cleats 40*d* and 40*e*, as well as a stern cleat 40*f*.

Near the stern 18, the deck 24 includes: a rudder retracting element 43, a rudder steering deck element 44 in the form of a rotary disk including a steering shaft mounting element 45 in the form of an aperture; a rear hatch assembly 46 having a pair of hatch elements 46*a* and 46*b*, each having a respective cover 47*a* and 47*b* with a respective latch lock 48*a* and 48*b*; a stern retractable cleat 40*f*; and a retractable rudder mechanism 52 all of which will be described herein. The underside 54 of the hull 12, includes a retractable rudder blade 56 (mounted to a rudder shaft 57 through a rudder well 99, see FIG. 7 and analogous FIG. 35) and a retractable centre board 58 both shown here in their retracted positions (see FIG. 6 for the extended positions).

Figure 4:
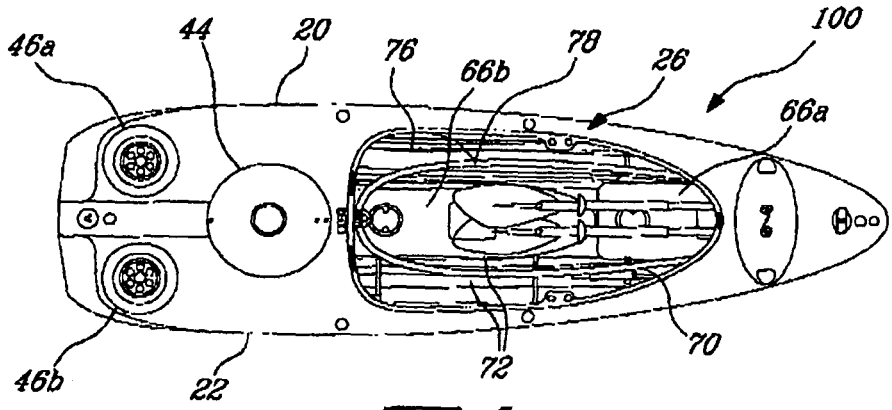
FIG. 4 is a top view of the watercraft of FIG. 1, with a portion being removed for revealing a portion of the inside.
Figure 5:
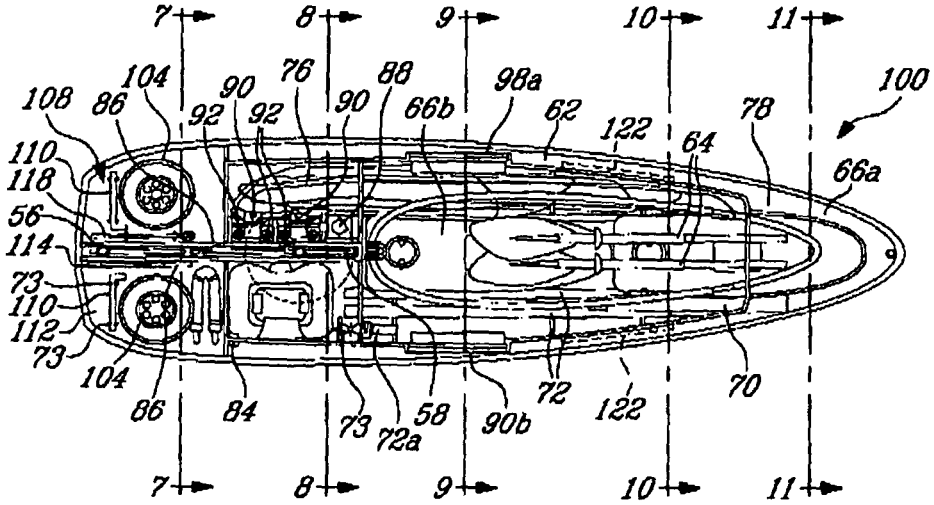
FIG. 5 is a cross-sectional top view of the watercraft of FIG. 1, for revealing the inside.
Figure 6:
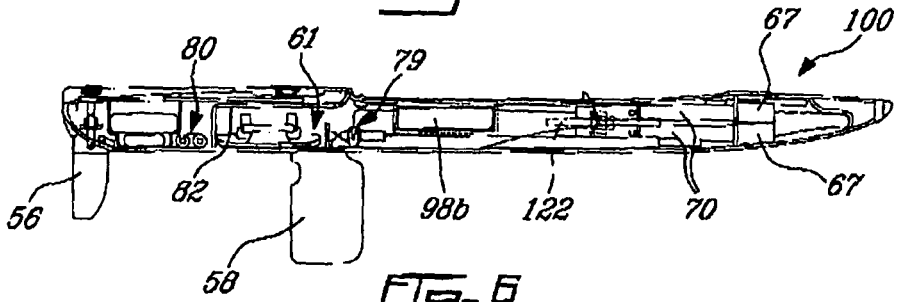
FIG. 6 is a cross-sectional side of the watercraft of FIG. 1.

FIG. 4 shows the watercraft 10 having its hatch covers 28 and 30 removed to reveal its main stowage compartment 60. In FIG. 5, the panels of the deck 24 have been removed for description purposes only. FIG. 6 is a cross sectional view along the length of main body 12, FIG. 7 to are various cross sectional views along the width of main body 12.

With reference to FIGS. 4 to 11, the internal contents and self-stowage system of the watercraft 10 will be described hereinbelow. It should also be noted as is revealed by the above-mentioned figures that the be watercraft 10 includes a double hull 62.

Figure 8:
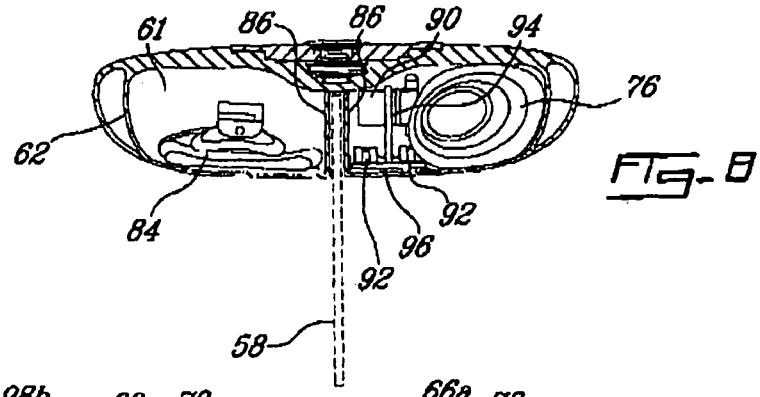
FIG. 8 is a sectional view of the watercraft of FIG. 5 along line 8-8.
Figure 9:
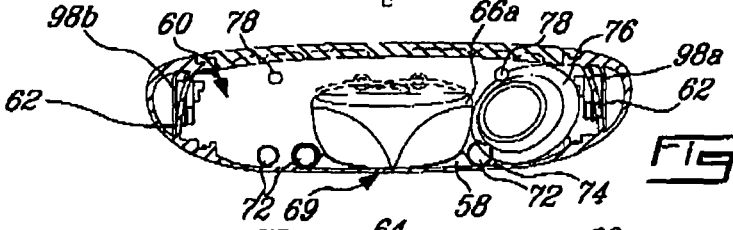
FIG. 9 is a sectional view of the watercraft of FIG. 5 along line 9-9.
Figure 10:
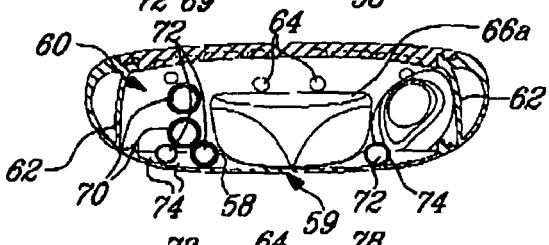
FIG. 10 is a sectional view of the watercraft of FIG. 5 along line 10-10.
Figure 11:
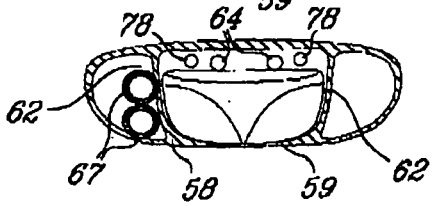
FIG. 11 is a sectional view of the watercraft of FIG. 5 along line 11-11.

Turning now to the self-stowage compartment 60 as shown in FIG. 4, it includes a two-piece paddle 64 placed on top of a pair of outrigger hulls 66*a* and 66*b*, which are adjacently positioned in front-to-back relation and placed within a respective molded recessed nest 68 formed in the internal floor 69 of the watercraft 10 (see FIGS. 9-11). A pair of outrigger hull beam sections 70 are fitted into internal support tube elements 67, three mast sections 72 are positioned in respective receding longitudinal nests 74 formed in the bottom floor 59 of the watercraft 100 (see FIGS. 9 and 10). A mast base 72*a* base is kept in place near the of the compartment 60 via snap members 73 (which can be in the form of rubber or other suitable material). A sail 76 is placed within compartment 60 as well as a wishbone 78. With particular reference to FIG. 6, it should be noted that the unexposed area 61 of compartment 60 is accessible via an opening 79, while the area 80 posterior to the compartment extension 61 is separated by watertight wall 82. Area 61 of compartment 60 contains a moveable seat 84 (also see FIG. 8). It should be noted that are 61 is split down the middle by watertight bulk heads 86, on each side of the retractable rudder blade 56 and a retractable centre board 58 (also see FIG. 8). On the side of area 61 proximal to the starboard 20, the compartment includes wishbone mast mounting brackets 88, outrigger beam brackets 90 and screws 92 (also see FIG. 8). With respect to FIG. 8, the brackets 90/94 are removably mountable in their compartment, screws 92 are threadedly mounted to floor receiving element 96. Finally, the stowage compartment 60 also includes a pair of outrigger seats 98*a* and 986 on each lateral side 20 and 22 of the watercraft 100.

Figure 7:
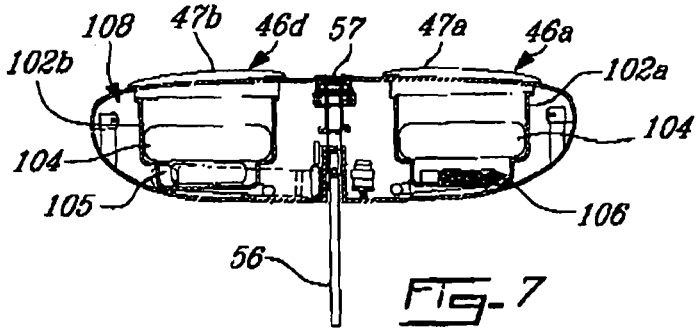
FIG. 7 is a sectional view of the watercraft of FIG. 5 along line 7-7.

Turning now to the rear stowage assembly 46, FIG. 4 shows the covers 47*a* and 47*b* of stowage compartments having been removed to reveal removable canisters 102*a* and 102*b* (see FIG. 7). Referring to FIG. 8, canister 102*a* includes a rear trailer wheel 104 and mast ropes (or blocks) 106, canister 102*b* includes a rear trailer wheel 104 and a front trailer wheel 105. Referring to FIG. 5, when removing the canister 102*a* and 102*b*, access is provided to stowage area 108 (also shown in FIG. 7) that is split down the middle via watertight bulkheads 86 on each side of the rudder 56. Stowage area 108 includes stern vertical shaft sections 110, a bow vertical shaft 114, a hiking strap 116 and a rudder steering shaft 118 held in place on surface 112 via snap members 73, also held in place via snap members 73.

In this way, all the components exposed above and mentioned below of the multifunctional-transformable watercraft 100 can be stowed within body 12, furthermore and as will be detailed herein, the various locking knobs, retractable cleats, hatch covers can be removed without any tools and when assembled on the deck 24 lie flush with the deck surface in order to avoid injury to the user when engaging the deck 24 surface. Moreover and as will be described herein, assembling the various components of the various embodiments of the watercraft of the invention requires not tools and all watercraft articles and sub-parts including without limitation brackets, screws, ropes, shafts, wheels, cables, blocks, sticks, sails, wishbone, paddles, spinnakers, hiking straps, axles, locis, and the like are stowed and secured within the body of the watercrafts of the invention.

With respect to FIGS. 12 to 29, the watercraft 100 will now be described in operation.

Figure 12:
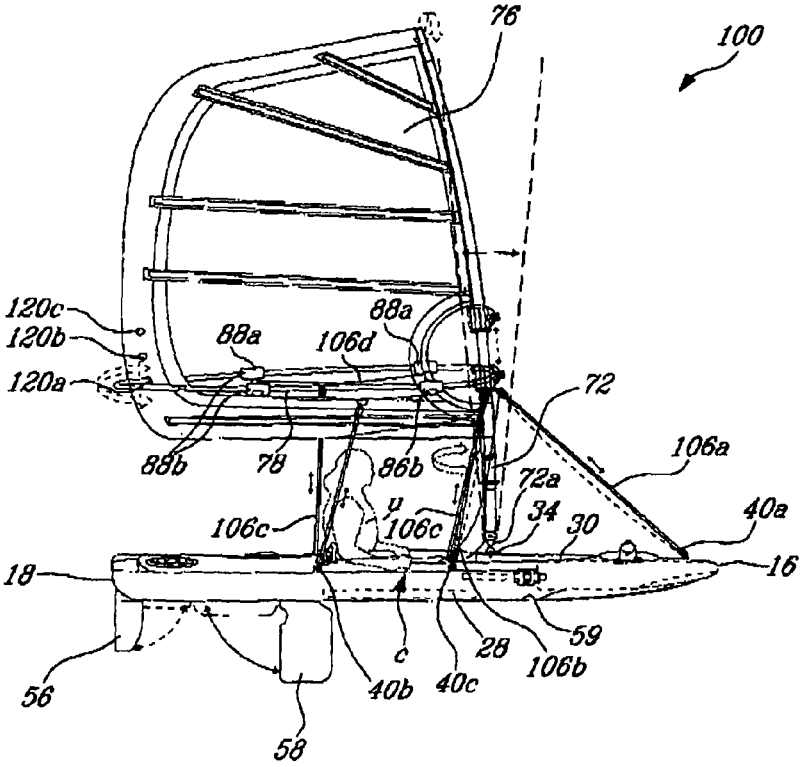
FIG. 12 is a side plan view of the watercraft of FIG. 1 in operation.

FIG. 12, shows the watercraft 100 in the form of a sailboat, with the mast 72 having all of its sections assembled including the mast base 72*a* which is securely positioned within the mast receiving element 34 of hatch cover 30, the wishbone 78 has been mounted to the mast 72 via mast mounting bracket 88 and hooped through the sail 76 via aperture 120*a*. Sail apertures 120*a*, 120*b* or 120*c* and adjustable bracket 88 provide for the user U to adjust the height H of the wishbone 78. Three bow ropes 106*a*, 106*b*, and 106*c* are mounted at a top respective end to the bracket 88 and their bottom respective end to retractable cleats 40*a*, 40*c* and 40*e* (see FIG. 1) respectively thereby stabilizing the mast 72. A pair of left side brackets 88*a* are spaced apart and secured to wishbone 78 on the left side thereof so as to attach a horizontal lateral rope 106*d* thereon, which in turn is connected to a vertical left lateral side rope 106*e* which is mounted at the opposite end thereof to the retractable cleat 40*d* (see FIG. 1). A pair of right side brackets 88*b* are spaced apart and secured to wishbone 78 on the right side thereof so as to attach a horizontal lateral rope 106*f* thereon, which in turn is connected to a vertical right lateral side rope 106*g* which is mounted at the opposite end thereof to the retractable cleat 40*b*.

The user U sits within the body 12. Accordingly, the hatch cover 28 was removed and positioned within compartment 60 (as will be described herein) providing a double floor and defining a cockpit C, and the seat 84 was placed in the cockpit C to allow the user U to sit thereon. The user can also utilize the feet rudder steering 122 (also shown in FIGS. 5 and 6) to steer rudder 56, or the rudder steering shaft 118 by mounting it to the rudder rotary steering disk 44 as will be explained later on.

The user can steer the position of the sail 76 via hand ropes 106*d* and 106*e*. The user U can steer (such as adjusting the angle of the mast 72) the mast 72 via ropes 106*a*, 106*b* and 196*c*. 10 as will be described herein.

Figure 13:
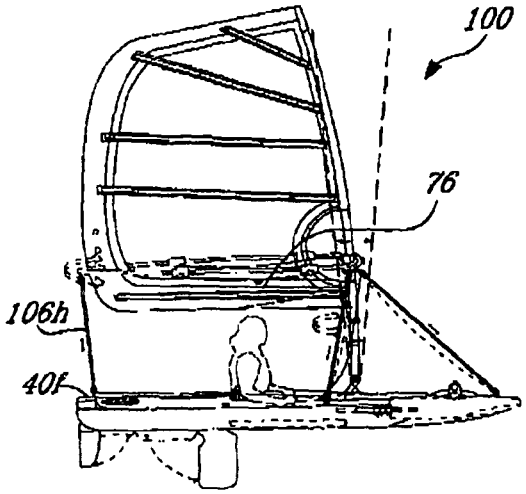
FIG. 13 is another side plan view of the watercraft of FIG. 1 in operation.

With reference to FIG. 13, the user U may add a stern rope 106*f* mounted to the rear end of the wishbone 76 and to the stern retractable cleat 40*f*.

Figure 14:
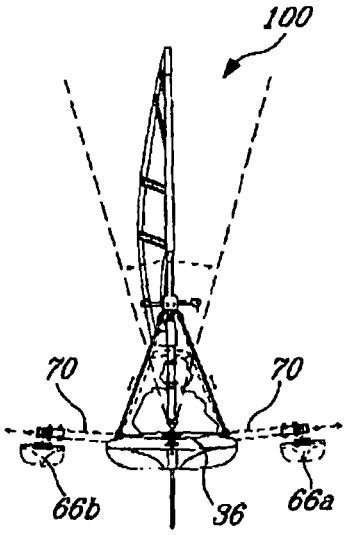
FIG. 14 is a rear plan view of the watercraft of FIG. 1 in operation.

With reference to FIG. 14, the user may mount the outrigger beam 70 whose sections have now been connected to the outrigger hull mounting assembly 36 which defined an aperture therethrough for receiving the beam 70 with the auxiliary outrigger hulls 66*a* and 66*b*. It should be noted and as will be further detailed herein that the beam 70 is adjustable along its length.

Figure 15:
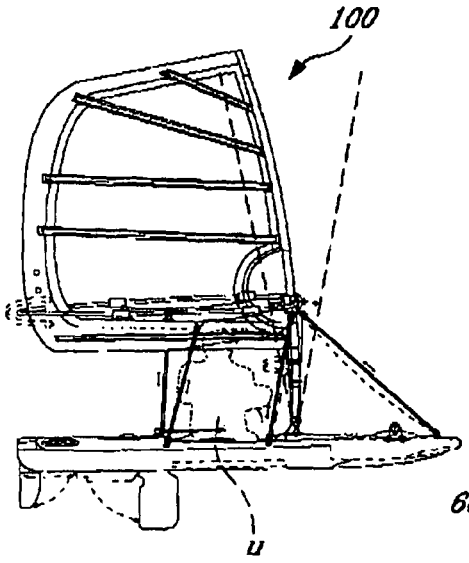
FIG. 15 is a further side plan view of the watercraft of FIG. 1 in operation.
Figure 16:
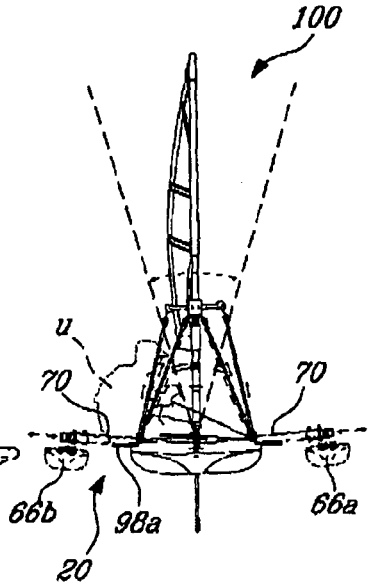
FIG. 16 is another rear plan view of the watercraft of FIG. 1 in operation.

With reference to FIGS. 15 and 16, the user U may retract an outrigger seat 98*a* or 98*b* (in this case it is 98*a* which has been retracted). It should be noted that given the fact that the part of the compartment 60 which contains the outrigger seats 98*a* and 98*b* is open in order to define the cockpit C, access to the seats as well as their retraction is provided (all of which will be detailed herein). With particular reference to FIG. 16, while the user U, is sitting at the starboard side 20, the outrigger hulls 66*a* and 66*b* can be mounted to the watercraft 100.

Figure 17:
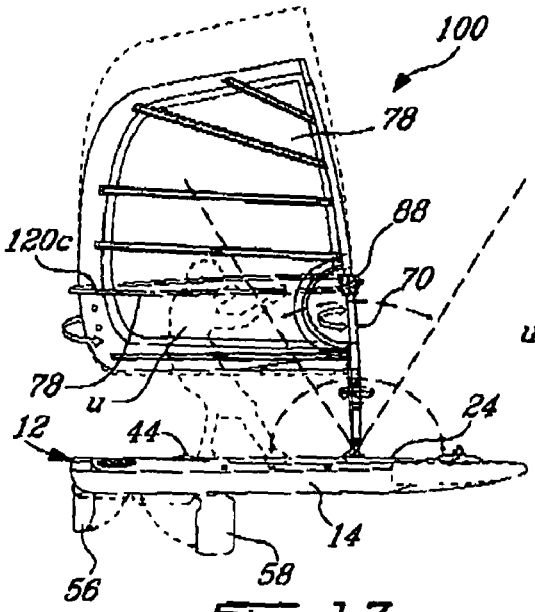
FIG. 17 is yet another side plan view of the watercraft of FIG. 1 in operation.
Figure 18:
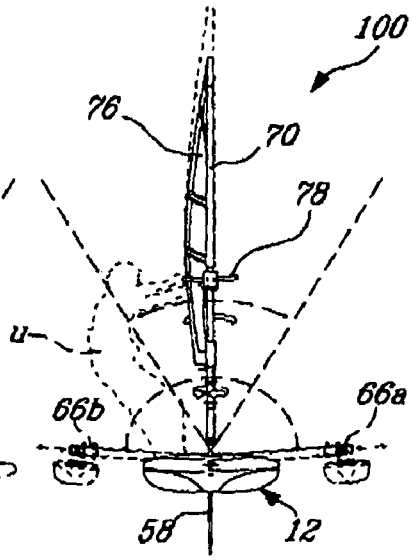
FIG. 18 is a further rear plan view of the watercraft of FIG. 1 in operation.

FIGS. 17 and 18, show that the watercraft 100 can be transformed into a sailboard. In this case the cover 28 is returned to the top of the deck 24, to provide for the user U to stand thereon. The wishbone's 78 height is increased by mounting it to aperture 120*c* of the sail 76 and raising the bracket 88 along the mast 72. The user U can steer the sailboard 100 by rotary foot action on the rotary rudder steering disk 44. FIG. 18, shows an alternative of the sailboard 100 including outrigger hulls 66*a* and 66*b*.

Figure 19:
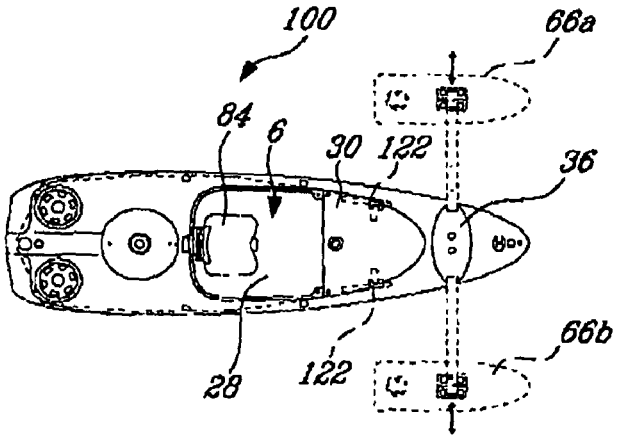
FIG. 19 is a top plan view of the watercraft of FIG. 1, being transformed into a sit-in paddle boat.
Figure 20:
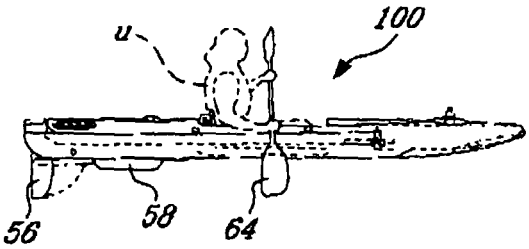
FIG. 20 is a side elevational view of the watercraft of FIG. 19.
Figure 21:
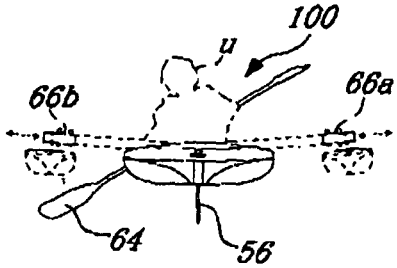
FIG. 21 is a rear view of the watercraft of FIG. 19.

FIGS. 19 to 21, show the watercraft 100 having been transformed into a sit-in paddle boat. Again, the user U removes the cover 28 and places within compartment 60 so as to define a cockpit C, the seat 84 is mounted to the cover 28, the paddle 64 is assembled for use and the centre board 58 is retracted. Again the sit-in paddle boat 100 can include outrigger hulls 66*a* and 66*b*, the user U may use foot steering elements 122 or the steering shaft 118 on the rotary disk 44 to steer rudder 56.

It should be noted that the cover 30 can be mounted at the deck level or at the floor level thereby allowing the mast base 72*a* to be at the floor level or deck level.

Figure 22:
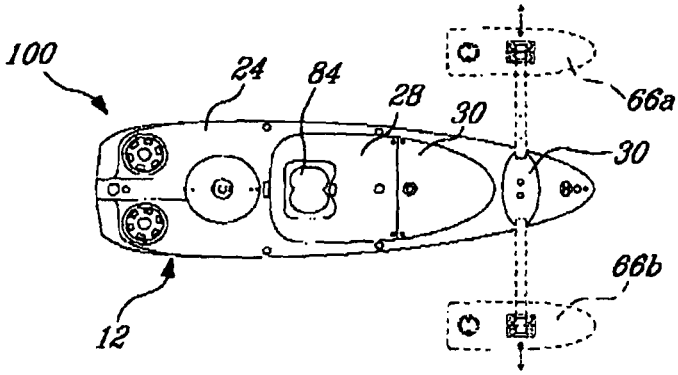
FIG. 22 is another top plan view of the watercraft of FIG. 1, being transformed into a sit-in paddle boat.
Figure 23:
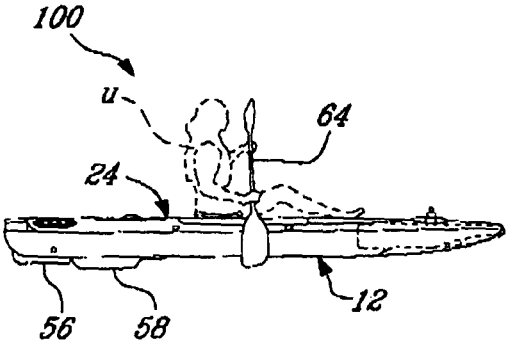
FIG. 23 is another side elevational view of the watercraft of FIG. 22.
Figure 24:
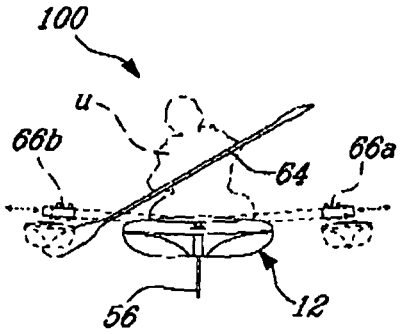
FIG. 24 is another rear view of the watercraft of FIG. 22.

FIGS. 22 to 23, show the watercraft 100 having been transformed into a sit-on paddle boat. The user U places the cover 28 to be flush with the deck 24, the seat 84 is mounted to the cover 28, the paddle 64 is assembled for use and both the rudder 56 and centre, board 58 can be retracted. Outrigger hulls 66*a* and 66*b* can be added on this configuration as well.

Figure 25:
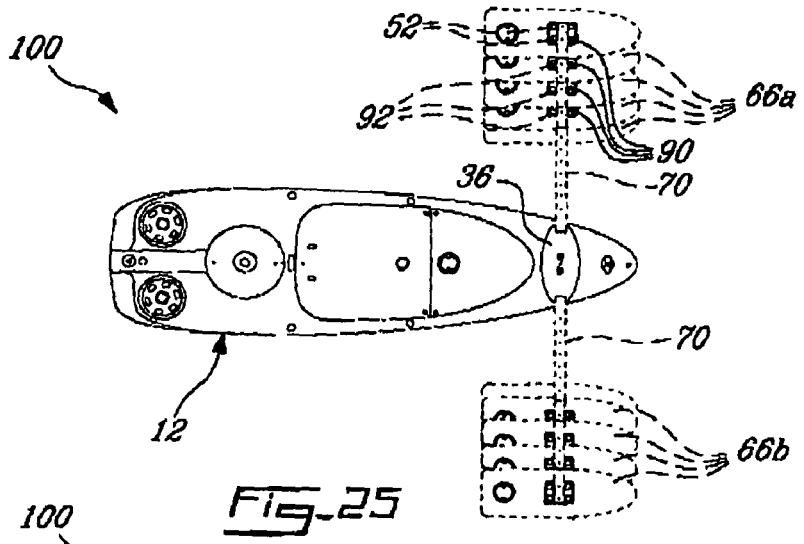
FIG. 25 is a further top plan view of the watercraft of FIG. 1, being transformed into a sit-in paddle boat.
Figure 26:
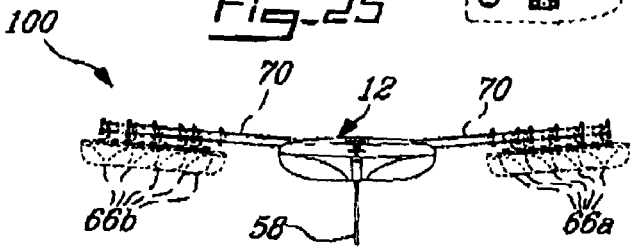
FIG. 26 is a further rear view of the watercraft of FIG. 25, according to a vertical axis.

FIGS. 25 and 26 show that the outrigger hulls 66*a* and 66*b* can be adjusted at different relative lengths with respect to the main body 12 due to the adjustable beam 70, and are mounted to this beam via brackets 90 and screws 92.

Figure 27:
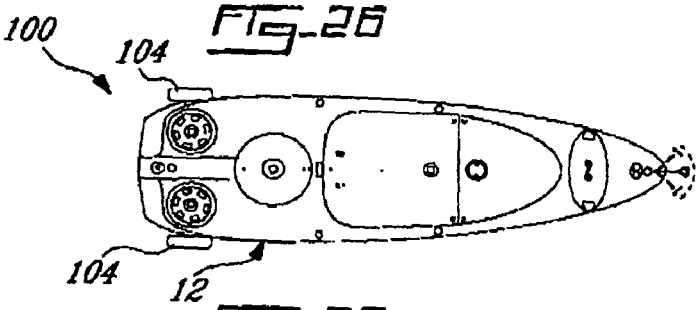
FIG. 27 is yet another top plan view of the watercraft of FIG. 1, being transformed into a sit-in paddle boat.
Figure 28:
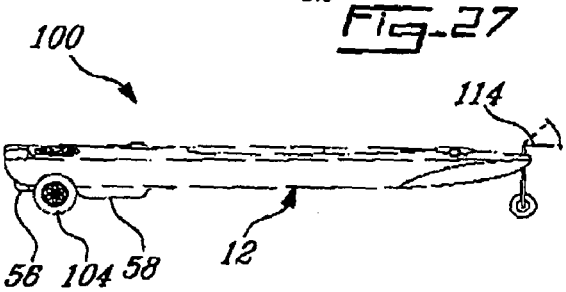
FIG. 28 is yet another side elevational view of the watercraft of FIG. 27.
Figure 29:
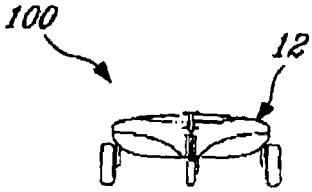
FIG. 29 is yet another rear view of the watercraft of FIG. 27, according to a horizontal axis.
Figure 30:
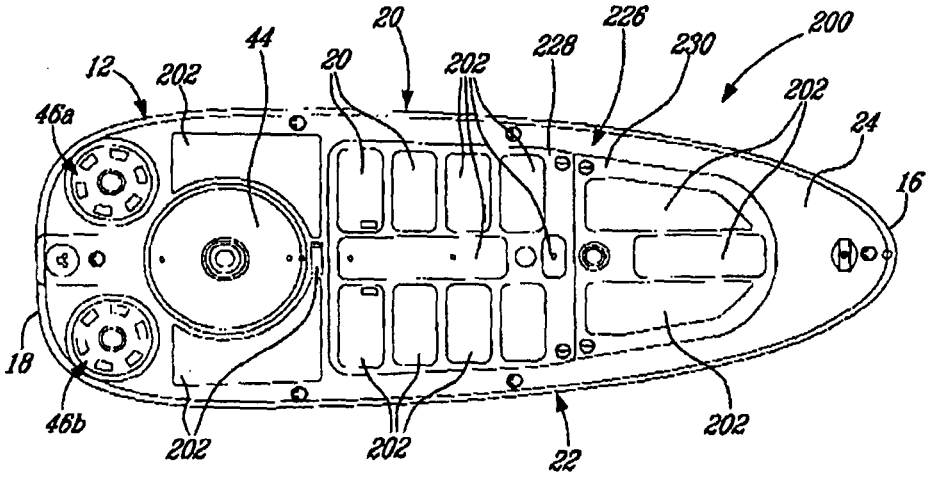
FIG. 30 is a top plan view of a watercraft according to another non-restrictive illustrative embodiment of the present invention.
Figure 31:
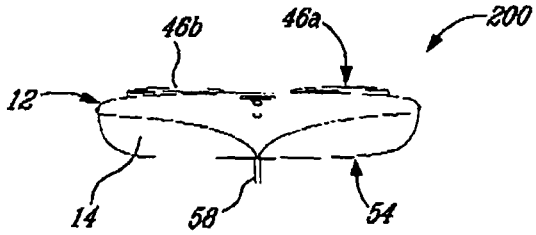
FIG. 31 a rear plan view of the watercraft of FIG. 30.
Figure 32:
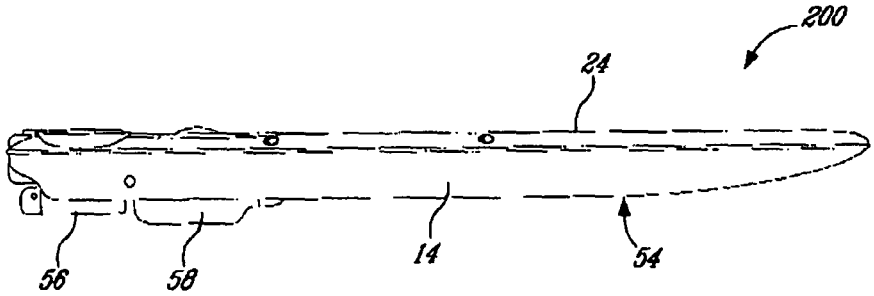
FIG. 32 is a side plan view of the watercraft of FIG. 30.

FIGS. 27 to 29, show the watercraft 100 when it is to be trained on the ground before or after use. The stern trailer wheels 104 are mounted at each lateral side of the stern 18, the rudder 56 and centerboard 58 are retracted, the user can train the on land watercraft 100, via the bow vertical shaft 114 which is moveable side to side (FIG. 27) as well as up and down (FIG. 28) and is used to pivot the bow trailer wheel.

Watercraft 200

FIGS. 30 to 40 show a watercraft 120 in accordance with another embodiment of the present invention. Watercraft 200 is a transformable, multi-functional and self-stowage watercraft. In one non-limiting example, watercraft 200 is about eight feet in length. It should be noted that watercraft 200 is similar to watercraft 100 and hence, will not be described in full detail for concision purposes only. In fact, the description below will highlight only the important differences between watercraft 200 and watercraft 100.

One major difference is that watercraft 200 does not include an outrigger hull and hence unlike watercraft 100 is not a multi-hull watercraft. Hence, the deck 224 of the watercraft does not include as outrigger hull mounting assembly. The foregoing provides in one embodiment for a watercraft having a shorter length as well as smaller stowage space given the fact that components related to the outrigger hull are not needed.

Figure 33:
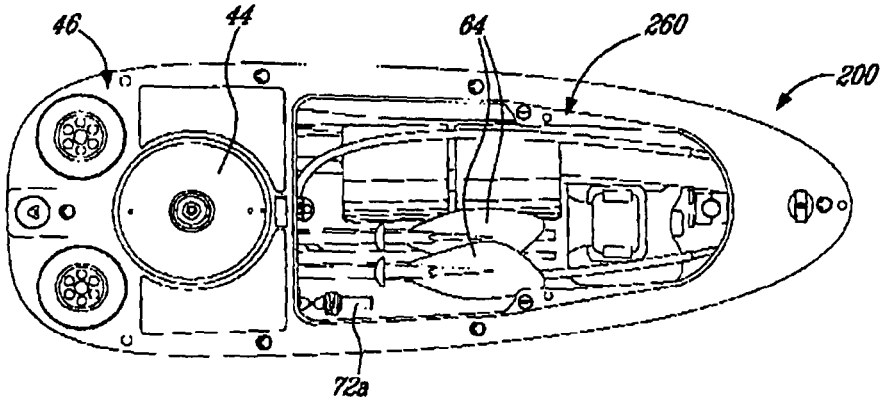
FIG. 33 is a top plan view of the watercraft of FIG. 30, with a portion being removed for revealing a portion of the inside.
Figure 34:
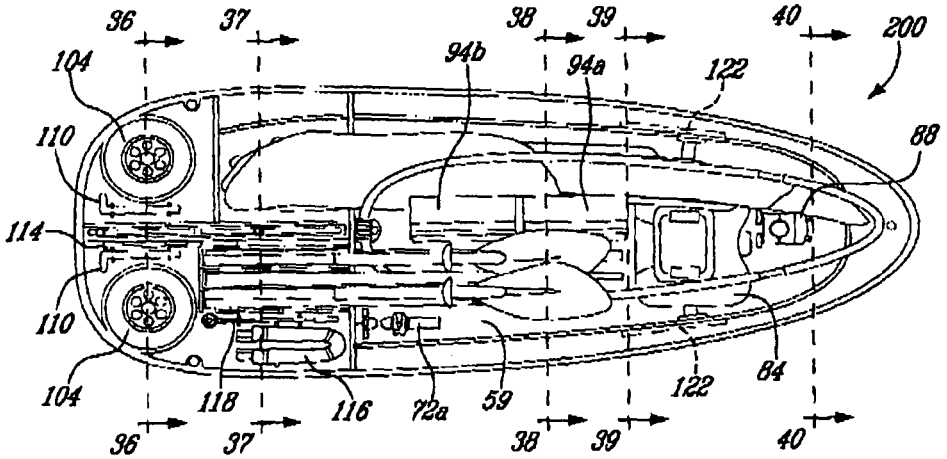
FIG. 34 is a cross-sectional top view of the watercraft of FIG. 30, for revealing the inside.
Figure 35:
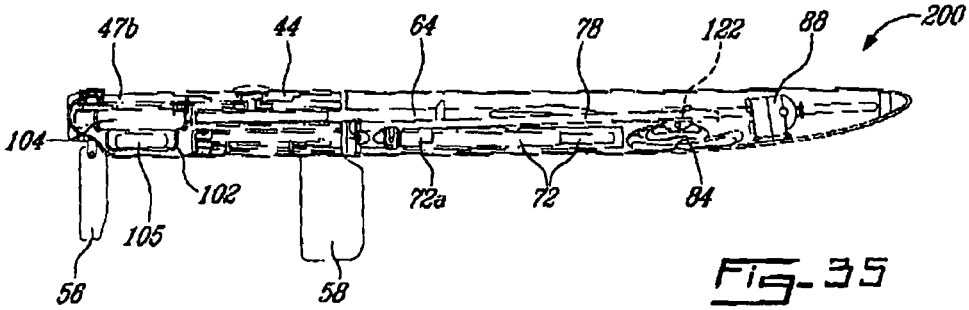
FIG. 35 is a cross-sectional side view of the watercraft of FIG. 30.
Figure 36:
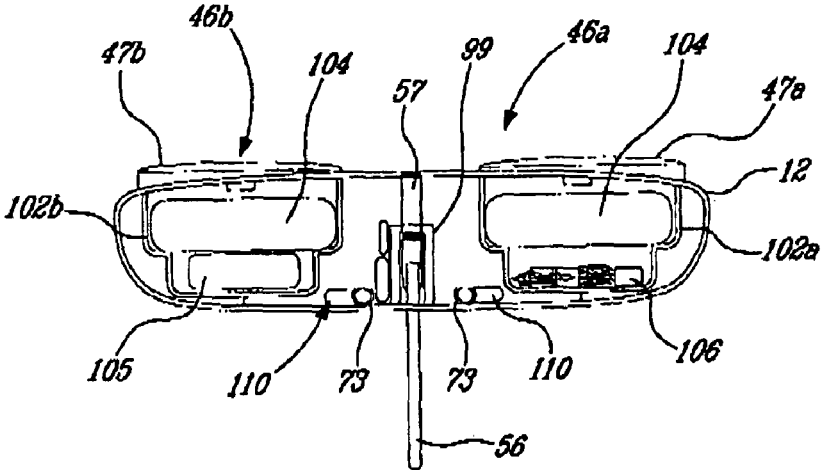
FIG. 36 is a sectional view of the watercraft of FIG. 34 along line 36-36.

With respect to FIG. 33, the main stowage assembly 226 includes a stowage covers 228 and 230 which are similarly constructed to stowage covers 20 and 30, thereby are removable to provide access to a main stowage 260 (see FIG. 33), cover 228 can also be placed within stowage 260 (similarly to cover 28 within stowage 60 described above for watercraft 100) so as to provide a double floor thereby allowing to transform the watercraft into a sit-in sailboat or a sit-in paddle-boat. Covers 228 and 230 include anti-skid mats 202. The deck 224 also includes anti-skid mats 202 about the rudder steering rotary disk 44.

With reference to FIGS. 33 to 40, the internal stowage of the watercraft 200 will be described by highlighting the differences between watercraft 200 and watercraft 100. It should be noted that the watercraft 200 includes a double hull 252 (see FIGS. 38 to 40).

Figure 37:
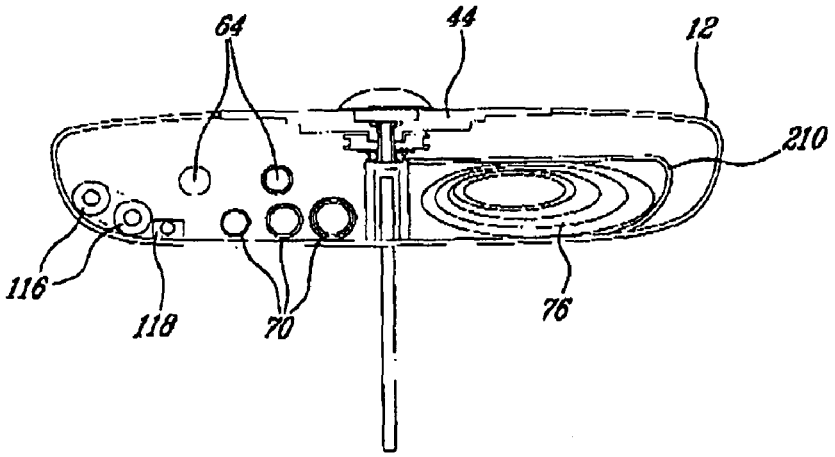
FIG. 37 is a sectional view of the watercraft of FIG. 34 along line 37-37.
Figure 38:
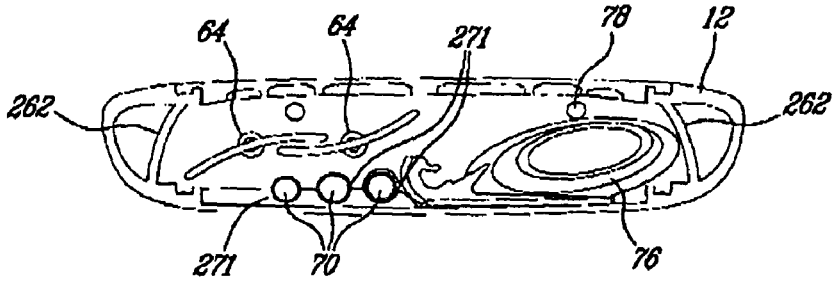
FIG. 38 is a sectional view of the watercraft of FIG. 34 along line 38-38.
Figure 39:
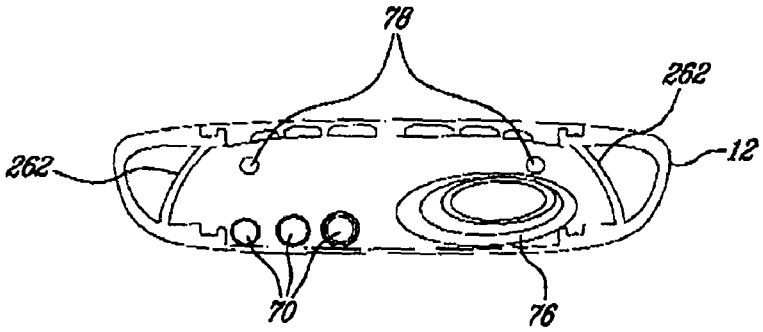
FIG. 39 is a sectional view of the watercraft of FIG. 34 along line 39-39.
Figure 40:
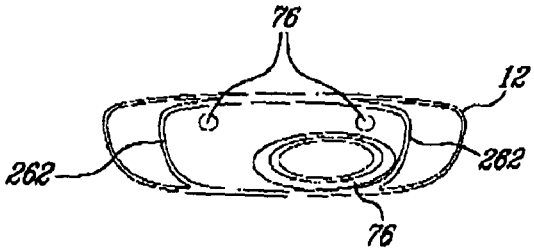
FIG. 40 is a sectional view of the watercraft of FIG. 34 along line 40-40.

Near the bow 16, the storage compartment 260 includes a wishbone mast mounting bracket 88, behind it a seat 84, and a pair of outrigger removable seats 94*a* and 94*b*, on the side near the starboard 20, the sail 76 is placed along the internal length of the watercraft 200 and the wishbone 78 is placed on top of the foregoing. As shown in FIG. 37, the sail 76 is fitted within a watertight bulkhead 210. The floor 59 includes elongated recessed nests 271 (see FIG. 38) for receiving the three mast sections 70.

The auxiliary components enumerated in FIGS. 33 to 40 (which were describe above for FIG. 10) are placed within the internal stowage of the main body 12 in a disposition similar to that of watercraft 100. Of course, the skilled artisan will easily understand that there are a variety of ways of storing the auxiliary components within the self-stowage watercrafts disclosed herein in accordance with the present invention.

Watercraft 300

FIGS. 41 to 81*b* show a watercraft 300 in accordance with another embodiment of the present invention. Watercraft 300 is a transformable, multi-functional and self-stowage watercraft. In one non-limiting example, watercraft 300 is about twelve feet in length. It should be noted that watercraft 300 is similar to both watercrafts 100 and 200 and hence, will not be described in full detail for concision purposes only, the following description will bring greater attention to differences between watercraft 300 and watercrafts 100, and 200

Figure 41:
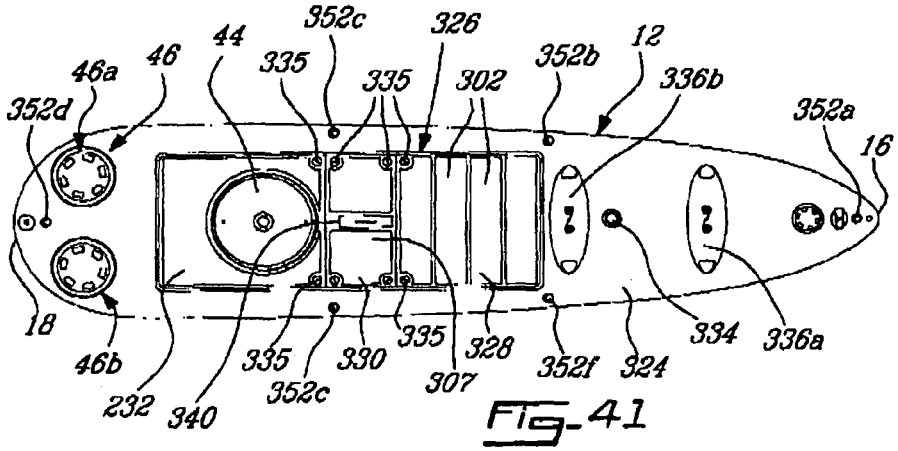
FIG. 41 is a top plan view of a watercraft according to a further non-restrictive illustrative embodiment of the present invention.
Figure 42:
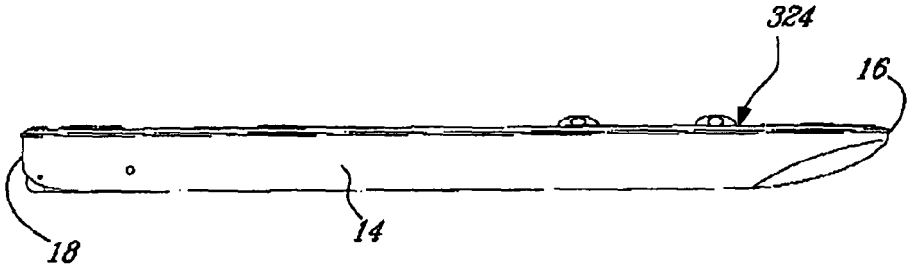
FIG. 42 is a side plan view of the watercraft of FIG. 41.
Figure 43:
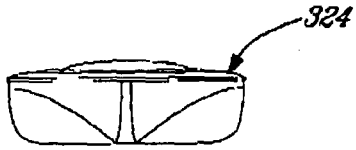
FIG. 43 is a rear plan view of the watercraft of FIG. 41.
Figure 44:
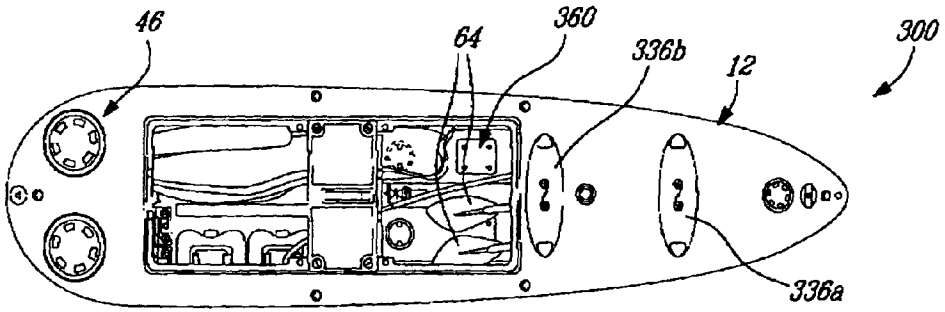
FIG. 44 is a top plan view of the watercraft of FIG. 41, with a portion being removed for exposing a portion of the inside.
Figure 45:
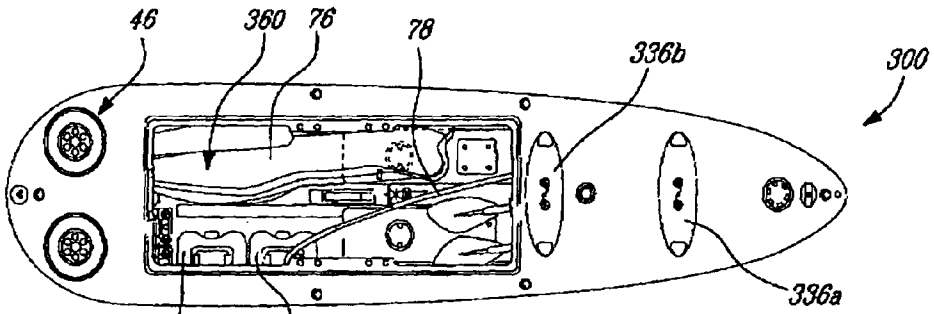
FIG. 45 is another top plan view of the watercraft of FIG. 41, with a portion being removed for exposing a portion of the inside.
Figure 46:
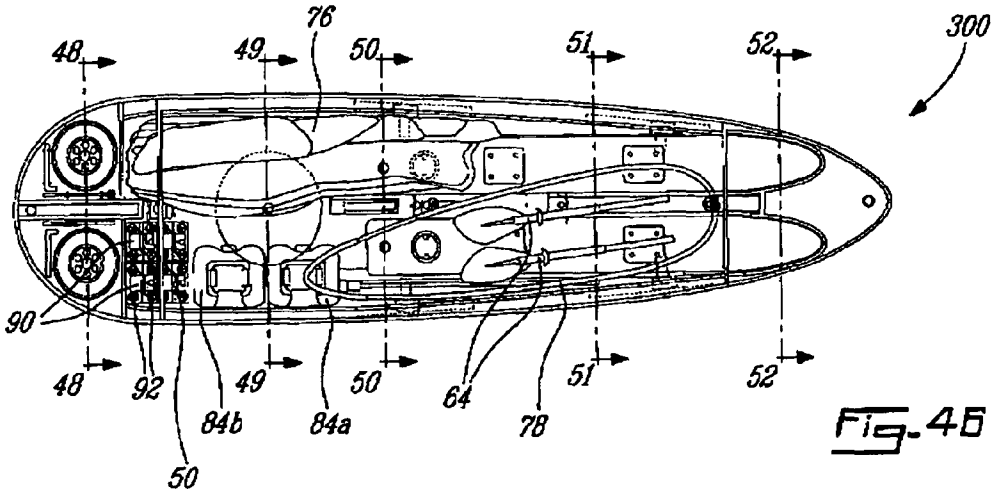
FIG. 46 is a cross-sectional top view of the watercraft of FIG. 41.
Figure 47:
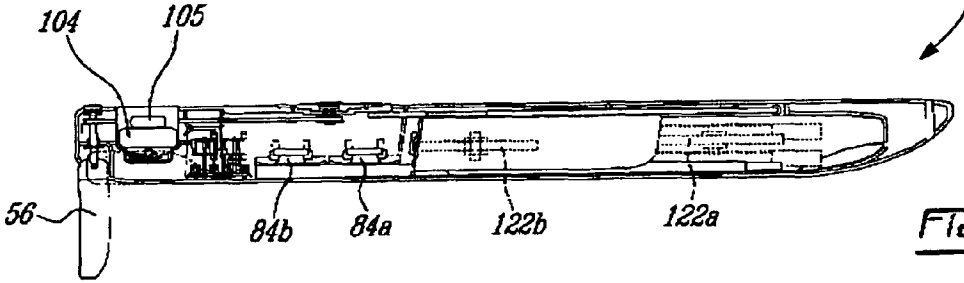
FIG. 47 is a cross-sectional side view of the watercraft of FIG. 41.
Figure 48:
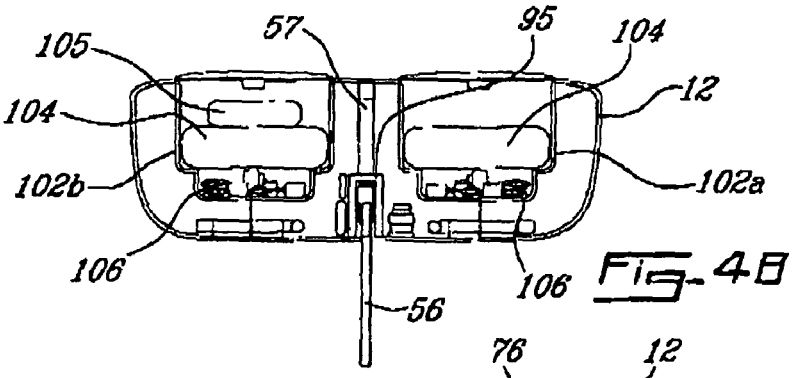
FIG. 48 is a sectional view of the watercraft of FIG. 46 along line 48-48.
Figure 49:
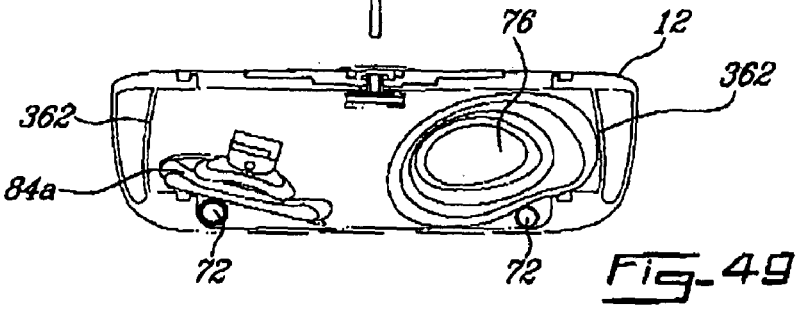
FIG. 49 is a sectional view of the watercraft of FIG. 46 along line 49-49.
Figure 50:
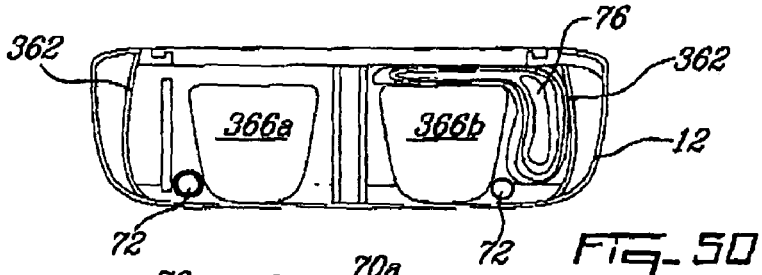
FIG. 50 is a sectional view of the watercraft of FIG. 46 along line 50-50.
Figure 51:
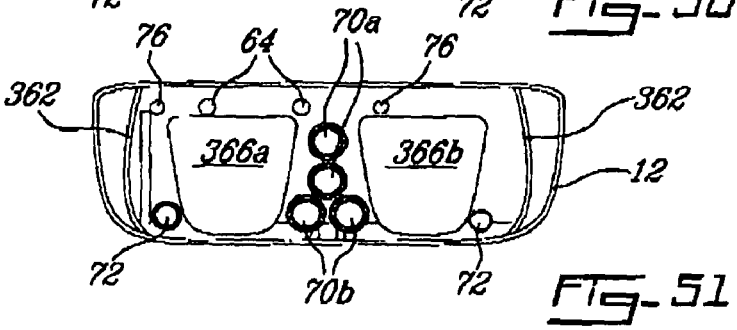
FIG. 51 is a sectional view of the watercraft of FIG. 46 along line 51-51.
Figure 52:
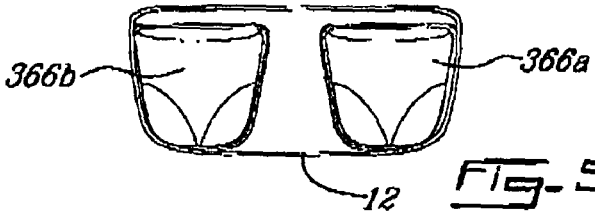
FIG. 52 is a sectional view of the watercraft of FIG. 46 along line 52-52.

Turning now to FIGS. 41, 42 and 43, the watercraft 300 includes a main body 12 having a hull 14, a bow 16, a stern 18, a port 20, a starboard 22 and a deck 324.

The deck 324 includes a main stowage assembly 326 having a three removable hatch covers 328, 330 and 332 all of which are mounted to the deck 324 via lock knobs 335. The hatch covers 328, 330 and 332 include anti-skid elements or mats 307. The middle hatch 330 is placed about a well 340 which provides a space for a retractable dagger-board 342 (see FIG. 53). The removal of hatch 328 provides for a first cockpit C1 (see FIG. 53), the removal of hatch cover 332 and rotary disk 44 provides for a second cockpit C2 (see FIG. 53).

The deck 324 includes a mast receiving element 334 for receiving a mast as well as two outrigger receiving mounting assemblies 336*a* and 336*b*. The deck also includes a plurality of retractable cleats 352*a*, 352*b*, 352*c*, 352*d*, 352*e*, and 352*f*.

Near the bow 16, the deck 24 includes an outrigger hull receiving assembly 36, a retractable lift handle 38, a retractable bow cleat 40*a* and a bow-wheel shaft receiver 42, the function of all of which will be described herein.

FIGS. 44 to 52 expose the internal contents of both the main stowage compartment 360 and the stern stowage assembly 46. The contents of stowage compartment 360 and the stern stowage assembly 46 are similar as denoted by the reference numerals, yet certain differences will be highlighted below.

There are two cockpit seats 84*a* and 84*b* for each cockpit C1 and C2. There are two pairs of outrigger hull beams 70*a* and 7*b* for the double outrigger hulls 366*a* and 366*b*, which are stowed within the compartment 350 in a side by side fashion.

There are two pair of foot steering rudder controls 122*a* and 112*b* for each cockpit C1 and C2.

Also of note, is that watercraft 300 includes a double hull 36.

Figure 56:
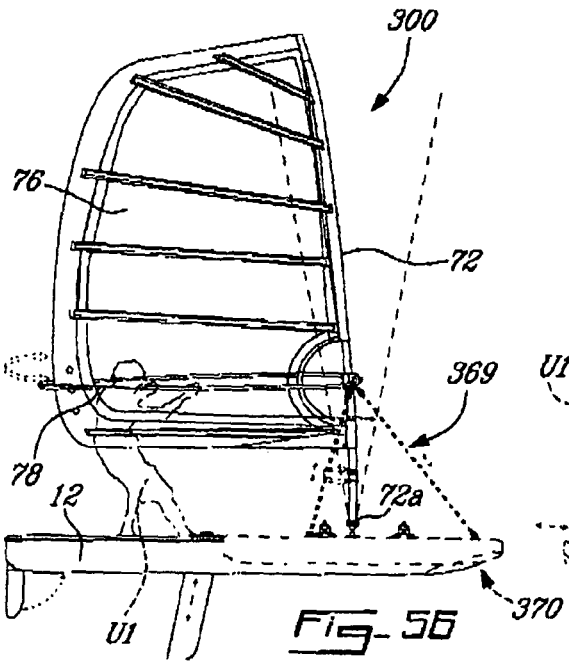
FIG. 56 is another side view of the watercraft of FIG. 54, in operation.
Figure 57:
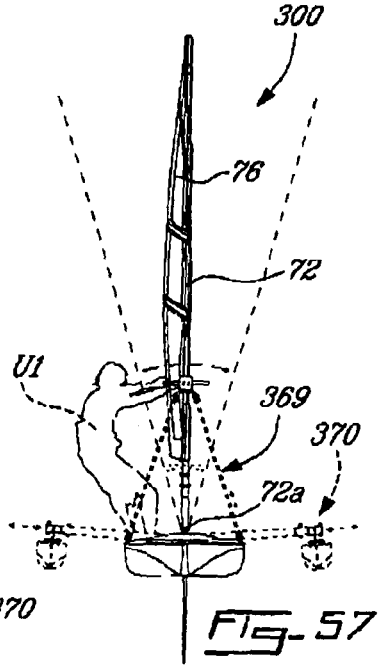
FIG. 57 is another rear view of the watercraft of FIG. 54, in operation.
Figure 58:
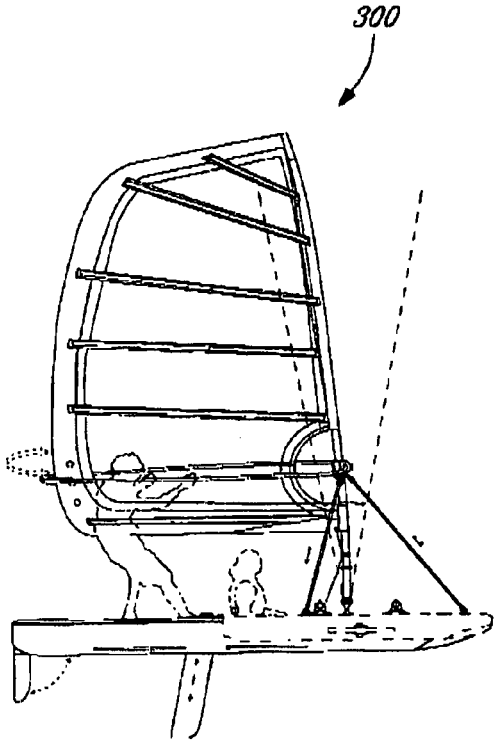
FIG. 58 is a side view of the watercraft of FIG. 41, being transformed into a hybrid sailboat/sailboard.
Figure 59:
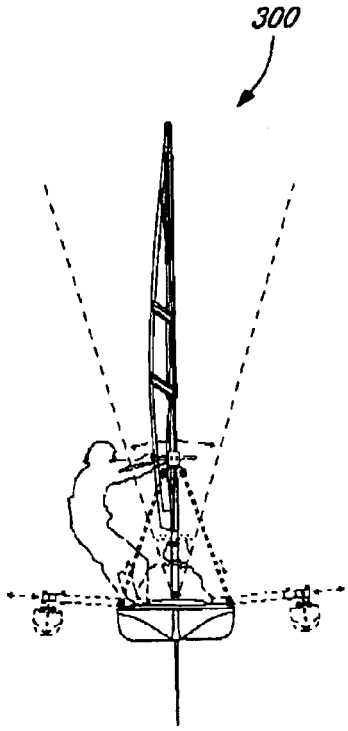
FIG. 59 is a rear view of the watercraft of FIG. 58, in operation.
Figure 60:
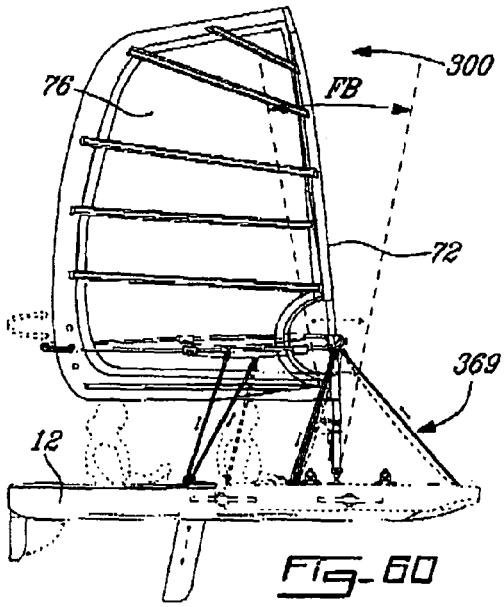
Figure 61:
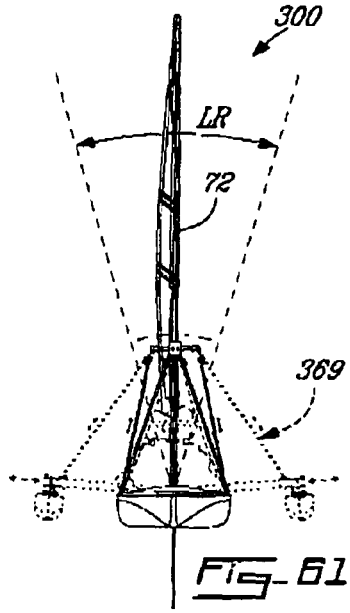
FIG. 61 is another rear view of the watercraft of FIG. 54, in operation.

Turning now to FIGS. 53 to 82, the operation of the watercraft 300 will be described herein. FIGS. 53, 60-71 show the watercraft 300 having been transformed into a sailboat. FIGS. 54 to 57 show the watercraft 300 having been transformed into a sailboard. FIGS. 58 to 59 show the watercraft 300 having been transformed into a hybrid sailboat/sailboard. FIGS. 70 to 81*a* show the show the watercraft 300 having been transformed into a paddle boat.

Figure 53:
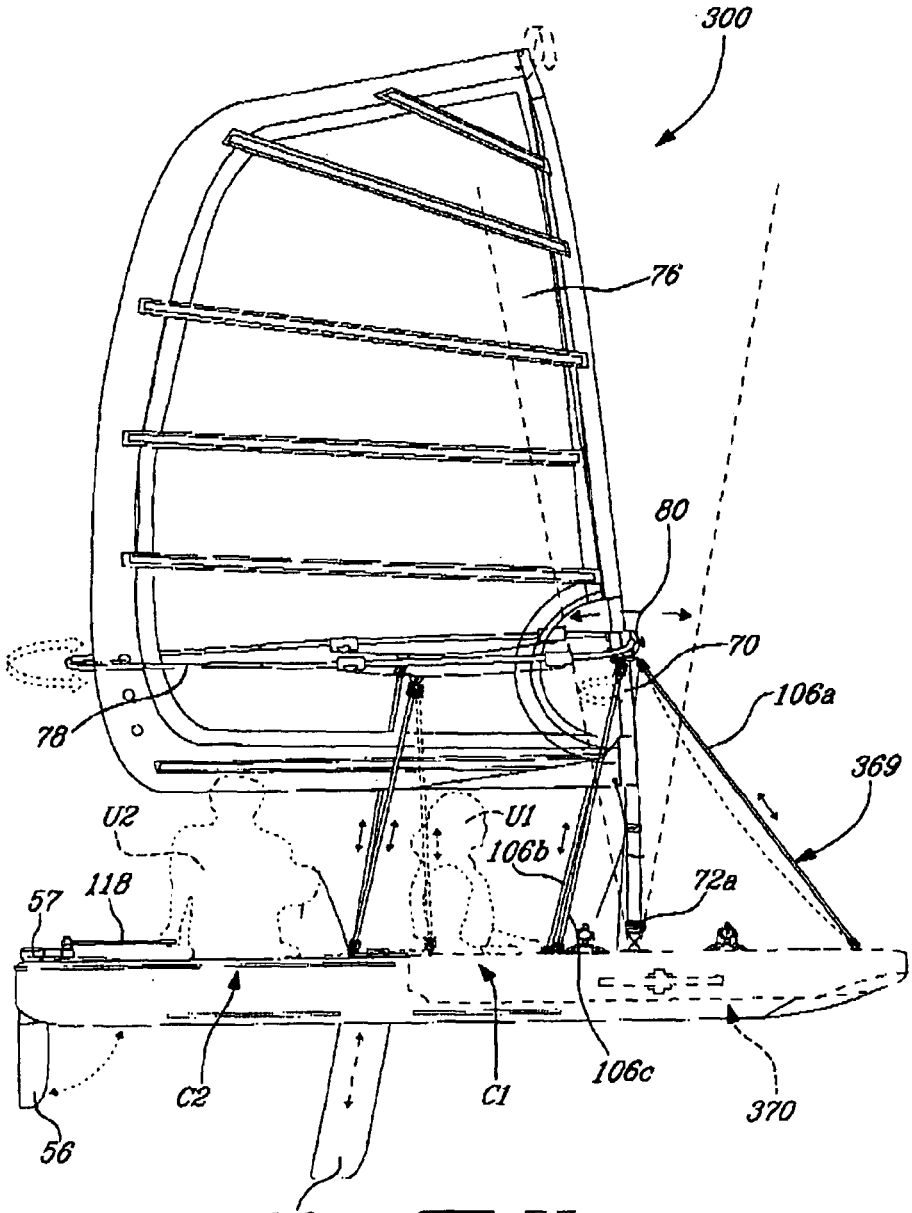
FIG. 53 is a side view of the watercraft of FIG. 41, being transformed into a sailboat.

FIG. 53 shows two users U1 and U2 in cockpits C1 and C2 respectively. A mast control assembly 370 is mounted to the mast 72 about bracket 88. Assembly 369 includes a forestay rope 106*a*, a starboard shroud rope 106*b* and a port shroud rope 106*c*. The user U1 in cockpit can pull or release the adjustable ropes 106*a*, 106*b* or 106*c* to move the mast 72 in a front to back direction FB shown in FIG. 60 for example or in a side to side direction LR shown in FIG. 61 for example. It should also be noted that the mast base 72*a* is a flexible and provides the mast 72 universal movement relative thereto. Lateral sheet ropes 106*d* and 106*e* can be mounted to the wishbone 78 and one end thereof and at the opposite end to the deck 324 or to the outrigger hull assemblies 370 (defined by beams 70*a*, 70*b* as well as hulls 364*a* and 364*b* when assembled).

In FIGS. 53, 68, 69, 70 and 71 the user U2 is in cockpit C2 on an outrigger seat 98*a* or 98*b* and can steer the rudder via steering stick 116 and can ac on the lateral sheet ropes 106*d* and 106*e*.

Figure 62:
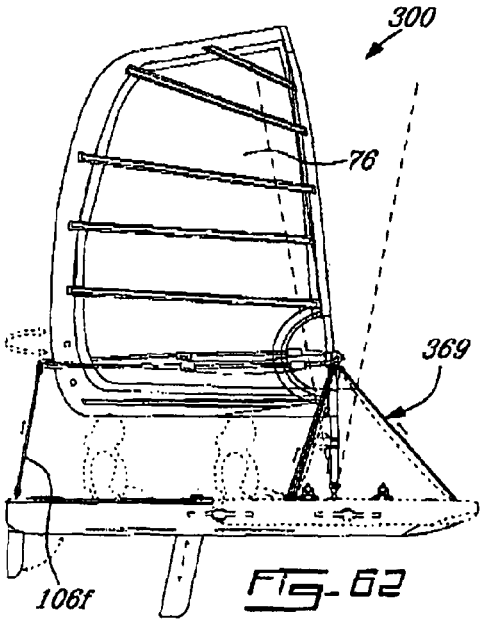
FIG. 62 is a further side view of the watercraft of FIG. 54, in operation.
Figure 63:
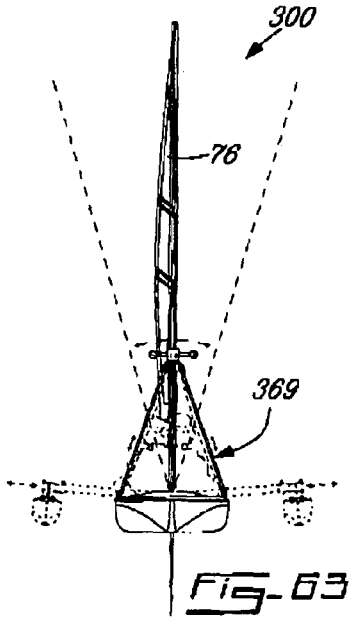
FIG. 63 is a further rear view of the watercraft of FIG. 54, in operation.
Figure 64:
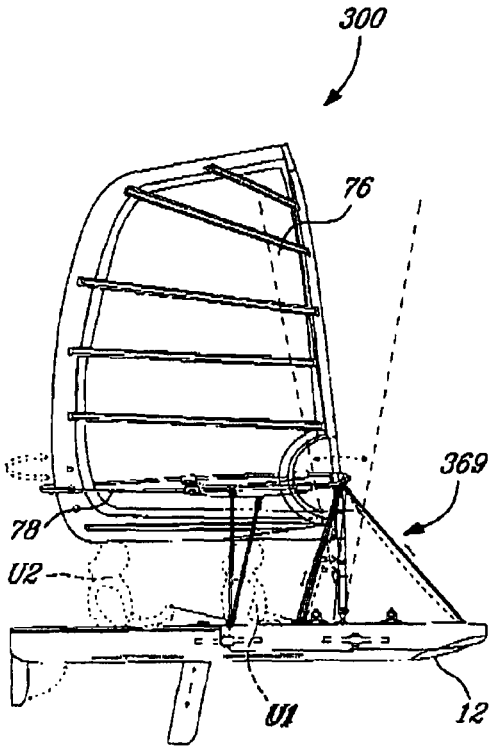
FIG. 64 is yet another side view of the watercraft of FIG. 54, in operation.
Figure 65:
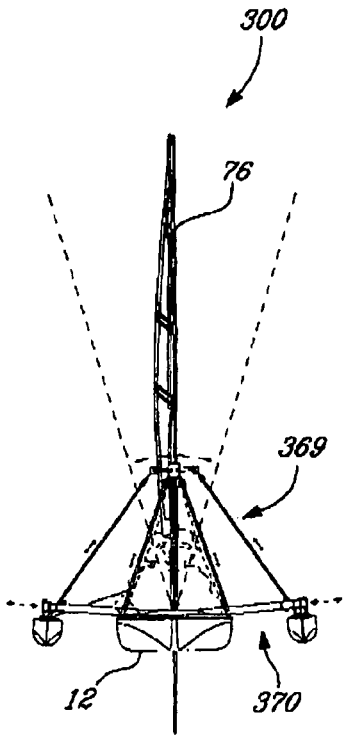
FIG. 65 is yet another rear view of the watercraft of FIG. 54, in operation.
Figure 66:
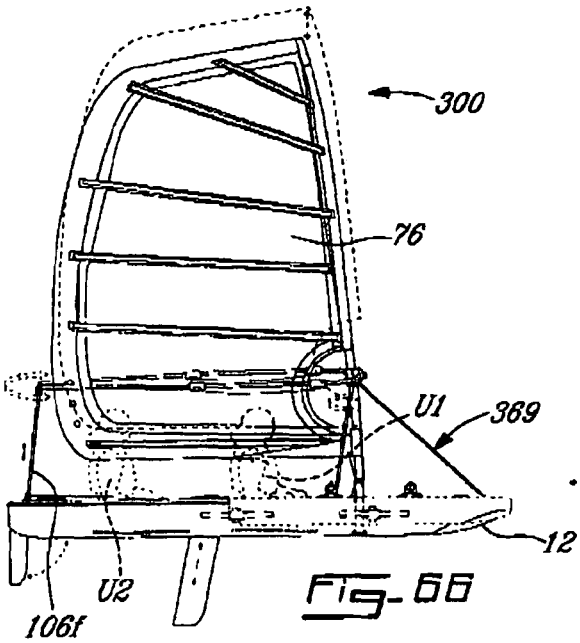
FIG. 66 is an additional side view of the watercraft of FIG. 54, in operation.
Figure 67:
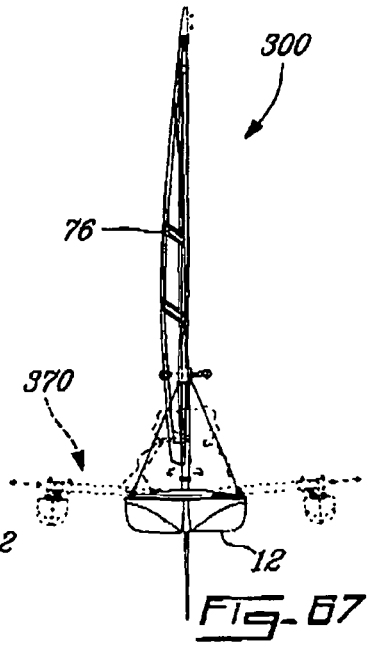
FIG. 67 is an additional rear view of the watercraft of FIG. 54, in operation.
Figure 68:
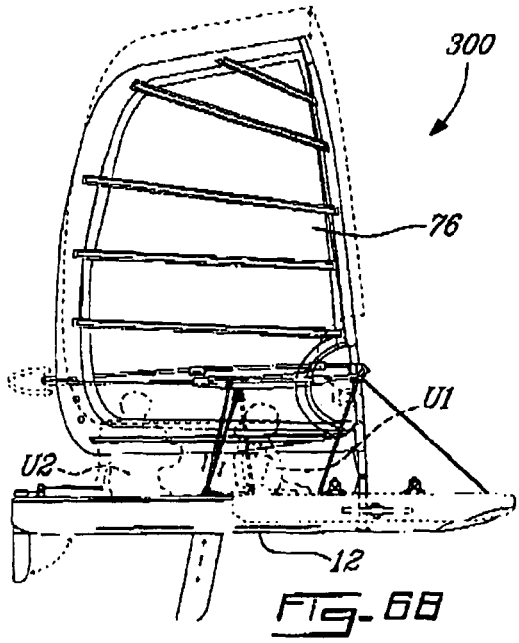
FIG. 68 is a further side view of the watercraft of FIG. 54, in operation.
Figure 69:
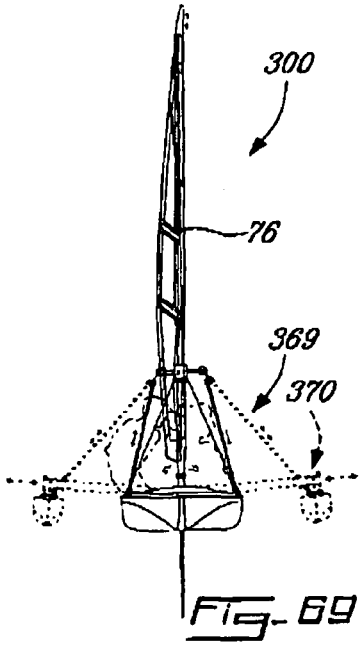
FIG. 69 is a further rear view of the watercraft of FIG. 54, in operation.
Figure 70:
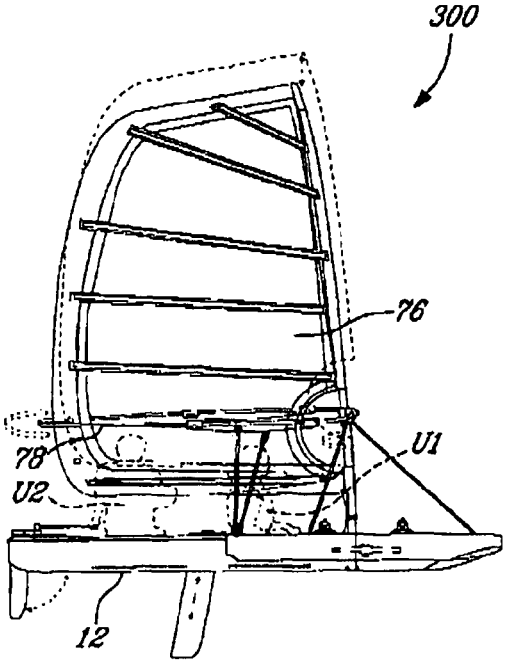
FIG. 70 is yet another side view of the watercraft of FIG. 54, in operation.
Figure 71:
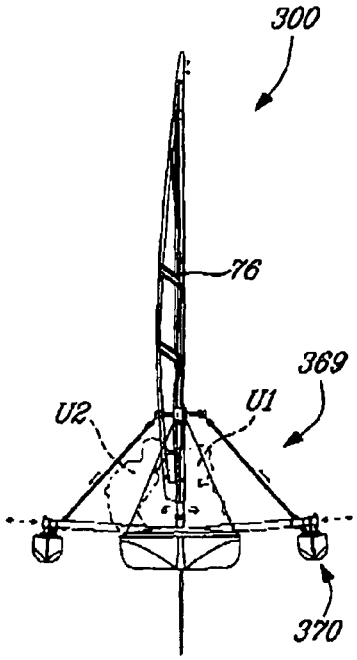
FIG. 71 is yet another rear view of the watercraft of FIG. 54, in operation.

FIGS. 60, 61, 62, 63, 64, 65, 66, and 67 show that both users U1 and U2 within the cockpits C1 and C2 respectively. In FIGS. 62 and 66, a stern sheet rope 106*f* has been added and the lateral sheet ropes 106*d* 106*e* have been removed.

FIGS. 58 and 59, show the watercraft 300 being transformed into a hybrid sailboard/sailboat by placing the hatch cover 332 at the deck level along with the rotary foot rudder control click 44. Hence, user U2 stands and controls the sail 76 via the wishbone 78 while the user U1 sits in cockpit C1. The outrigger hull assemblies can be optionally added.

Figure 54:
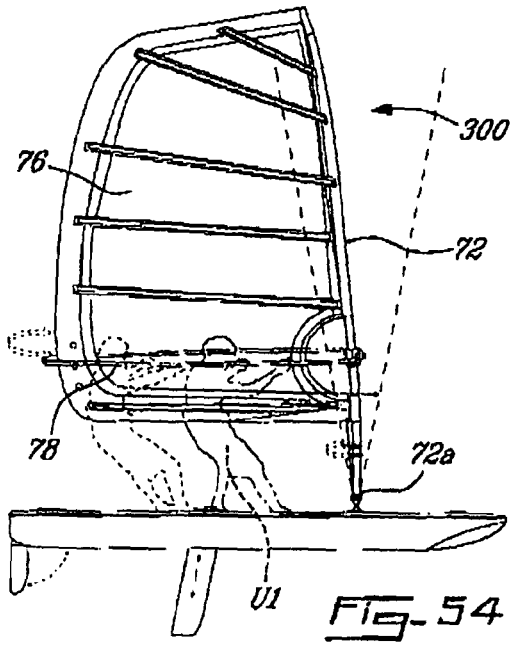
FIG. 54 is a side view of the watercraft of FIG. 41, being transformed into a sailboard.
Figure 55:
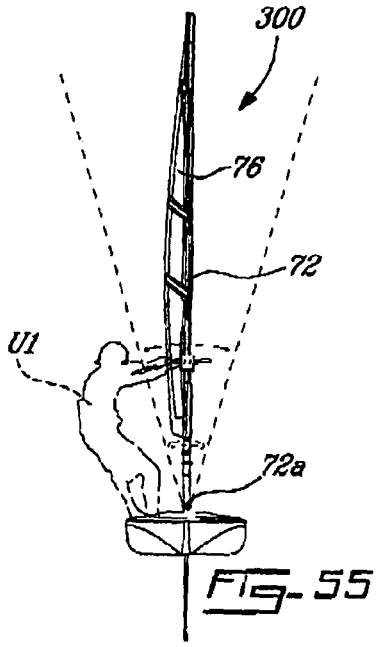
FIG. 55 is a rear view of the watercraft of FIG. 55, in operation.

In FIGS. 54 and 55 the watercraft 300 has been transformed into a sailboard by placing all the hatch covers 326, 330 and 332 at the deck level as shown in FIG. 1. In FIGS. 56 and 57, the mat control mechanism 369 and the outrigger hull assembly are optionally added.

Figure 72:
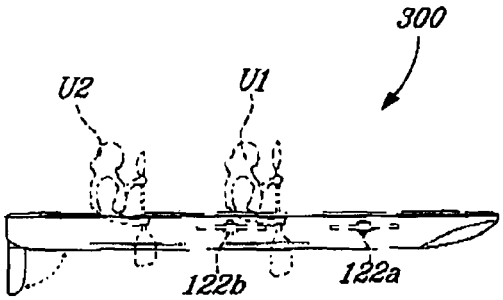
FIG. 72 is a side plan view of the watercraft of FIG. 41, being transformed into a paddle boat.
Figure 73:
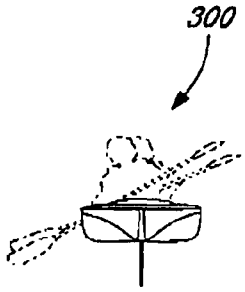
FIG. 73 is a rear view of the watercraft of FIG. 41, being transformed into a paddle boat.
Figure 74:
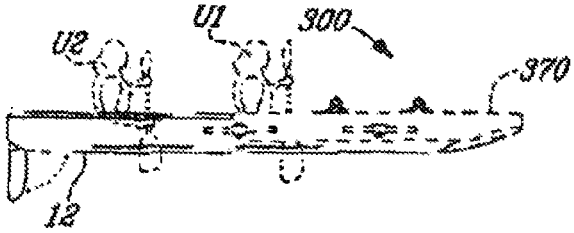
FIG. 74 is another side plan view of the watercraft of FIG. 72, in operation.
Figure 75:
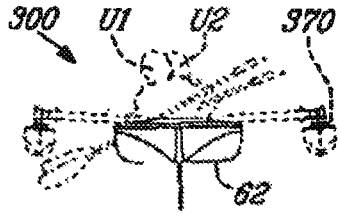
FIG. 75 is another rear view of the watercraft of FIG. 73, in operation.
Figure 76:
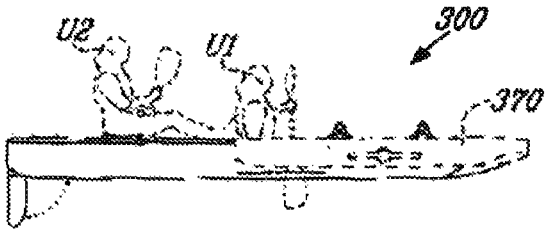
FIG. 76 is a further side plan view of the watercraft of FIG. 72, in operation.
Figure 77:
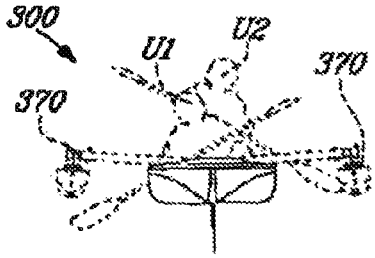
FIG. 77 is a further rear view of the watercraft of FIG. 73, in operation.
Figure 78:
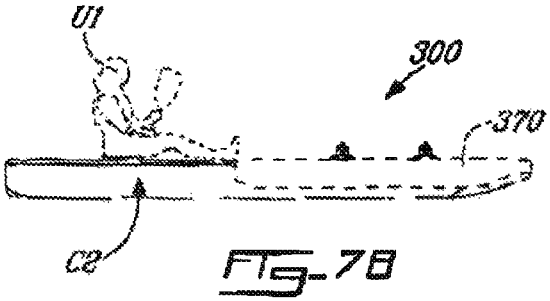
FIG. 78 is yet another side plan view of the watercraft of FIG. 72, in operation.
Figure 79:
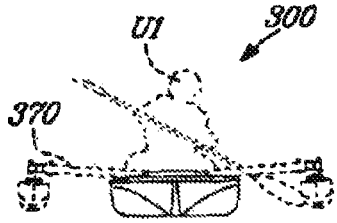
FIG. 79 is yet another rear view of the watercraft of FIG. 73, in operation.
Figure 80:
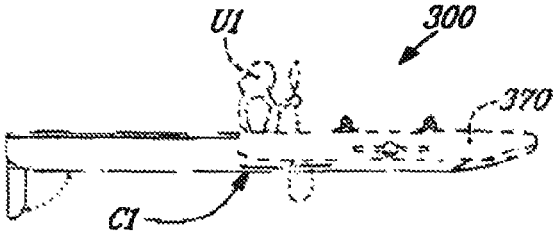
FIG. 80 is an additional side plan view of the watercraft of FIG. 72, in operation.

FIGS. 72 to 81 show the show the watercraft 300 having been transformed into a paddle boat. By independently placing the hatch covers 328 and 332 at the floor or deck level and by optionally adding the outrigger hull assembly, the following non-limiting options can be provided;

two-person sit in paddle boat (FIGS. 72 and 73);

two-person sit in paddle boat with outrigger hull assembly (FIGS. 74 and 75);

two-person one sit-in the other sit-on paddle boat with or without outrigger hull assembly (FIGS. 76 and 77);

one person sit-on paddle boat (back cockpit C2) with or without outrigger hull assembly (FIGS. 78 and 79); and one person sit-in paddle boat (front cockpit C1) with or without outrigger hull assembly (FIGS. 78 and 79).

Figure 81A:
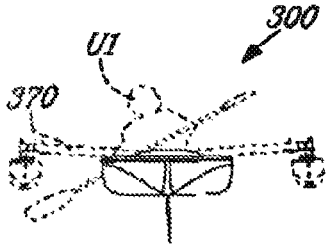
FIG. 81*a* is an additional rear view of the watercraft of FIG. 73, in operation.
Figure 81B:
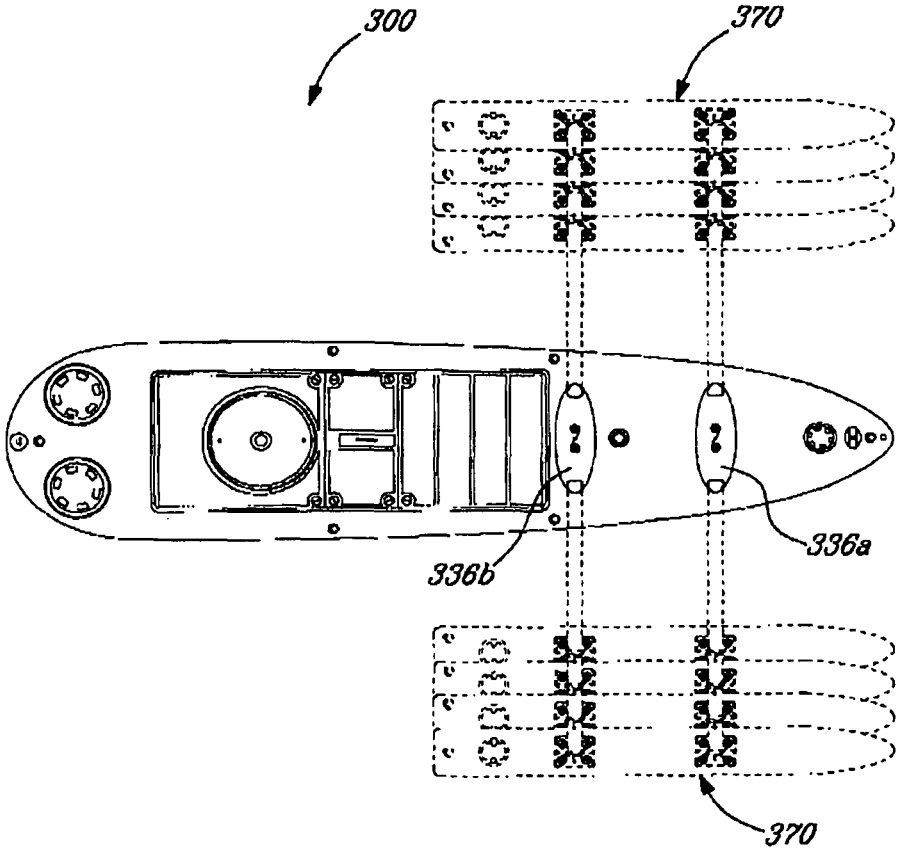
FIG. 81*b* is a top plan view of the watercraft of 41, with an adjustable hull assembly.

FIG. 81*b* shows that the outrigger hull assembly 370 has an adjustable length.

Watercraft 400

Figure 82:
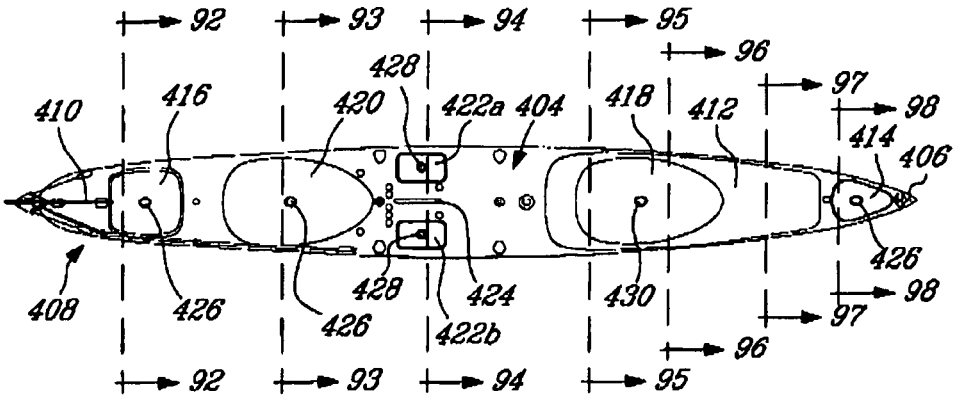
FIG. 82 is a top plan view of a watercraft according to yet another non-restrictive embodiment of the present invention.
Figure 83:
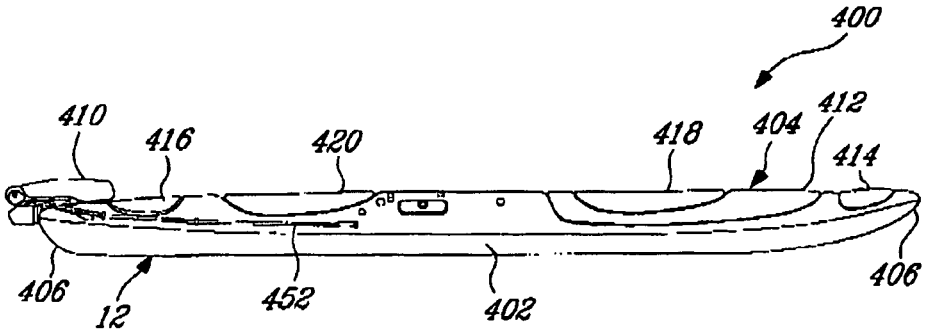
FIG. 83 is a side plan view of the watercraft of FIG. 82.

FIGS. 82 and 83 show watercraft 400 in accordance an embodiment of the present mentioned. The Watercraft includes a hull 402, a deck 404, a bow 406 and a stern 408. The deck 404 includes a daggerboard 410 near the stern 408. Furthermore, the deck 404 includes a main stowage hatch 412, a bow stowage at hatch 415, a stern stowage hatch 416, a front cockpit hatch 418, a rear cockpit hatch 420, a pair of side by side shallow stowage hatches 422*a* and 422*b* with a daggerboard well 424 therebetween. Hatches 416, 420 and 414 include a latch lock mechanism 426. Hatches 422*a* and 422*b* include a latch knob 428, hatch 418 includes a latch lock mechanism type 430. The daggerboard well 424 includes a shock cord 425.

Figure 84:
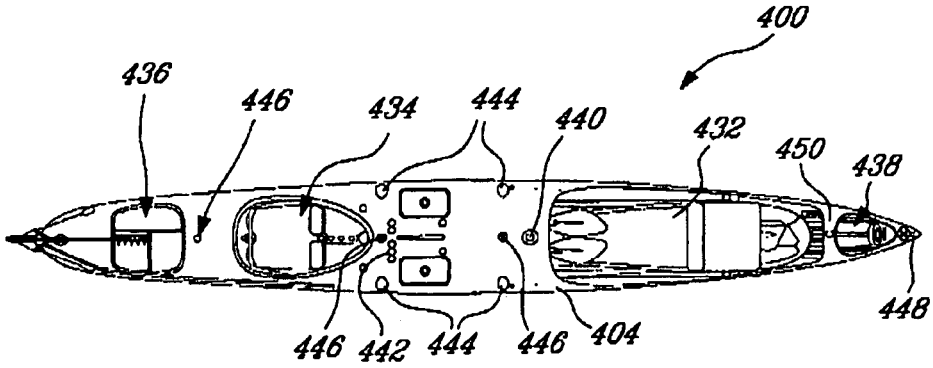
FIG. 84 is a top plan view of the watercraft of FIG. 82, with some portions removed in order to expose some portions inside.
Figure 85:
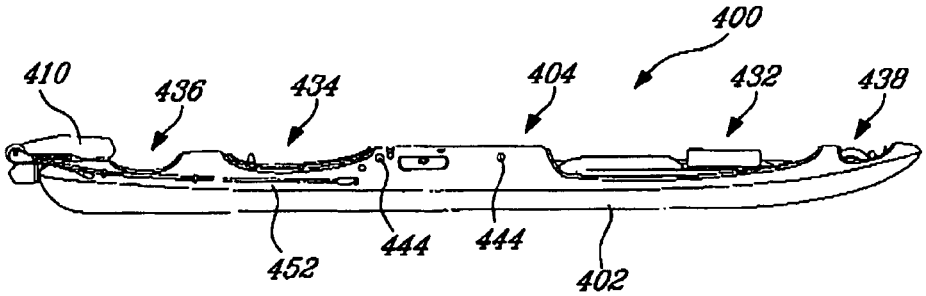
FIG. 85 is a rear plan view of the watercraft of FIG. 84.

With respect to FIGS. 84 and 85 the watercraft 400 is shown having its hatches 418, 412, 420 and 416 removed in order to expose stowage compartments 432, 434 and 436 respectively. Stowage compartment 434 acts as a cockpit. Hatch 414 has also been removed in order to expose stowage compartment 438. The deck 404 also includes a mast well 440, as well as retractable cam jamming cleats/fairleads 442. The deck 404 furthermore includes outrigger hull beam deck receivers 444, outboard motor mounting tightening knobs 446, a bow wheel shaft receiver 448, as well as retractable D-shackles 450. As shown in FIGS. 85 and 83, a rudder control 452 is mounted to the body 12 of watercraft 400.

Figure 86:
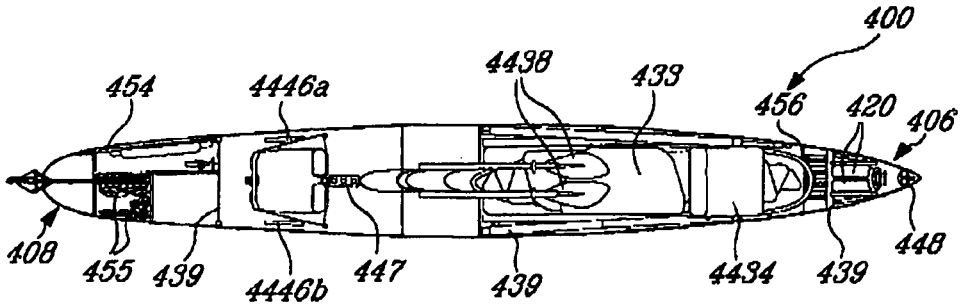
FIG. 86 is a cross-sectional top view of the watercraft of FIG. 82.
Figure 87:
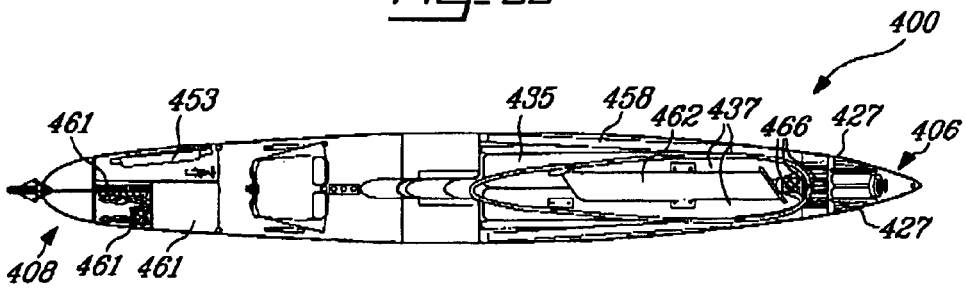
FIG. 87 is another cross-sectional top view of the watercraft of FIG. 82.
Figure 88:
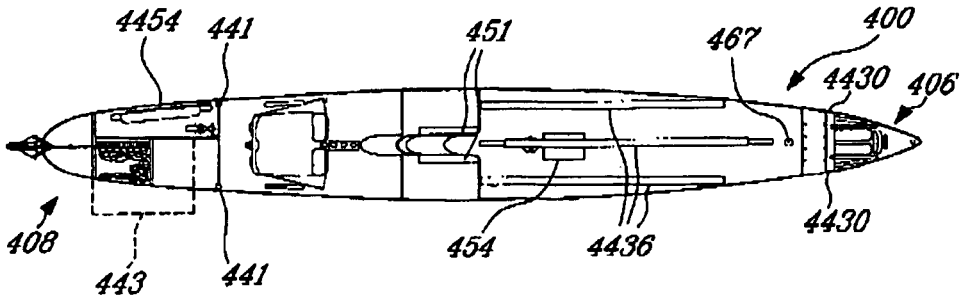
FIG. 88 is a further cross-sectional top view of the watercraft of FIG. 82.

With respect to FIGS. 86, 87 and 88, further elements (including articles) of the watercraft 400, will now be described starting from the stern 408 to moving towards the bow 406 so as to facilitate the present description.

The watercraft 400 includes a tiller extension arm with universal joint 454 and 455, a removable outboard motor mount 453, a stowage compartment 461, inner compartment stowage partitions 443, stern shaft vertical receiver 441, a padded hiking strap 4454 and bulkheads 439. Moving away now from the stern 408 the watercraft 400 includes retractable trapeze seats 4446*a* and 4446*b*, a seat and hiking strap rail 447. Moving towards the center of the watercraft 400, it includes paddle receivers 451, bulkheads 439, a two piece paddle 4438, a main sail 433, a wishbone boom 435 having an adjustable length, outrigger hull beams 458, a latch 459 for battery for an electric motor. Moving now towards the bow 406, the watercraft 400 includes a seat assembly 4434, a bulkhead 439, stern wheels 429, a bow wheel shaft receiver 448, a dagger board 462, outrigger hulls 437, outrigger hull bracket stowage receivers 466, outrigger hull and beam mounting brackets 456, a three-piece mast 4436, a wishbone mast bracket stowage receiver tube 467. Finally near the bow 406, the watercraft 400 includes a stern wheel shaft axle assembly 4430 and a bow wheel shaft axle 427.

Figure 89:
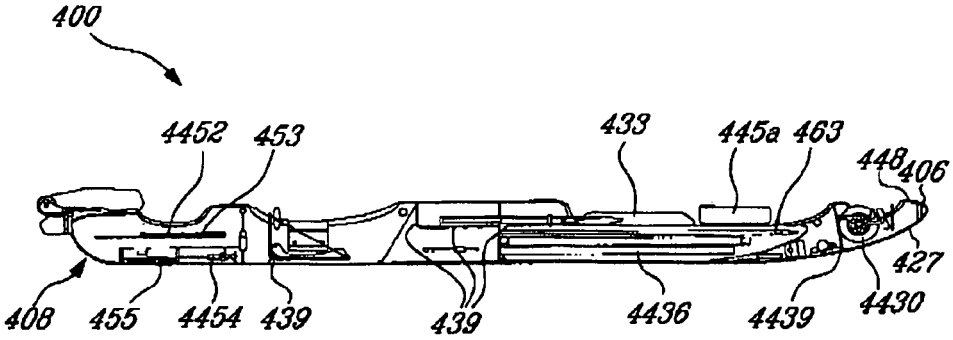
FIG. 89 is a rear view of the watercraft of FIG. 86.
Figure 90:
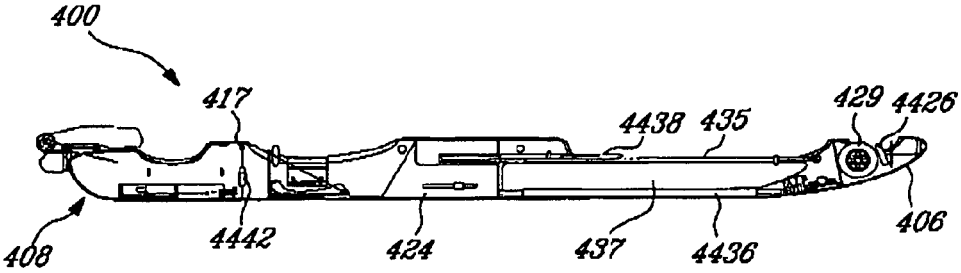
FIG. 90 is a rear view of the watercraft of FIG. 87.
Figure 91:
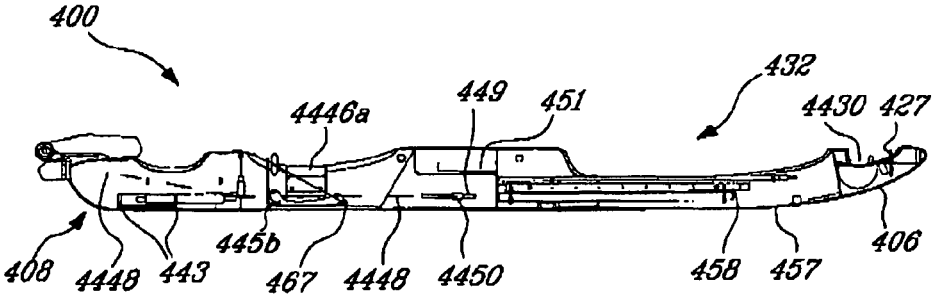
FIG. 91 is a rear view of the watercraft of FIG. 88.
Figure 92:
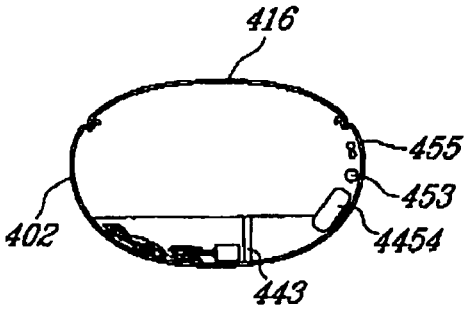
FIG. 92 is a sectional view of the watercraft of FIG. 88, along line 92-92.
Figure 95:
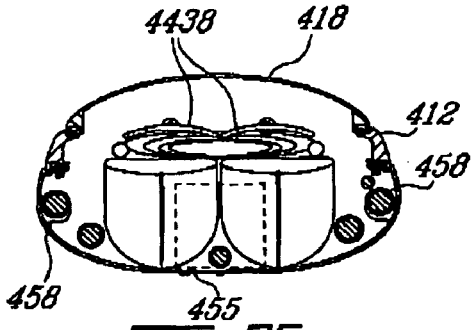
FIG. 95 is a sectional view of the watercraft of FIG. 88, along line 95-95.
Figure 93:
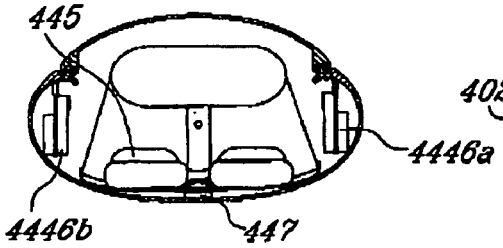
FIG. 93 is a sectional view of the watercraft of FIG. 88, along line 93-93.

FIGS. 89, 90 and 91 show the watercraft 400 and expose elements and articles which were described in FIGS. 82 to 88. Now again taking each FIGS. 89, 90 and 91 separately, the following will only review the elements which have yet to be described again starting from the stern 408 and moving towards the bow 406. In FIG. 89, the watercraft 400 is shown including a removable seat assembly 445 a, a spinnaker pole 463 and a bow wheel shaft axle 427 and finally a stern wheel shaft axle assembly 4430. In FIG. 90 there is shown an outboard motor mount deck receiver 417, a stern shaft axle vertical receiver mechanism 4442, an adjustable length wishbone 435 and a bow wheel 4426. In FIG. 91, a foot rudder control cable 4448 is positioned near the stern 408 followed downstream by a removable seat assembly 445*b*. Also shown is an adjustable rudder pedal 449 and a sliding rail 4450 for the rudder pedal 449. Finally, FIG. 91 also shows a mast wishbone bracket 457. In FIG. 89 there is shown a tiller extension arm 4452 with a universal joint.

Figure 96:
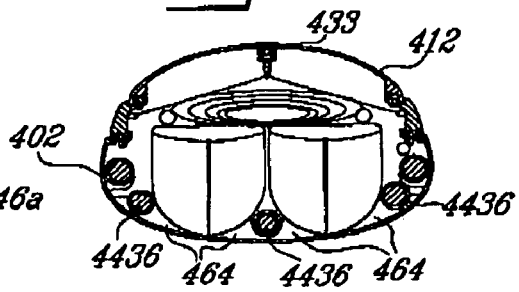
FIG. 96 is a sectional view of the watercraft of FIG. 88, along line 95-96.
Figure 94:
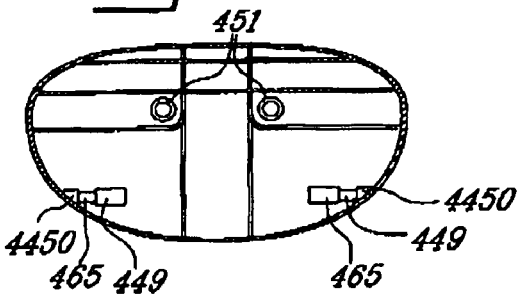
FIG. 94 is a sectional view of the watercraft of FIG. 88, along line 94-94.
Figure 97:
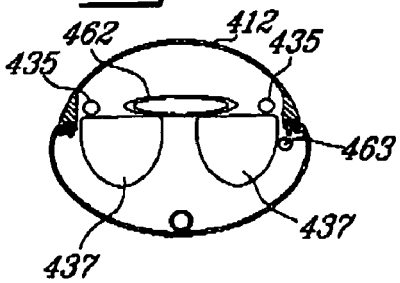
FIG. 97 is a sectional view of the watercraft of FIG. 88, along line 97-97.
Figure 98:
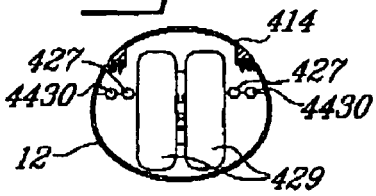
FIG. 98 is a sectional view of the watercraft of FIG. 88, along line 98-98.

FIGS. 92 through 98 expose other views of the above-described elements and articles of the watercraft 400. For concision purposes only, the new elements and articles introduced by FIGS. 92 through 98, will be discussed only. FIG. 96 shows a recess mold in the hull floor which acts as a receiver 464 for the mast and outrigger hulls. FIG. 94 shows that the adjustable rudder pedal is mounted to the sliding rail 4450, via a pedal adjustment bracket 465.

Figure 99:
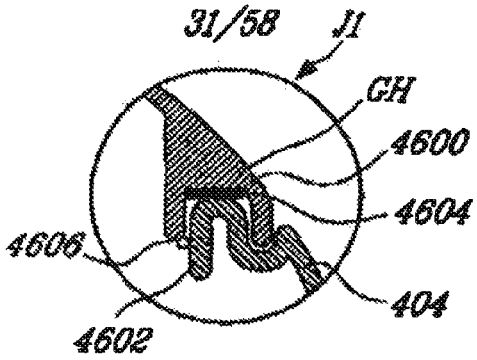
FIG. 99 illustrates a joint used to connect the hatches of the watercraft of FIG. 82 to the deck.
Figure 100:
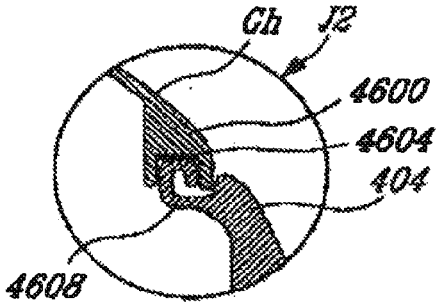
FIG. 100 and FIG. 101 (which is an enlarged view of FIG. 100 illustrate another joint to connect the hatches of the watercraft of FIG. 82 to the deck.
Figure 101:
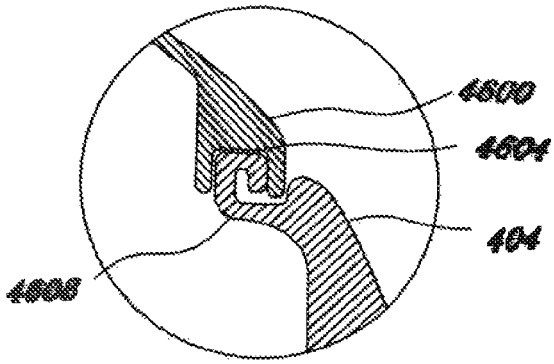
Figure 102:
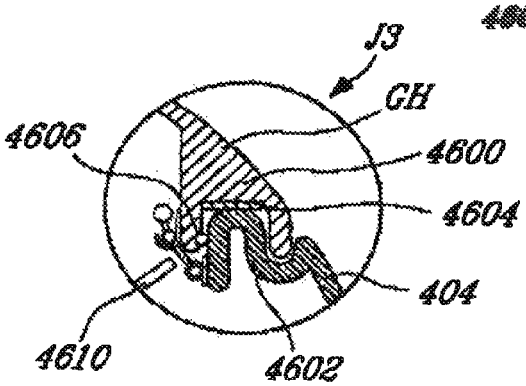
FIG. 102 illustrates a further joint to connect, the hatches of the watercraft of FIG. 82 to the deck.

Turning now to FIGS. 99, 100 and 102, various joints will be describe herein, which are use to connect the hatches (or panels) of watercraft 400 to the deck 404. The enlarged circle shows the type of joint used for a particular hatch to be joined to the deck or main body 12. Given the fact that the various hatches of the present watercraft 400 have been denoted with different reference numerals, we will here use the reference GH (i.e. generic hatch) and of course 404 for a deck. As can be seen in FIG. 99 (joint J1), the hatch GH defines a hand or a palm female portion 4600, while the deck 404 joint defines a male hand 4602 to be placed within the female recess 4600. Seal elements 4604 and 4606 provide a secure fit. FIG. 100 shows a joint J2 in which the hatch GH includes an open female hand 4600, while the deck 404 defines a fist-like male hand 4606, a seal element 4604 is placed therebetween. Turning now to FIG. 102, there is shown a joint J3, which is similar to the joint J1 described in FIG. 99, with the exception that it contains a t-latch to solidly secure the hatch GH to the deck 404 from the inside.

With respect to FIGS. 103 to 117 the watercraft 400 will now be described during its operational configurations.

Figure 103:
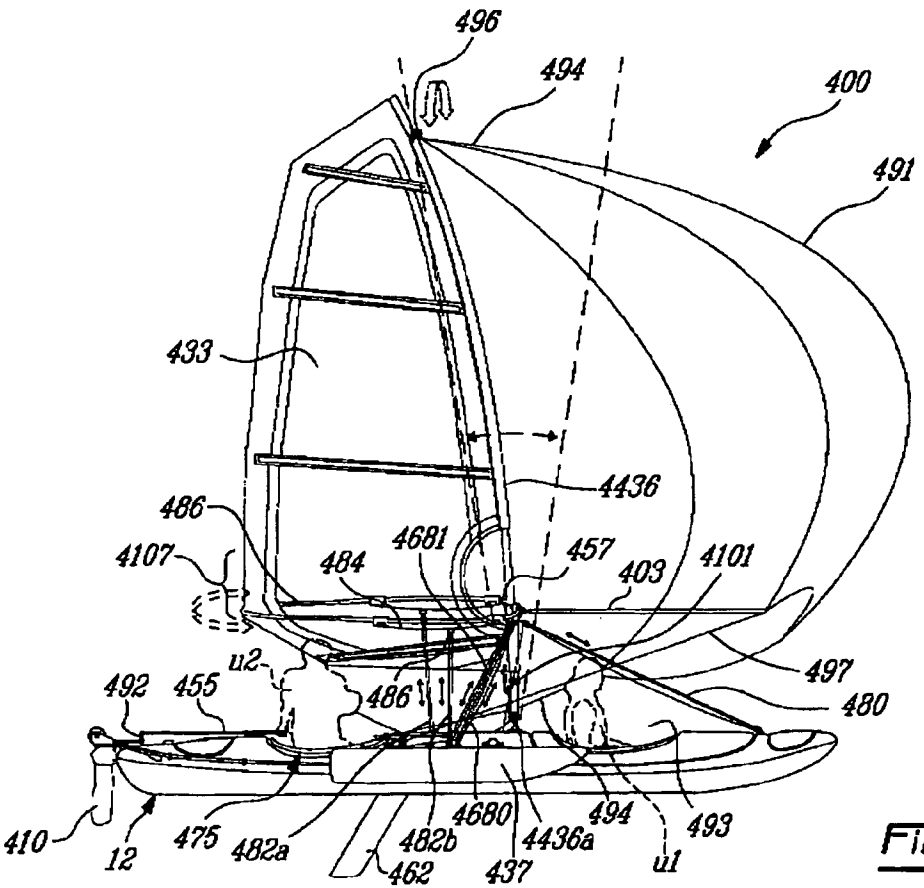
FIG. 103 is a side view of the watercraft of FIG. 82, being transformed into a sailboat.

FIG. 103 shows the Watercraft 400 having been transformed into a sailboat. The sailboat 400 includes a main sail 433, a spinnaker 491, a mast 4436 holds up the main sail 433, the adjustable wishbone boom 435 is mounted to the mast 4436 via a mast wishbone bracket 457, the wishbone is also mounted to the main sell 433. The spinnaker 491 is mounted to the mast 4436, via a removable mast jaw clamp 496 at it head 498 level. The spinnaker 491 is also attached to the main body 12 of the Watercraft 400 via the Guy 497 and a spinnaker sheet 494 at the bottom area thereof. A tack rope 4101 is positioned to the mast—4436 near the bottom end thereof, the mast being mounted the mast well via a flexible base 4436*a*. An adjustable running forestay system 480 is mounted to the bracket 457 at one end and to the main body 12 of the watercraft 400, at another end: Furthermore, lateral shroud ropes 4680 and 4681 are also mounted to the main body 12 and the bracket 457, thereby representing a mast control and securing mechanism. An adjustable lateral shroud ropes 482*a* and 482*b* are attached to a wishbone rope traveler 484 via a wishbone traveler car 486. A user U1 is in the bow cockpit 493, while a user U2 is in the stern cockpit 475 and can manually control the rudder 410 via the rudder steering stick 455 which is connected to a tiller universal joint 492. A spinnaker pole 463 is mounted from the spinnaker 491 to the bracket 457.

Figure 104:
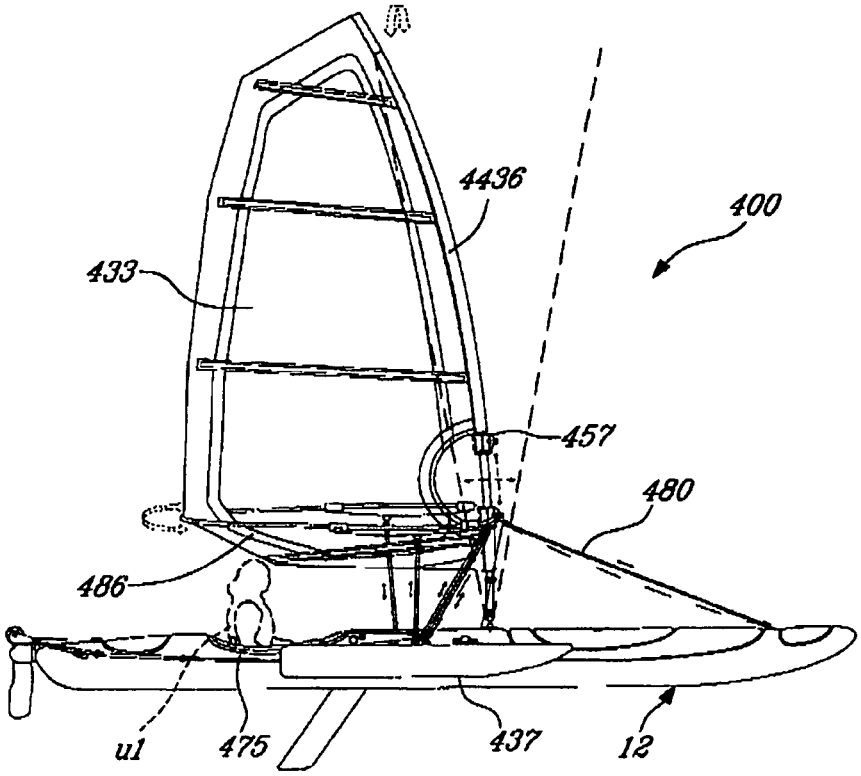
FIG. 104 is another side view of the watercraft of FIG. 82, being transformed into a sailboat.
Figure 105:
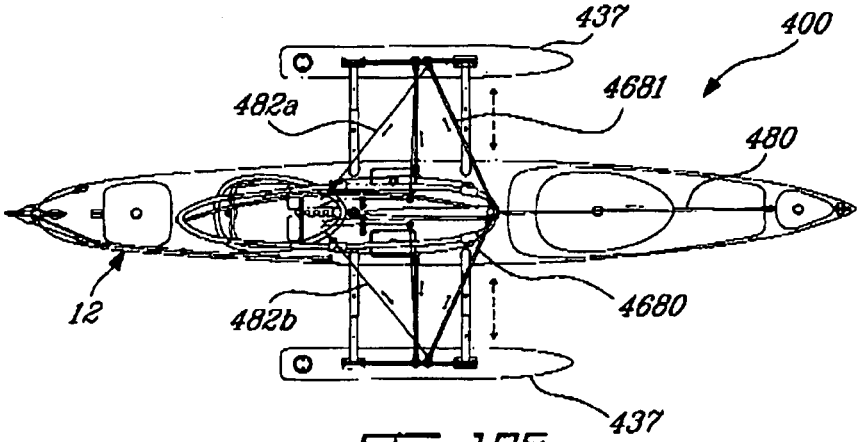
FIG. 105 is a top view of the watercraft of FIG. 104.

With respect to FIGS. 104 and 105 the watercraft 400 is in the form of a sailboat having a mast 4436 with a main sail 433. The forestay rope 480 is mounted to the bracket 457. Also mounted to the bracket 457 are lateral shroud ropes 4681 and 4680 which are mounted at their opposite end to outrigger hulls 437 at each lateral side of the watercraft 400. The lateral sheet ropes 482*a* and 482*b* are also mounted from the wishbone 486 to the outrigger hulls 437. A user U1 is in the stern cockpit 475 and may control the sail and mast via the aforementioned ropes.

Figure 106A:
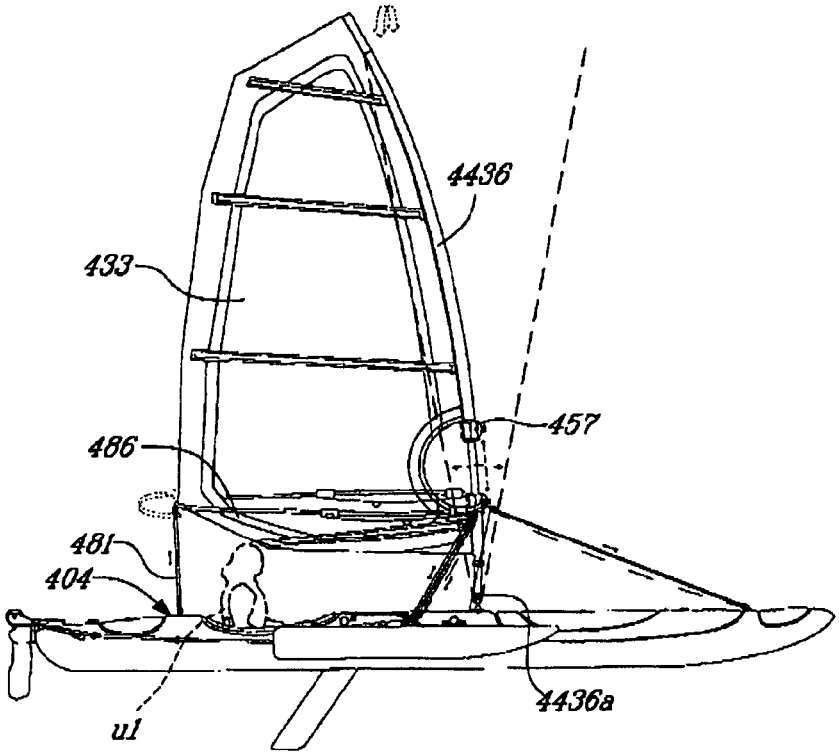
FIG. 106 is a further side view of the watercraft of FIG. 82, being transformed into a sailboat.
Figure 106B:
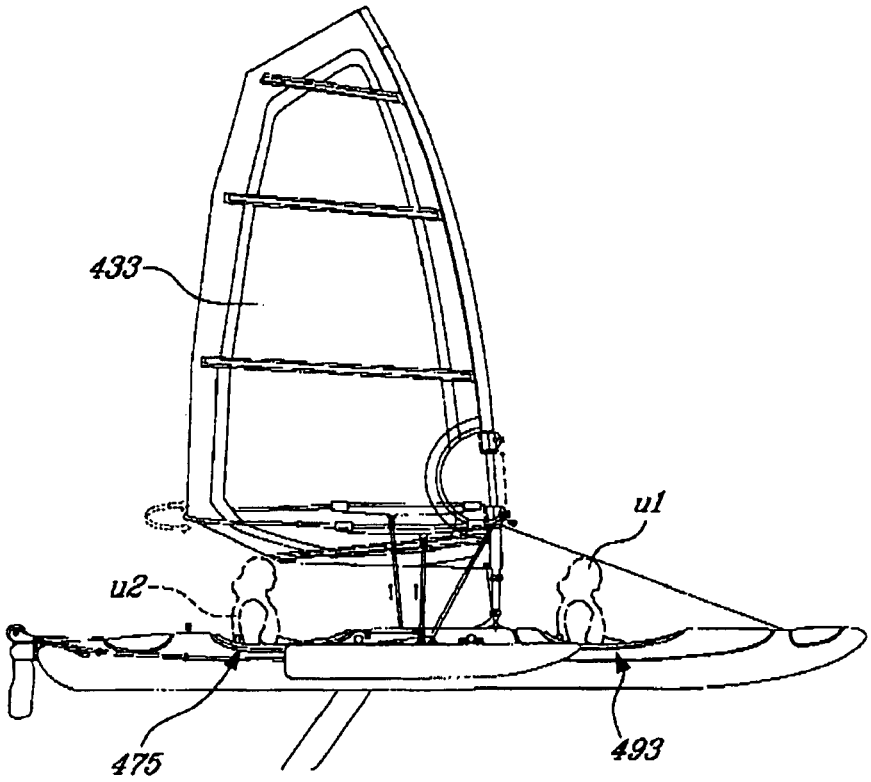

FIG. 106 is similar to FIG. 104 with the exception being that a stern main sail sheet rope 481 has been mounted to the deck 404 and the wishbone 486.

Figure 107:
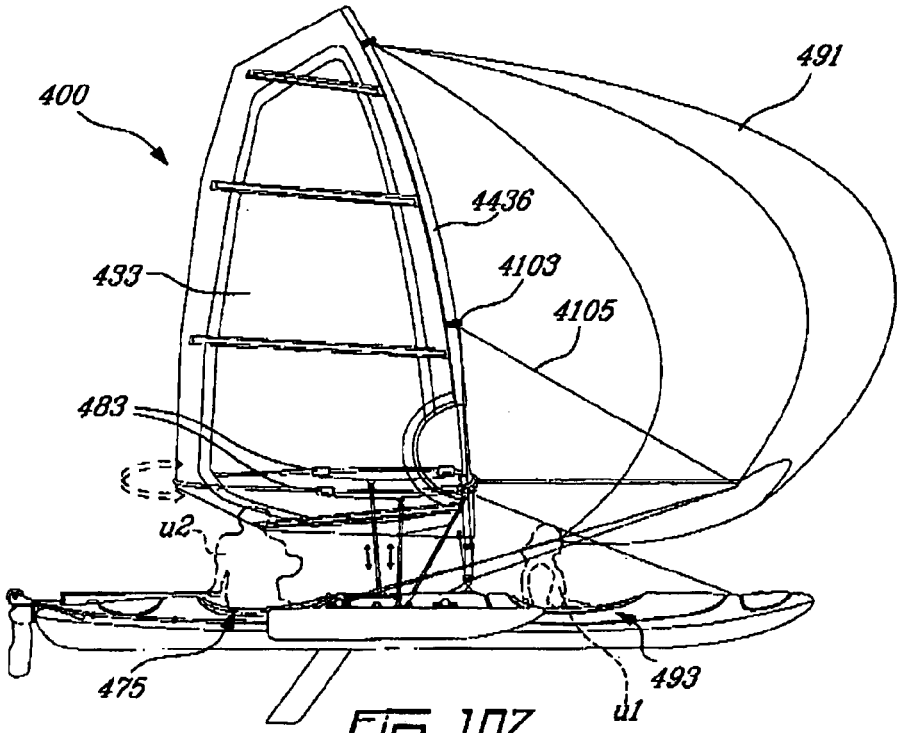
FIG. 107 is a side view of the watercraft of FIG. 104, with more than one person sitting in the watercraft.
Figure 108:
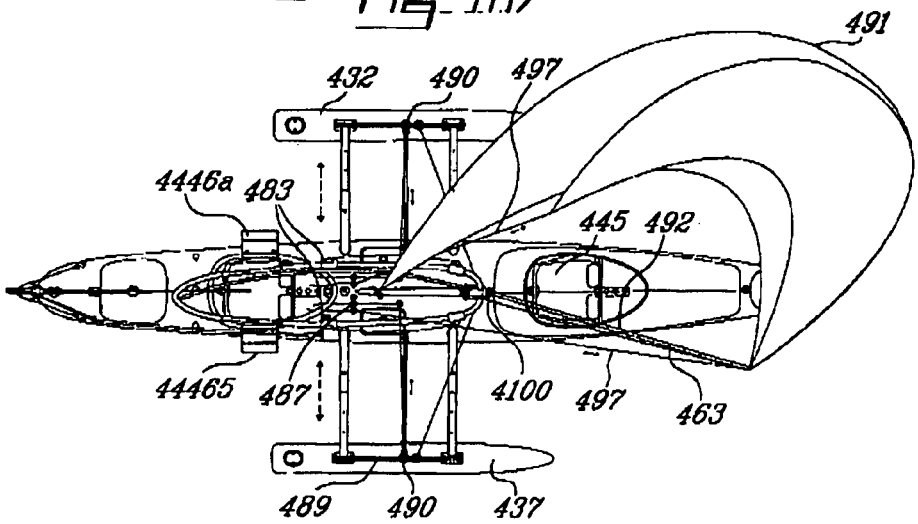
FIG. 108 is a top plan view of the watercraft of FIG. 107.

FIG. 107 is similar to FIG. 104 with the difference being that the hatch 418 has been removed in order to provide a bow cockpit 493 for user while user U2 is in the stern cockpit 47. With the reference now to FIGS. 107 and 108 the watercraft sailboat 400 will further be described. Since FIGS. 107 and 108 are similar to FIG. 103, only the yet to be identified elements will be discussed herein for concision purposes only. As can be seen, the wishbone 486 includes clip members (or brackets) 483 for mounting the rope traveler 484 to the sail controlling ropes mentioned herein and as can be understood by the person having skill in the art. Referring to the hulls 437, an outrigger hull traveler car 490 within traveler sliding rail 489 are provided. The deck 404 also includes a jamming cleat fairlead fore spinnaker guy or sheet 487. Finally an uphaul 4105 is mounted to the spinnaker 491 at one end thereof and to the removable mast halyard bracket 4103 which is on the mast 4436, at the other end thereof.

FIGS. 109 to 112 show the watercraft 400 having been transformed into a paddle boat.

Figure 109:
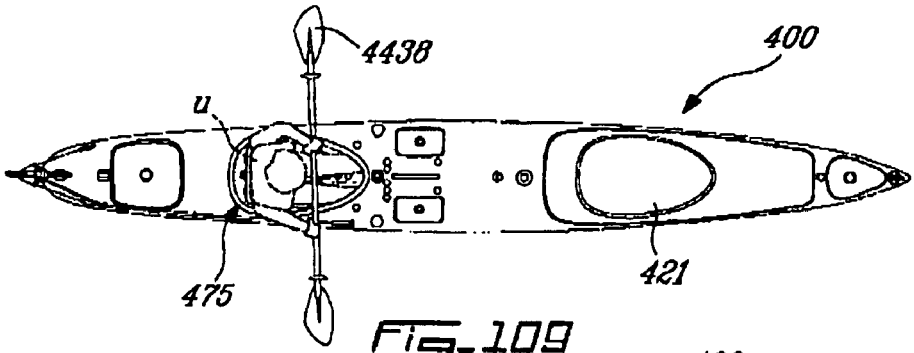
FIG. 109 is a top plan view of the watercraft of FIG. 82, being transformed into a paddle boat.
Figure 110:
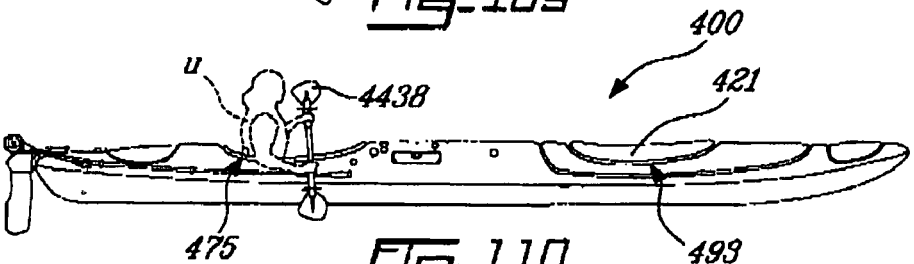
FIG. 110 is a side plan view of the watercraft of FIG. 109.
Figure 111:
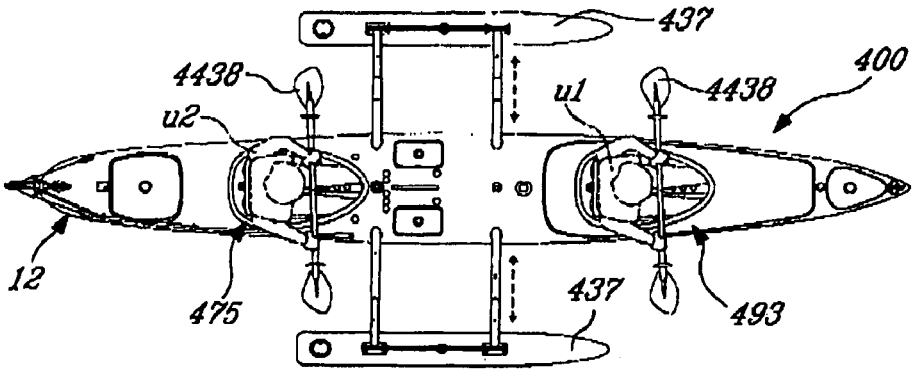
FIG. 111 is another top plan view of the watercraft of FIG. 82, being transformed into a paddle boat.
Figure 112:
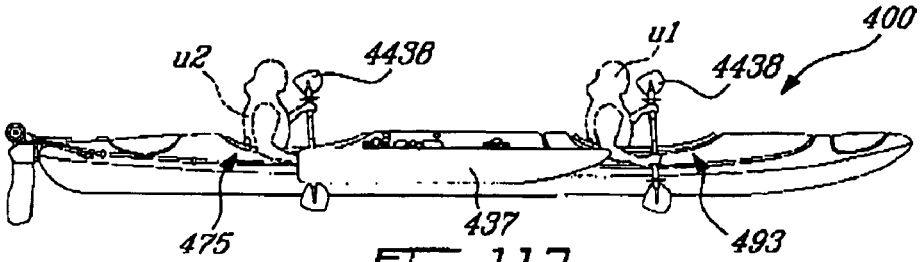
FIG. 112 is a side plan view of the watercraft of FIG. 111.

FIGS. 109 and 110 shows the paddle boat 400 having a stern cockpit 475 with the user U holding a paddle 4438, the cockpit cover 421 covers cockpit 493. FIGS. 111 and 112 show the bow cockpit—493 and the stern cockpit 475 respectively hosting users U1 and U2, each holding respective paddles 4438. Outrigger hulls 437 have been mounted to the main body 12. Therefore, FIGS. 109, 110, 111 and 112 provide a kayak 400.

Figure 113:
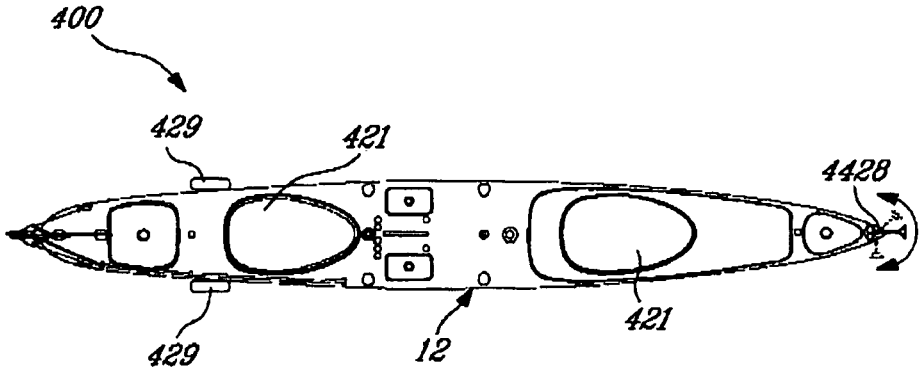
FIG. 113 is a further top plan view of the watercraft of FIG. 82, being transformed into a paddle boat.

FIGS. 113 and 114 show the Watercraft 400 when it is to be trained on land. Stern wheels are added on the main body 12, the stern wheel shaft axle assembly 4430, the cockpits 493 and 475 can be covered by soft cockpit covers 421, a bow wheel 4426 is added near the bow 406 of the watercraft 400 the shaft 427 and the steering thereof is controlled by an articulate handle 4428.

Watercraft Elements

In this section, FIGS. 115 to 193, a variety of elements including watercraft articles and subcomponents for the watercraft and of the watercraft which are mounted or mountable to the watercraft will be described herein:

As will be detailed herein, FIGS. 115 to 147 shown on-road and off-road trailer- or wheel-assemblies for watercrafts, FIGS. 148 to 153 show retractable cleats, FIG. 154 shows retractable handles, FIGS. 155 to 160 shows the latch lock devices, FIGS. 161 to 165 show removable deck hatches/panels, FIGS. 166 to 170 show a mast mounting assembly, FIGS. 171 and 172 show a removable mast halyard bracket, FIG. 173 shows a mast-wishbone bracket, FIG. 174*a* shows outrigger beam/hull brackets, FIGS. 175 to 188 show seats, FIGS. 189 and 189*a* show a retractable rudder and keel/centreboard/daggerboard and rudder steering (controlling) assemblies, and FIGS. 190 to 193 show a rotary plate member rudder control.

On-Road and Off-Rod Trailer- or Wheel-Assemblies for Watercrafts

FIGS. 115 to 118 show examples of a trailer or wheel assembly mountable to the main body 12 of the watercrafts of the invention for trailing thereof and generally denoted with reference numeral 500. More specifically, the three embodiments shown in FIGS. 115, 116 and 117 are respectively denoted as 500*a*, 500*b* and 500*c*.

In reference to FIG. 115 (trailer or wheel assembly 500*a*), the main body 12 is shown having a vertical shaft 501 inserted therein at each lateral side thereof. The vertical shaft 501 is connected an axle 502 mounted to a wheel 505.

FIG. 116 shows trailer or trailer or wheel assembly 500*b* having a horizontal shaft 503 mounted in the main body 12 of the watercraft of the present invention at each lateral side thereof.

The horizontal shaft 503 is connected to an axle 502 which is mounted to a wheel 505.

FIG. 117 shows a trailer or wheel assembly 500*c* with the main body 12 having a horizontal shaft axle 504 mounted therein at each side thereof and carrying wheel 505.

Referring now to portion P of FIGS. 115, 116 and 117, there is shown a shaft 501 inserted within a structural receiving tube 508 and placed within a structural sleeve 511 on the inside of the receiving tube 508. A locking pin 509 keeps receiver sleeve 511 and shaft 501 locked together. A seal cap 510 caps the sleeve 511 in order to keep the locking pin 509 in place, thereby locking the shaft 501 to the body 12. Of course a hatch on the deck of the watercraft can be removed in order to release the shaft 501 from the main body 12.

FIG. 118 shows an axle 502 with the wheel safety pin 506 as well as a key way 507 for locking the wheel and shaft assembly at the entry of the receiver tube 508.

Figure 119:
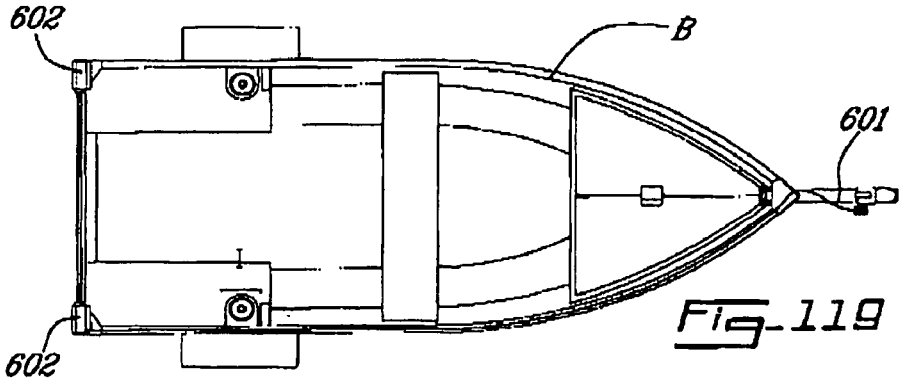
Figure 120:
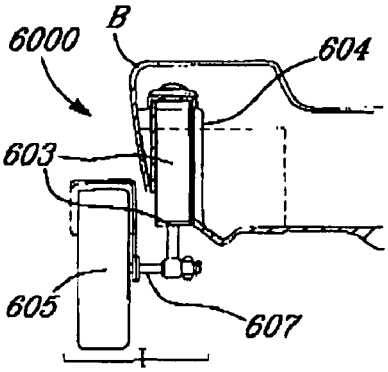
Figure 121:
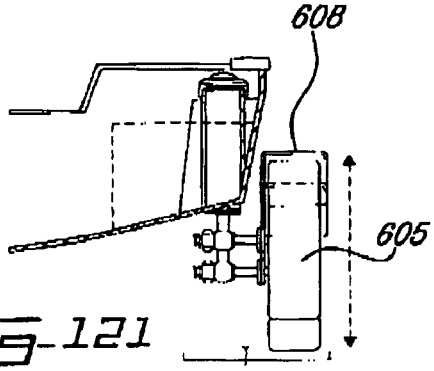

With reference to FIGS. 119 to 121, there is shown a trailer or wheel assembly 500*d* for a boat B in accordance with the watercraft of the present invention. The boat B includes a wire 601 for backlights 602 shown in FIG. 119.

Turning now to FIGS. 120 and 121. A suspension cartridge system generally denoted 603 is inserted inside the body of boat B within a structural receiving tube 608. An axle hub bearing assembly 607 carries the wheel 605 which is topped by a finder 608.

Figure 122:
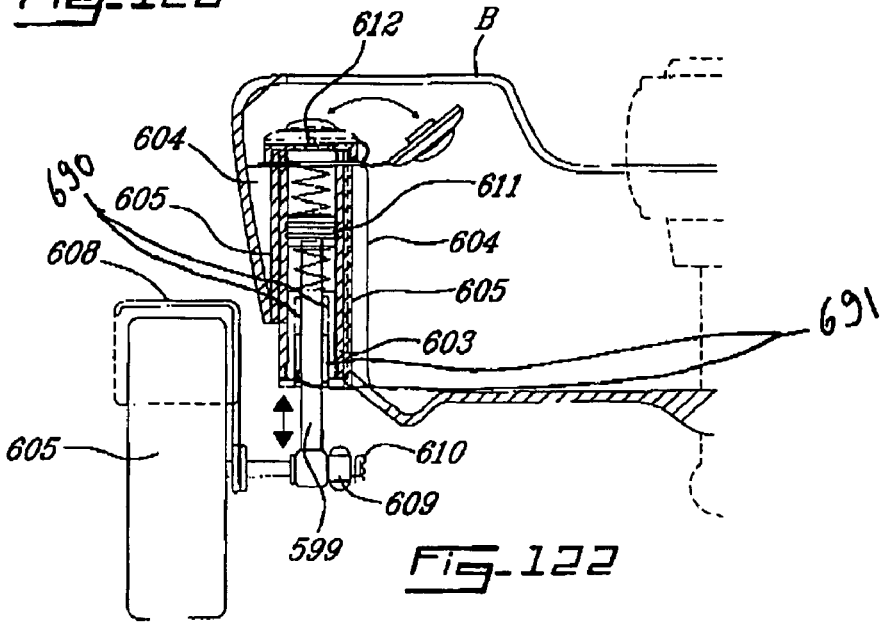

Referring to FIG. 122, the height of the wheel 605 relative to boat B is adjustable via the suspension cartridge assembly 603. The suspension cartridge assembly 603 is placed within a structural inner sleeve 605 and includes a piston spring assembly 611 therein. The shaft 599 is movable within the cartridge assembly 603 to adjust the height of the wheel 605 relative to boat B. An air valve 612 allows adding pressure into the cartridge 603, which will push the spring assembly 611 downwards, thereby lifting the boat B relative to the wheel 605. The cap 613 closes the air valve 612. At the bottom end of shaft 599, there is a lock nut 609, which is locked in place via safety pin 610. It should be noted that the cartridge 603 includes channels or grooves 690 for receiving a key way 691 which locks the shaft 599 and hence, wheel in position so that there is not left to right movement.

Figure 123:
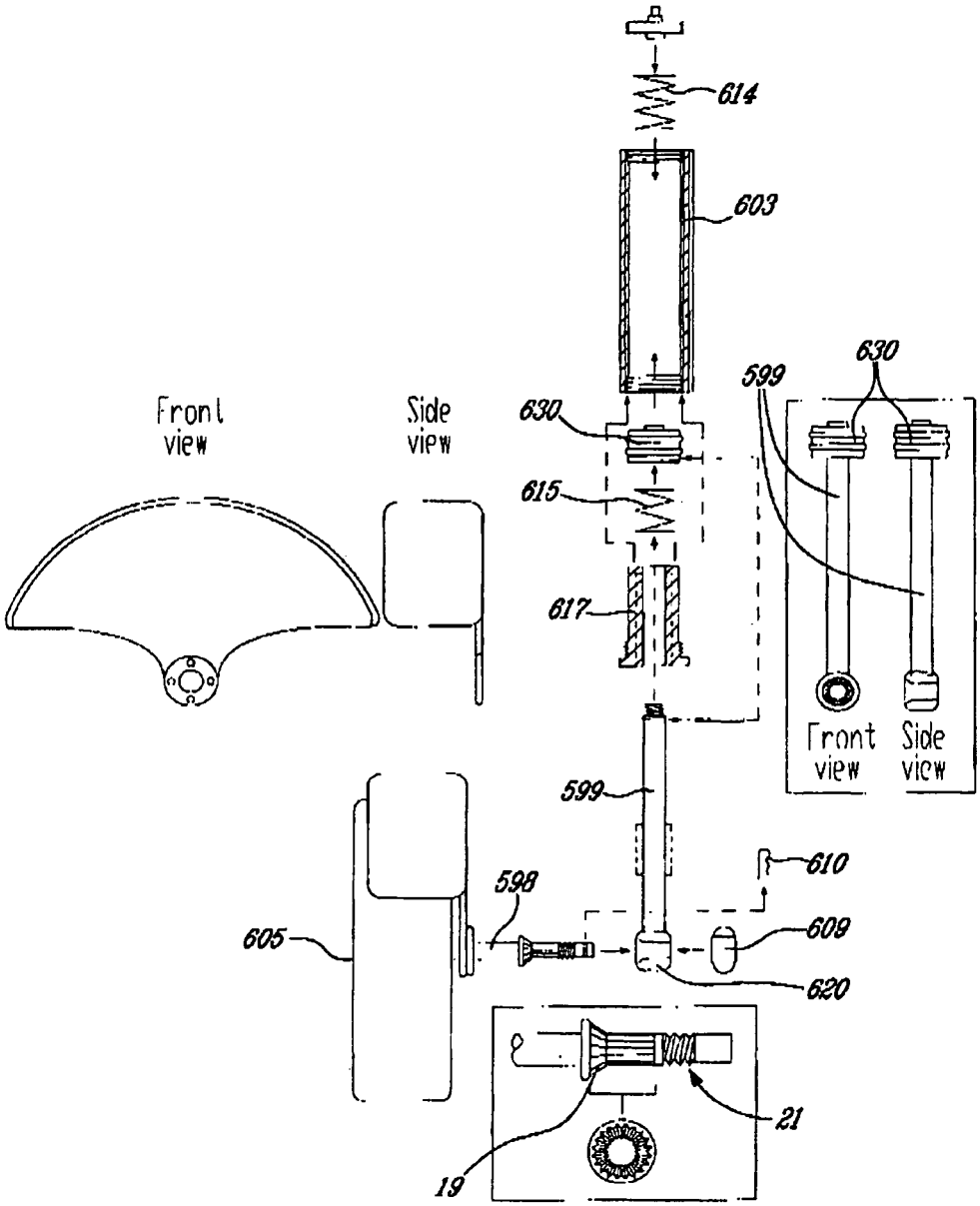

With reference to FIG. 123, there is shown the cartridge and trailer or wheel assembly in a disassemble disposition. A load spring 614 is inserted within the cartridge tube 603 (603 refers to the assembly as a whole as well as the tube), the piston 630 is also inserted within the cartridge tube 603 followed by a rebound spring 615, the lower screw sleeve in oil seal 617 which is engaged by the shaft 599 is strategy secured within the cartridge tube 603. The top of the shaft 599 carries the piston 630 within the cartridge tube 603. The bottom of the shaft 599 includes a female shaft axle receiver 620 which receives the axle 598, specifically it receives a threaded portion of 621 of the axle 590 which is adjacent to a conical lock axle threaded portion 519 as well. As can be seeing in the front view and side view portion of FIG. 123, the female axle receiving portion 620 is internally threaded. A safety pin 610 and lock joint 609 secure axle 598 to the shaft 599.

Figures 124A, 124B, 124C, 124D, 124E, 124F:
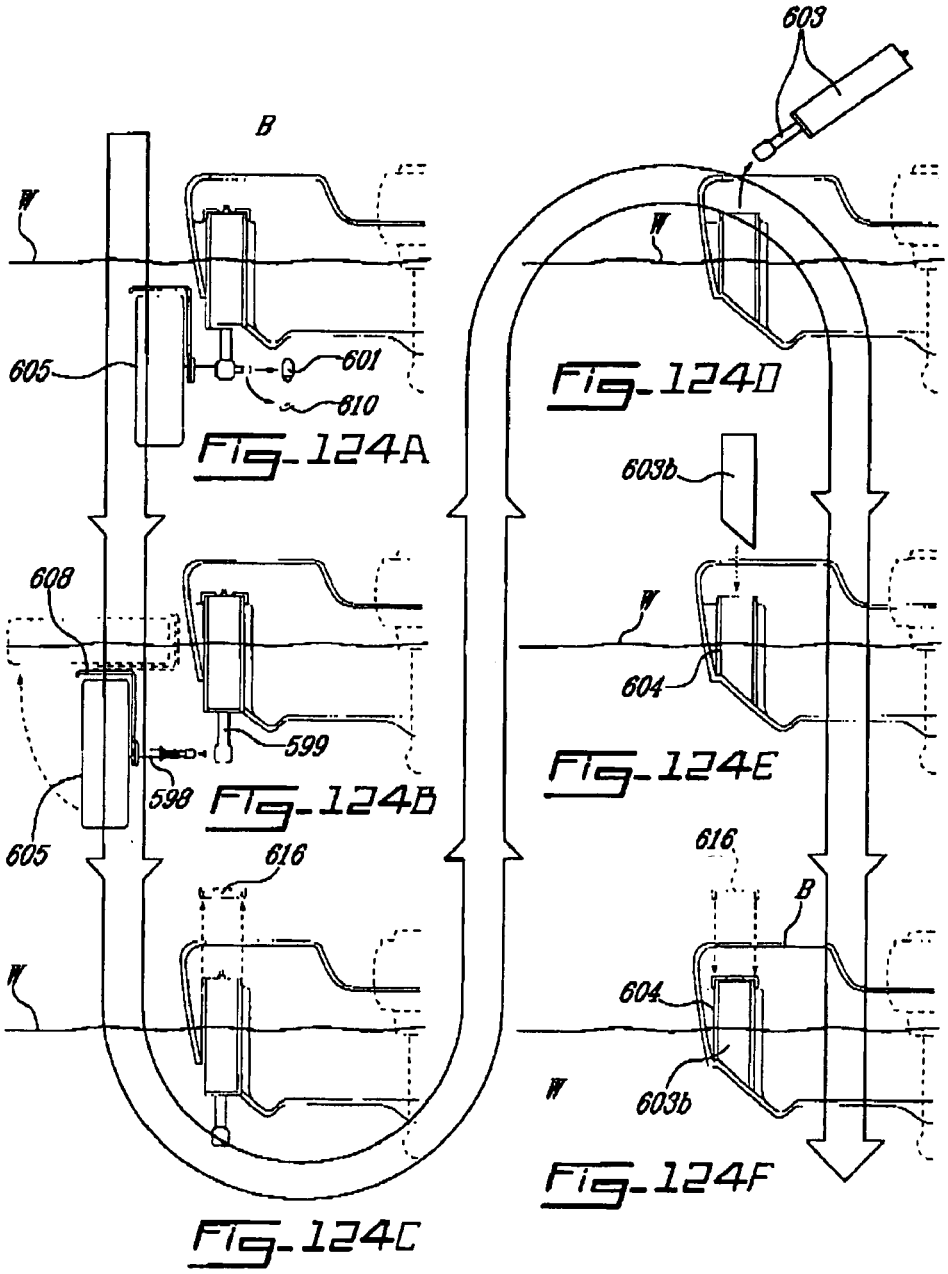
Figure 125:
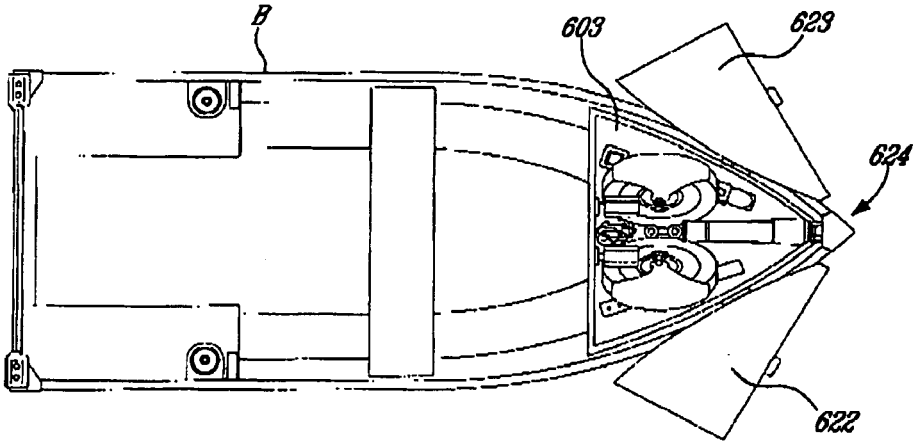
Figure 126:
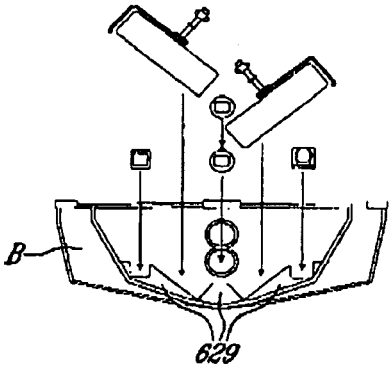

FIG. 124 is a sequential representation of the removal of a trailer or wheel assembly 600 from a boat B being in the water (W). Therefore, FIG. 124A shows the boat B being launched in the water W with wheels 605 (only one lateral wheel shown here) under the water W. The pin 610 is removed which releases the joint lock 609. As shown in FIG. 124B, the wheel 605 along with the finder 608 and axle 598 can thus be removed from engagement of the shaft 599. Furthermore, as shown in FIG. 124C the cap 616 is taken off and the cartridge and shaft assembly 603 a can thus be removed as shown in FIG. 1240. In its place as as shown in FIGS. 124E and 124F, a blank cartridge 603*b* is inserted into the sleeve 604. The cap 616 is then secured onto the sleeve 604 with the blank cartridge 603*b* enclosed therein.

Figure 127:
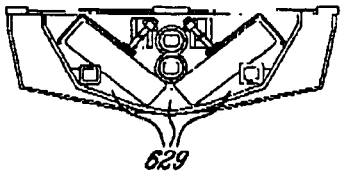
Figure 128:
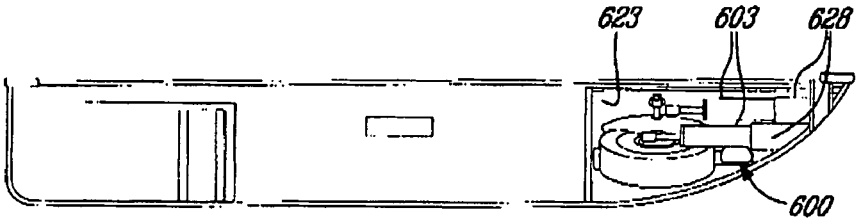

FIGS. 125 to 128 show how the trailer or wheel assembly 600 is stowed within a boat B according to an embodiment of the present invention. The boat B includes a stowage compartment 623 having a pair of hatches 622 at the bow 624. As shown in FIG. 127, the boat B includes internal moulded receivers 629 in stowage compartment 623 for wheels. Furthermore, as shown in FIG. 128, the stowage compartment 623 includes receiving tubes 628 for receiving the cartridge tube 603.

Figure 129:
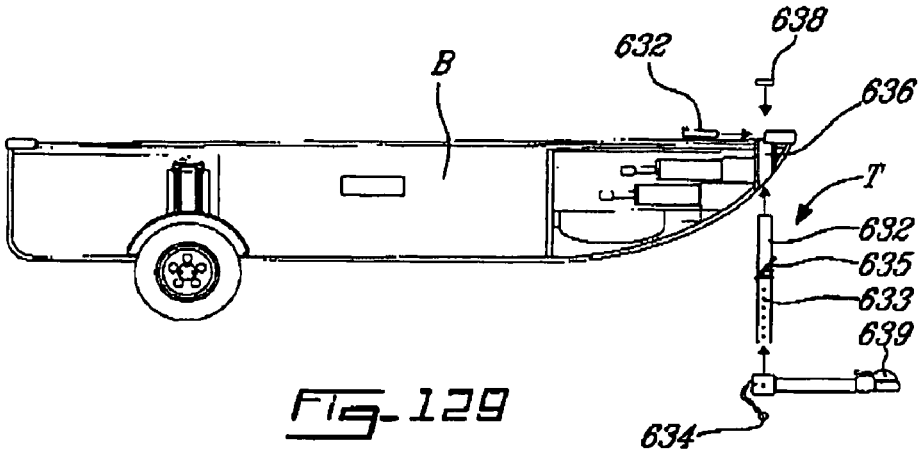
Figure 130:
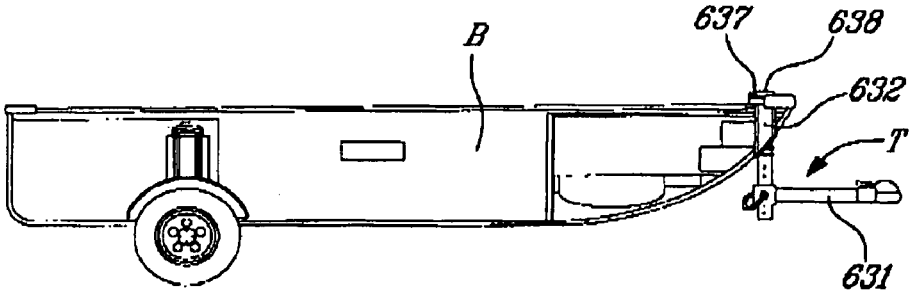
Figure 131:
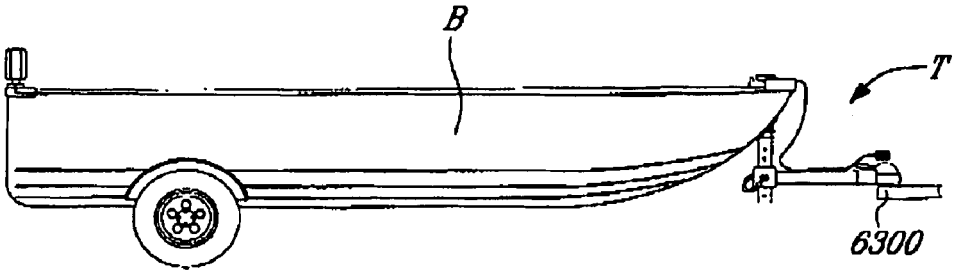

Referring now to FIGS. 129 to 131, a tow assembly T will be described. The tow assembly T includes a vertical front arm 632 with adjustable height holes 633, as well as a vertical arm boat rest 635 and is configured to be inserted in vertical arm structural receiver 636 at the bow of boat B. A lock 637 engages arm 632 and a safety lock pin 638 engages the lock 637. A horizontal arm 631 is mounted to the vertical arm 632 and carries a locking hand-ball 639 as well as a lock pin 634 at one longitudinal end thereof and ball 6300 at the another longitudinal end thereof.

With reference now to FIGS. 132 through 137, an example of a catamaran C having a on-off road trailer or wheel assembly 700 will now be described. The catamaran C includes hulls 701, a stowage compartment 702, a moulded receiver 703 to receive a wheel 777. With reference to FIG. 133, a receiving tube 708 includes a blank cartridge 710 therein. The catamaran C includes transverse booms 706 shown in FIG. 135. FIG. 136 shows a trampoline 707 mounted to the booms 706 and positioned between the hulls 701. Each hull 701 has a stowage compartment 702, as well as a hatch 704 having a lock 705 (shown here in a removed position. Looking now into stowage compartment 702, there is a suspension cartridge 709 behind tubular member 708 which holds the blank cartridge 710.

FIG. 137 shows the catamaran C on-ground or on-road ready to be trained, thereby defining a catamaran trailer C. The catamaran trailer C has lateral wheels 777 and a front towing assembly T7. With reference to FIGS. 138 and 139 a telescopic lock vertical beam 713 is inserted within a telescopic horizontal beam 711, which is inserted into the telescopic beam receivers 712 formed within each hull 701. A bottom horizontal arm 714 has at its free end a receiver 715 for receiving the vertical arm 713, as well as a safety lock pin 716 for locking arm 713 to arm 714 (also see FIGS. 140 and 141). With reference to FIGS. 142 and 143 a mast support 716 is mounted to the horizontal telescopic beam 711 about the vertical arm 713 as known in the art.

FIG. 144 shows the catamaran C having a pair of suspension cartridge assemblies 750 on the hulls 701 thereof with a respective wheel 777 mounted on the outside of the catamaran C. FIG. 145 is similar to FIG. 144 with the exception being that the wheels 777 have been replaced by balloon wheels 778. FIG. 146 shows that the hulls 701 of the catamaran C have two tubular receivers 708 and 708*b*, in this case the wheels 777 with their respective cartridge assembly 750 have been mounted to the inside or inner position of the catamaran C by mounting the cartridges 750 to the tubular receivers 708*b*. On the other hand, as shown in FIG. 147 the wheels 778 can be mounted to the outer side of the catamaran C by placing the cartridge suspension system 750 within the tubular receiver 708.

Retractable Cleats

FIGS. 148 and 150 show a U-shackle retractable cleat 800 in accordance with an embodiment of the present of the invention.

Referring specifically to FIG. 149, there shown a deck 801, an upper casing 802, a lower casing 803, the upper casing 802 is screwed within deck 801 and the lower casing 803 is threaded onto the upper casing 802. In this respect, the deck 801 has internally threaded sleeves 804 to provide a knob 805 to be secured therein. The U-shackle 8U is mounted to an axle 807, the axle 807 is mounted to a screw member 806, which can raise or lower the shackle 8U given the fact that the screw member 806 is theadedly mounted to the upper casing 802. When lowering the screw member 806, a cover 808 can be placed on top of the U-shackle 8U and the cover 808 will be substantially flush with the deck 801.

The D-shackle cleat 800D shown in FIGS. 151, 152 and 153 is substantially similar to the U-shackle 800, with the difference being that the D-shackle includes a swivelling rope guide 809 as well as locking rings 811 mounted on the screw member 806. As shown, a rope member 812 can be mounted on the D-shackle cleat 800D.

Retractable Handles

FIG. 154 shows a retractable handle assembly 900 in accordance with the present invention.

The handle 901 is connected to a rope 902 that has a ball 903 at the top thereof. The rope 902 is connected to a unison restrictor 904 which acts as a stopper. The unison restrictor 904 is connected to an elastic 905 which is mounted either to the floor 9F (of the hull) or the inner side of deck 9D.

In operation, the handle 901 is within a recess 910 and as such flush with the deck 90. When the user pulls on the handle 901, the rope 902 will act on the unison member 904 and via the tension of the elastic 905 will slow down or resist this pulling movement and the member 904 will act as a stopper to stop the retractable handle 901 from moving any further than the predetermined distance allowed by stopper 904. When the user releases the handle 901 then the tension of the elastic 905 will pull it back and retract it back into its recess 910.

Latch Lock Devices

Referring now to FIGS. 155 to 156*b* a latch lock device 1000 will now be described.

As shown in FIGS. 155 to 156*b*, a latch lock device or assembly 1000 is mounted within recess on the deck. The device 1000 includes an external threaded cup 1002 as well as a ball handle 1004 that has a string 1006 which includes a ball lock 1008 that is attached to a spring system 1010. The spring system or assembly 1010 includes a spring 1012 within a tubular housing 1014 and ball member 1016, that abuts the spring 1012, as well as a bottom ball member 1018 that is in locked with the floor. When the user pulls on ball 1004 as shown in FIG. 156, the locked ball 1008 will go through an opening 1020 in the cup 1002 thereby, causing tension in the spring system 1010 as shown in FIG. 155. When the user screws cup 1002, this will raise the cup 1002 further outward causing tension to spring 1012 and keeping the locked ball 1008 in the position shown in the FIG. 156A. The cap 1022 is added and screwed within the cup 1002 to hold the deck (i.e. a movable/removable auxiliary portion thereof) in place. This type of latch locking device can be used to keep hatches, covers, panels and any like-element in place on the watercrafts n the present invention.

Another way of locking a cap so as not to allow panels to move is shown n FIGS. 157, 158 and 159. In this case the cap 1002 includes a magnetic pin member 1024 that has a spring 1026 to outwardly push it in order to engagingly lock with a an adjacent complementary member (within the deck recess) thereby preventing the cap to be removed, hence keeping a panel a hatch or another cover in place as is shown throughout the present application. In order to release this pin 1024 which is magnetic, a magnetic key 1026 is inserted in a slot 1028 and the magnetic attraction of the key 1026 will cause the pin 1024 to move inwardly thereby allowing to unscrew the cap 1022 in order to remove it and release any panel cover hatch and the like.

Turning now to FIG. 174, there is shown a canister 1030 similar to the canister described above having a canister cover 1032 and including wheel element 1034 and other articles therein. As shown a cup 1034 with a cap 1036 is used and includes a string 1038 so be kept into place and not lost (the other caps described in this section may also include a strong 1038). Therefore, the system shown in FIG. 160 is similar to the system shown in FIGS. 154 to 156 and includes bottom cords 140 locking the spring system to the hall floor.

Removable Deck Hatches/Panels

FIGS. 161 to 165 will show removable hatch or panel covers 2000 of the present invention.

FIG. 161 shows a first panel 2000A and a second panel 2000B. Panel 2000A has a hook and shown in portion 161P and denoted by reference numeral 2001. The hook end 2001 includes a seal 2002, placed along the contour of the hooking element 2001. The hooking element 2001 mates with a corresponding female receiving element 2003 at an end of panel or hatch cover 2000B. FIG. 163 shows the panels 2000A and 2000B in a mated position. As shown in FIG. 162 and in portion 163P, the female member 2003 of a removable panel or of the deck body 2005 shown in portion 162P of FIG. 162, can include a seal 2006. Furthermore, as shown in portion 163P, the female element may include a seal 2007 on its inner surface. It should be noted that seals 2002 and 2007 are transverse seals and prevent water from going through adjoined panels/hatches such as 2000A and 2000B. Whereas, seals 2006 are peripheral seals and avoid water going into the periphery of the panels/hatches of the present invention. Thereby, the present removable panel/hatch system 2000 is watertight.

With respect to FIG. 164, the panels 2000A and 2000B can be at the level of the deck 2010 or at the level of the floor 2012, thereby providing cockpits and the like. The same is shown for panel 2014 in FIG. 165, which can be placed at the deck level 2016 or at the hull floor level 2018, as has been previously described herein.

Mast Mounting Assembly

FIGS. 166 to 170 show a panel 2020 mounted to a watercraft 2022. The panel includes a mast receiving aperture 2024. The panel 2020 is mounted on the deck 2026 via lock knobs 2028 which are received in lock knob deck receivers 2030 shown in FIG. 167.

A mast 2032 having a flexible mast base 2034 is mounted within a base lock system 2036 which is positioned within the aperture 2024. With reference to FIG. 168, the flexible mast receiving element 2036 is mounted within aperture 2024 via the internal side of the hatch panel 2020 providing for the flexible base 2034 to then be mounted within the receiver 2036.

FIG. 167 shows that the hatch panel 2020 can be mounted at the hull floor level 2038 via lock, knobs 2026 which are mounted within knob lock receivers 2040 as shown in FIG. 166.

FIG. 169 shows that a mast 2042 without flexible base member can also be mounted within panel 2020. In this case, a stayed mast sleeve 2044 better shown in FIG. 170, is placed within the aperture 2020 for it to be secured therein. The mast 2042 is then placed through the hole defined by the stayed mast sleeve 2044. The ring 2046 on the mast 2042 will engage element 2048 as it is brought down towards the floor 2027 of the hull thereby locking the mast 2042 into the stayed mast receiver 2044. The bottom end of the mast is also secured within a moulded recess 2050 that is formed on the floor 2027 of the hull 2029.

Removable Mast Halyard Bracket

With reference to FIGS. 171 and 172, a removable mast halyard bracket 3000 will be described herein. This removable bracket 3000 is used when putting both a spinnaker and a sail on a watercraft.

As can be seen, the mast 3002 is engaged by claw fingers 3004 which include internal cushions 3006. The bracket 3000 includes lock nuts 3008 as well as a bolt knob 3010 that is inserted in a female thread 3012 for tightening the bolt 3014, thereby closing fingers 3004. Furthermore, the bracket 3000 includes adjustable ring attachments 3014.

In this way, the fingers 3004 are movable about shaft 3016 to open and close, thereby gripping the mast 3002 and providing a space therebetween for the sail 3018.

Mast-Wishbone Mounting Bracket

With reference to FIG. 173, the mast wishbone bracket 457 will be herein described.

As shown the mast wishbone bracket 457 includes two separate mast jaw casing pieces 3024, which have internal locking pins 3026 that engage complementary apertures within the mast M. The pins 3006 also have gaskets 3028.

The bracket 457 also includes a wishbone jaw casing 3030 that is movable about a hinge 3032 and forms a hole 3034 with the casing 3024 in order to provide a space for the wishbone 3036. Once the casing 3030 is in the closed position, knobs 3038 will be tightened in order to pass lock bolt 3040 through the mast M and into the casing 3030 thereby locking the bracket 457.

A ring member 3024 is brought onto the mast jaw casing 3024 on the underside thereof. A ring support casing 3044 is threaded into the mast jaw casing, at the underside thereof, in order to tightly support this rig 3042 which does not rotate with the mast M during mast rotational movement. The ring 3042 includes hook member 3046 in order to receive various ropes. It should be noted that the casing 3030 also includes an attachment hook 3048. Turning now to FIG. 174, the outrigger beam hull mounting bracket 3050 will be described herein. As is shown, the beam 3052 is mounted to an outrigger hull 3054 via a bracket element 3056, which is shown in enlarged portion P1 showing a front view A and a top view B thereof.

Outrigger Beam/Hull Brackets

Turning now to FIG. 174*a*, the bracket 3056 provides for mounting the beam 3052 on to the outrigger hull 3052H. The bracket 3056 consists of a lock bolt element 3054H that attaches to the top of the hull 3052H, as well as screw members 3056, which are received in threaded openings 3058, formed within the top of the outrigger hull 3052H.

Portion P2 shows a bracket 3059 for adjusting the length of the outrigger beam 3052. As shown in portion P2.1, the bracket has an elastic loop 3060, a pin member 3062, a rubber seal cap 3064, a pin and lock 3066, which is shown in greater detail in portions P3 and P4. The pin and lock 3066 is inserted in the pin base lock 3068 at the end of the pin 3062 and looped by the elastic loop 3060 to be kept in place as shown in FIG. 174*b*.

Turning now to portion P3, the beam 3052 is secured to a main watercraft hull 3070 via a bracket 3072. This bracket 3072 includes a locking knob screw 3074 as well as a locking pin member 3076 and a bottom bolt 3078. It should be noted that the locking knob 3074 includes side notches 3080 as well as an elastic lock member 3082 that is fixed to both the knob screw 3074 as well as the deck 3084, thereby engaging the notches 3080 during unscrewing movement of the screw knob 3074, thus avoiding unscrewing the knob 3074.

Seats

FIGS. 175 and 176 show a trapeze or outrigger seat 3100 in accordance with an embodiment of the present invention.

The seat 3100 includes a lower engaging area 3102 that snaps on to a seat axle 3104, which is on the inside of a deck 3106. More specifically, the inner portion of the deck 3106 defines a seat receiving structure 3108. Once the seat has been snapped on to the axle 3104 by sliding it under the deck 3106 via a rotating movement (as shown by arrow R). A lock knob 3110 locks the seat 3100 into place and allows it to move in a side to side fashion from the bow B to the stern S as shown by arrow L.

With reference to FIGS. 177 to 180, a retractable outrigger seat 3150 will be described.

The seat 3150 includes push button lock knobs 3152 which are illustrated in detail in FIG. 178 and which are known in the art. As can be seen, knobs button lock knobs 3152 include a knob 3154, a casing 3156, a spring 3158 as well as a t-lock 3160. When releasing the push button lock knobs 3152, the seat 3900 can be rotated about hinge 3162 shown in FIGS. 179*a*, 179*b* and FIG. 180.

Figure 179B:
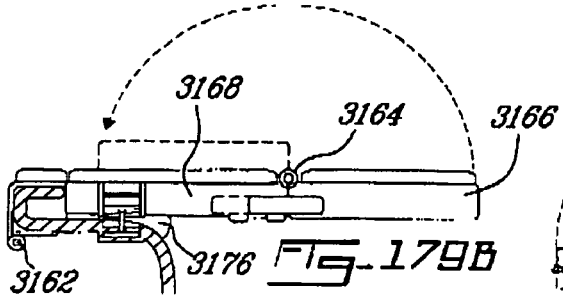
Figure 179A:
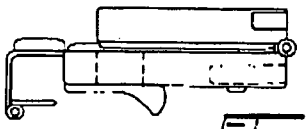

As shown in FIGS. 179*a* and 179*b*, the retractable outrigger seat 3150 also includes a hinge 3164 in order to close or open a pair of seat members 3166 and 3168. The hinge 3162, as shown in FIG. 180, mounts the retractable seat 3150 into the inner side 3170 of a deck 3172, hence the retractable seat is rotatable about hinge 3162 and includes an extension member 3174, which connects hinge 3162 to the seat 3150. A cushion 3176 is also provided to avoid the seat hitting the deck too abruptly, causing damage thereto.

FIGS. 181 to 184 show a seat 3200, which in one example can be used for a kayak, in accordance with an embodiment of the invention.

The seat 3200 is shown in FIG. 181 having a back rest 3202 as well as a seat 3204 and a back rest support 3206 there between. As shown in FIGS. 181 and 183, a hull seat receiver bar 3208, having a variety of apertures 3210 provides for backing knobs 3212 to adjust the seat 3200 along the length of the bar 3208. FIG. 182 shows that the seat 3200 includes back rest cable angle adjustment 3214. FIG. 181 shows that the back rest 3202 also has an adjustment mechanism 3216. Finally in FIG. 184 the seat 3200 is shown in the folded position within a seat bag 3218.

FIGS. 185 to 188 show a seat 3300 such as a cockpit seat for example, in accordance with an embodiment of the present invention.

The seat 3300 includes a back rest 3302 as well as a seat 3304 and a flexible back rest support 3308. FIG. 187 shows the seat 3300 in a fold away arrangement. FIG. 188 shows the seat 3300 within a compartment 3310 between a deck 3312 and a hull floor 3314. The seat 3300 is adjusted via screw knobs 3316 on the floor 3314 and is adjusted via an attachment 3318 on to a deck 3312 inner formation 3320.

Retracting Rudder and Keel (Centreboard/Daggerboard) and Rudder Steering Assemblies With respect to FIG. 189, the retractable rudder and keel or centerboard system (or assembly) will be described herein.

FIG. 189 shows a watercraft 5000 having a hull 5001 and a deck 5002. A retractable centerboard 5003 that is movable along the position shown by arrow X via the centerboard shaft 5004 and including reinforcement plate 5005. An up-board cord 5006 is mounted to the reinforcement plate 5005 at one end thereof and at another end thereof to the up-cord roller channel 5010. A down-board cord 5007 is mounted to the reinforcing plate 5005 and to a down-cord channel 5009 at the other end thereof. The up-board channel 5010 leads to an up-cord stowage lever 5011 which includes a flip up cover 5011*a* as well as hook member 5011*b*. The down-cord channel leads to a down-cord stowage and lock 5100 which includes a loop cord 5102, hooks 5104 and a flip up cover 5106.

The up-cord 5011 is mounted to a rotary disk rudder control 5044 which can have a tiller or steering stick 5046 mounted thereon for control thereof or can be controlled by the foot as has been previously explained.

In operation in order to move the centerboard 5003 between the retracted position and extended position along arrow X, the user will flip open cover 5011*a* and pull on the up-board cord 5006 thereby moving the centerboard 5003 into the retracted position. Accordingly, in order to move the centerboard 5003 into the extended position, the user will flip open cover 5106 and pull on cord 5102, which will pull on the down-board cord (cable) 5007 moving the centerboard 5003 towards the downward position.

Now turning to the rudder blade 5200, it is mounted to the watercraft 5000 via a shaft 5202.

Also shown, are the rudder up-cord 5012 and the rudder down-cord 5013 which are both mounted to the rudder 5200. The rudder up-cord 5012 and the rudder down-cord 5013 act on the rudder 5200 in order to pull it in or retract it out as shown by arrow Y. This its more clearly shown in FIG. 189*a*, which shows that pulling on the cord 5013 moves the rudder 5200 in the downward position while pulling cord 5012 moves it towards the up position.

FIG. 189 also shows a toothed belt 5014 that is mounted on one end to a primary drive pulley 5015 and at another end to a secondary drive pulley 5016 which is mounted about the shaft 5202. Hence, allowing the rudder 5200 to rotate about the axis defined by shaft 5202.

Turning now to the deck 5002, there is a cap 5020 which has apertures 5022 for locking the balls 5024 of both the cords 5012 thereon. Hence as shown in figure section 189*b* a rotating rudder assembly 5026 is provided on which a rudder stick or steering stick or tiller 5028 can be mounted via a stick adapter 5030. A foot steering pedal cable 50198 is also attached to the secondary pulley 5016.

Rotary Plate Member Rudder Control

With respect to FIGS. 190 and 192, a rotary plate member in the form of the rotary control disk 5044 for the rudder 5200 will be described herein.

The disk 5044 includes a central primary pulley 5015, a driving element in the form of a toothed belt 5014 is mounted thereon and is also mounted to a secondary pulley 5016 at another end thereof. Belt tensioners 5017 engage the belt, (these tensioners 5017 are also shown in FIG. 189). Therefore, the belt and pulleys define a driving assembly.

The rotary disk 5044 can either be controlled by a foot, thereby turning the pulley 5015, which acts on belt 5014, which acts on pulley 5016, which acts on shaft 5202, which acts on the rudder 5200. In another embodiment, a tiller steering stick 5028 is mounted in an aperture 5050 of the disk 5044. Turning now to FIG. 192, it is shown that a variety of primary disks 5015*a*, 5015*b* and 5015*c* can be used in order to induce a corresponding rotation of the secondary pulley 5016 as is known in the art. Also shown are the cables 5019 which are attached to the pulley 5016 and lead to foot pedals. Furthermore, the disk control 5044 includes slots 5052 and 5054 with stoppers 5056 and 5058 respectively in order to control the movement thereof.

With respect to FIG. 193, the disk 5044 is show having a shaft 5060 that controls the pulley 5062 that is mounted to the belt 5014. In this case both the disk 5044 and the panel or hatch 5064 are both removable. The user, by accessing the inside of the watercraft can remove tensioners 5017 which will then release the pulley 5062 and the panel or hatch 5064 along with disk 5044 and the shaft 5060 as well as the pulley 5062 can be removed thereby accessing an internal stowage compartment or providing a cockpit and the like as has been described herein.

As the skilled artisan will easily understand and as should be noted, all the features, articles, characteristics, components, variations, structures, members, and configurations of all the watercrafts described herein can be combined in a variety of ways to provide non-illustrated embodiments within the scope of the present invention.

Furthermore. It is to be understood that the invention is not limited in its application to the details of construction and pads illustrated in the accompanying drawings and described hereinabove. The invention is capable of other embodiments and of being practiced in various ways. It is also to be understood that the phraseology or terminology used herein is for the purpose of description and not limitation.

Hence, although the present invention has been described hereinabove by way of embodiments thereof, it can be modified, without departing from the spirit, scope and nature of the subject invention as defined in the appended claims.

What is claimed is:

1. A kayak comprising:

a main body comprising a main hull, a bow end and an opposite stern, a starboard lateral side and a port lateral side and a deck;

a stowage compartment defined within said main hull and comprising an internal floor;

a hatch for covering said stowage compartment and providing access to said stowage compartment when removed, said hatch comprising mating elements about an edge thereof for lockingly and releasably engaging complementary mating elements about a deck opening edge thereby covering said stowage compartment, and for lockingly and releasably engaging complementary mating elements within said stowage compartment thereby providing a second floor spaced above the internal floor of said stowage compartment thereby defining a cockpit;

an outrigger hull assembly mountable to said main body and stowable within said stowage compartment when said kayak is use;

a mast and sail assembly removably mountable to said main body and stowable within said stowage compartment when said kayak is in use;

wherein said kayak is transformable into a sailboat when mounting said outrigger hull assembly and said mast and sail assembly to said main body, said sailboat being transformable back into said kayak when removing said outrigger hull assembly and said mast and sail assembly from said main body.

2. A kayak according to claim 1, wherein said deck comprises a mast receiving well.

3. A kayak according to claim 1, wherein said outrigger hull assembly comprises auxiliary hulls mountable to a beam, said deck comprising internal supporting elements for receiving said beam.

4. A kayak according to claim 3, wherein said beam is adjustable in length.

5. A kayak according to claim 3, wherein said beam is adjustable in height.

6. A kayak according to claim 1, wherein said main body comprises a retractable element selected from the group consisting of a retractable rudder, a retractable keel, a retractable centerboard, retractable seat, retractable latch, retractable lock, a retractable daggerboard, and a retractable cleat.

7. A kayak according to claim 1, wherein said main body comprises a retractable cleat, said retractable cleat comprising a casing for being mounted within a recess of said deck, said casing including a screw member being threadably mounted within said casing, said screw member carrying at least one shackle member, wherein said screw member is movable between a first position where said shackle is above said deck surface about said recess and a second position where said shackle is below said deck surface about said recess.

8. A kayak according to claim 1, further comprising a wishbone boom mountable to said mast and sail assembly via a wishbone bracket and stowable within said stowage compartment when said kayak is in use.

9. A kayak according to claim 8, wherein said mast and sail assembly comprises a mast, said wishbone bracket comprises: a mast mounting casing for being mounted about said mast, a wishbone mounting casing for being mounted to said mast mounting casing and comprising a wishbone receiving portion; and a locking assembly for locking said mast mounting casing to said mast, for locking said wishbone mounting casing to said mast mounting casing when said mast mounting casing is mounted to said mast; and for locking said wishbone mounting casing to said wishbone boom when said wishbone mounting casing is mounted to said mast mounting casing.

10. A kayak according to claim 1, wherein said mast and sail assembly comprises a mast, a main sail and a mast control assembly mountable to said mast.

11. A kayak according to claim 10, wherein said mast control assembly comprises a forestay rope, a starboard shroud rope and a port shroud rope mountable to said mast and to said main body.

12. A kayak according to claim 1, wherein said main body comprises a mast well leading to a well floor, a base receiving element being securely mountable within said mast well for receiving a mast base thereon, said well floor comprising a mast support for so as to receive a mast through said mast well.

13. A kayak according to claim 1, further comprising a mast and sail assembly, said mast and sail assembly comprising a mast mountable to a flexible base.

14. A kayak according to claim 1, further comprising a trailer assembly for the land-transport thereof.

15. A kayak according to claim 14, wherein said trailer assembly comprises wheel members being mountable to an axle-shaft assembly, said axle-shaft assembly being mountable to an axle-shaft assembly receiving portion formed in said main body, wherein said wheels when mounted to said watercraft provide for land-transport of the watercraft.

16. A kayak according to claim 14, wherein said trailer assembly is stowable within said stowage compartment.

17. A sailboard comprising:

a main body comprising a deck and a hull, said deck comprising a generally contiguous flat surface allowing a user to stand thereon when in use and comprising a mast receiving well for mounting thereon a mast and sail assembly;

said hull comprising a stowage compartment therein, said stowage compartment defining a floor opening edge; and a rudder being pivotal about a vertical axis thereof and a rudder control assembly in operational communication with said rudder and comprising a rotary plate member being flush with said deck and being rotatably moveable about an axis thereof, wherein rotational movement of said plate member actuates said rudder to correspondingly pivot about its vertical axis.

18. A sailboard according to claim 17, further comprising a hatch cover mountable to said deck and being flush therewith for covering said stowage compartment, said hatch cover bring removable from said deck and mountable within said stowage compartment about said floor opening edge thereby providing a cockpit for the user transforming said sailboard into a sit-in watercraft, said hatch cover comprising mating elements about an edge thereof for lockingly and releasably engaging complementary mating elements about a deck opening edge, and for lockingly and releasably engaging complementary mating elements about said floor opening edge.

19. A sailboard according to claim 17, wherein said stowage compartment is configured to receive said mast and sail assembly therein.

20. A sailboard according to claim 17, wherein said deck comprises outrigger hull supporting elements for receiving an outrigger hull assembly.

21. A sailboard according to claim 19, wherein said outrigger hull assembly comprises auxiliary hulls mountable to a beam, said supporting elements receiving said beam.

22. A sailboard according to claim 21, wherein said beam is adjustable in length.

23. A sailboard according to claim 21, wherein said beam is adjustable in height.

24. A sailboard according to claim 17, wherein said stowage compartment is configured to receive said outrigger hull assembly therein.

25. A sailboard according to claim 17, wherein said rudder control assembly comprises a driving assembly in operational communication with said rotary plate member and with said rudder.

26. A sailboard according to claim 25, wherein said plate member comprises a disk.

27. A sailboard according to claim 26, wherein said plate member comprises a tiller-stick mounting element for mounting a tiller stick thereto.

28. A sailboard according to claim 17, wherein said hatch cover comprises a mast receiving well.

29. A sailboard according to claim 17, wherein said deck comprises a mast receiving well.

30. A sailboard according to claim 17, wherein said main body comprises a retractable element selected from the group consisting of a retractable rudder, a retractable keel, a retractable centerboard, a retractable seat, a retractable lock, a retractable latch, a retractable daggerboard, and a retractable cleat.

31. A sailboard according to claim 17, wherein said main body comprises a retractable cleat, said retractable cleat comprising a casing for being mounted within a recess of said deck, said casing including a screw member being threadably mounted within said casing, said screw member carrying at least one shackle member, wherein said screw member is movable between a first position where said shackle is above said deck surface about said recess and a second position where said shackle is below said deck surface about said recess.

32. A sailboard according to claim 17, further comprising a wishbone boom mountable to said mast and sail assembly via a wishbone bracket and stowable within said stowage compartment.

33. A sailboard according to claim 31, wherein said mast and sail assembly comprises a mast, said wishbone bracket comprises: a mast mounting casing for being mounted about said mast, a wishbone mounting casing for being mounted to said mast mounting casing and comprising a wishbone receiving portion; and a locking assembly for locking said mast mounting casing to said mast, for locking said wishbone mounting casing to said mast mounting casing when said mast mounting casing is mounted to said mast; and for locking said wishbone mounting casing to said wishbone boom when said wishbone mounting casing is mounted to said mast mounting casing.

34. A sailboard according to claim 31, wherein said mast and sail assembly comprises a mast, a main sail and a mast control assembly mountable to said mast.

35. A sailboard according to claim 34, wherein said mast control assembly comprises a forestay rope, a starboard shroud rope and a port shroud rope mountable to said mast and to said main body.

36. A sailboard according to claim 17, wherein said main body comprises a mast well leading to a floor, a base receiving element being securely mountable within said mast well for receiving a mast base thereon, said floor comprising a mast support for so as to receive a mast through said mast well.

37. A sailboard according to claim 17, further comprising a mast and sail assembly, said mast and sail assembly comprising a mast mountable to a flexible base.

38. A sailboard according to claim 17, further comprising a trailer assembly for the land-transport thereof.

39. A sailboard according to claim 38, wherein said trailer assembly comprises wheel members being mountable to an axle-shaft assembly, said axle-shaft assembly being mountable to an axle-shaft assembly receiving portion formed in said main body, wherein said wheels when mounted to said sailboard provide for land-transport of said sailboard.

40. A sailboard according to claim 38 wherein said trailer assembly is stowable within said stowage compartment.

41. A watercraft comprising:

a main body comprising a main hull defining an internal stowage compartment and a deck including a removable hatch cover providing access to said stowage compartment; and auxiliary elements comprising an outrigger hull assembly and a mast and sail assembly, said auxiliary elements being removably mountable to said main body, said outrigger hull assembly comprising auxiliary hulls mountable to a beam, said deck comprising apertures for receiving said beam, said beam being adjustable in length said stowage compartment comprising a floor defining respective molded recessed nests for each auxiliary hull and molded longitudinal recessed nests for the mast and sail assembly.

* * * * *